US006625845B2

(12) United States Patent
Matsumoto et al.

(10) Patent No.: US 6,625,845 B2
(45) Date of Patent: Sep. 30, 2003

(54) CYCLONIC VACUUM CLEANER

(75) Inventors: Yukimichi Matsumoto, Nara (JP); Hiroshi Ota, Yao (JP); Yuji Onishi, Sakai (JP); Kenji Kimura, Nara (JP); Takayuki Tujii, Mie (JP); Masahiro Sato, Habikino (JP); Kouji Ninomiya, Yamatotakada (JP); Kazumasa Hayashi, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/814,772

(22) Filed: Mar. 23, 2001

(65) Prior Publication Data

US 2001/0025395 A1 Oct. 4, 2001

(30) Foreign Application Priority Data

| | | |
|---|---|---|
| Mar. 24, 2000 | (JP) | 2000-088500 |
| Aug. 7, 2000 | (JP) | 2000-238691 |
| Aug. 9, 2000 | (JP) | 2000-241333 |
| Aug. 10, 2000 | (JP) | 2000-242811 |

(51) Int. Cl.[7] ..... A47L 9/20

(52) U.S. Cl. ..... 15/353; 15/352; 55/DIG. 3; 55/295; 55/305; 55/337; 55/429

(58) Field of Search ..... 15/352, 353; 55/289, 55/295, 304, 305, 337, 428, 429, DIG. 3

(56) References Cited

U.S. PATENT DOCUMENTS

| | | | | | |
|---|---|---|---|---|---|
| 1,759,947 | A | * | 5/1930 | Lee | 15/353 |
| 2,287,921 | A | * | 6/1942 | White | 15/352 |
| 2,570,307 | A | * | 10/1951 | Bell et al. | 15/352 |
| 2,684,125 | A | * | 7/1954 | Brace | 55/305 |
| 3,320,727 | A | * | 5/1967 | Farley et al. | 15/353 |
| 3,755,992 | A | * | 9/1973 | Ylinen | 15/353 |
| 3,797,064 | A | * | 3/1974 | MacFarland | 15/352 |
| 4,246,011 | A | * | 1/1981 | Oberdorfer | 55/289 |
| 4,363,156 | A | * | 12/1982 | Leinfelt | 55/428 |
| 4,571,772 | A | * | 2/1986 | Dyson | 15/352 |
| 4,944,780 | A | | 7/1990 | Usmani | 15/353 |
| 5,045,098 | A | * | 9/1991 | Poor | 55/304 |
| 5,145,499 | A | * | 9/1992 | Dyson | 15/352 |
| 5,254,147 | A | * | 10/1993 | Finke | 15/353 |
| 5,267,371 | A | * | 12/1993 | Soler et al. | 15/352 |
| 5,935,279 | A | * | 8/1999 | Kilstrom | 15/353 |
| 5,950,274 | A | * | 9/1999 | Kilstrom | 15/353 |
| 6,083,292 | A | * | 7/2000 | Fumagalli | 55/DIG. 3 |
| 6,141,826 | A | * | 11/2000 | Conrad et al. | 15/353 |
| 6,146,434 | A | * | 11/2000 | Scalfani et al. | 15/353 |

(List continued on next page.)

FOREIGN PATENT DOCUMENTS

| | | |
|---|---|---|
| CA | 978485 A | 11/1975 |
| DE | 1 059 636 | 6/1959 |
| EP | 0 827 710 A2 | 3/1998 |
| JP | 05104033 | 4/1993 |

*Primary Examiner*—Theresa T. Snider
(74) *Attorney, Agent, or Firm*—Birch, Stewart, Kolasch & Birch, LLP

(57) ABSTRACT

In an electric vacuum cleaner, in a suction air passage provided between a nozzle unit having a nozzle and an electric blower for producing a suction air flow, a separator for separating dust from the suction air flow is arranged. In the separator, a dust collection chamber for collecting the separated dust is provided. The separator is fitted with an exhaust tube having an outlet, fitted with a filter, formed in the peripheral surface thereof so that the suction air flow is exhausted out of the separator through the exhaust tube to the downstream side of the suction air passage. The separator is fitted with a cleaning member having a brush for cleaning the filter. When the cleaning member is moved with the brush keeping contact with the filter, the dust that has settled on the filter is raked off. The cleaning member is moved through manual operation, with a motor, or by the suction air flow.

32 Claims, 41 Drawing Sheets

U.S. PATENT DOCUMENTS 6,158,484 A * 12/2000 Greenlee ..... 141/242
6,192,550 B1 * 2/2001 Hamada et al. ..... 15/352
6,195,835 B1 * 3/2001 Song et al. ..... 15/352
6,269,518 B1 * 8/2001 Yung ..... 15/352
6,341,404 B1 * 1/2002 Salo et al. ..... 15/352
6,353,963 B1 * 3/2002 Bair et al. ..... 15/352
6,375,696 B2 * 4/2002 Wegelin et al. ..... 15/352
6,502,320 B2 * 1/2003 Buckner et al. ..... 33/286
6,550,121 B2 * 4/2003 Weiss et al. ..... 29/407.07

* cited by examiner

CYCLONIC VACUUM CLEANER

BACKGROUND OF THE INVENTION

1. Field of the Invention

The present invention relates to an electric vacuum cleaner, and particularly to an electric vacuum cleaner having a cyclone-type dust collector that separates dust with a whirling air flow produced from air sucked in.

2. Description of the Prior Art

A conventionally known type of electric vacuum cleaner has a cyclone dust collector that separates dust with a whirling air flow produced from air sucked in by driving an electric blower. FIG. 49 is a diagram schematically showing a conventional example of such an electric cleaner. A nozzle unit 4 has a nozzle 4*a* that faces a floor surface F, and, to this nozzle unit 4, a connection pipe 3 is connected. To the connection pipe 3, a cyclone dust collector 5 is coupled.

The cyclone dust collector 5 communicates with a main body 1 of the electric vacuum cleaner having an electric blower 1 a through a coupling member 10 and a suction hose 2, thereby forming a suction air passage. Part of the coupling member 10 is bent so as to form a handle 10*a* to be held by the user. On the handle 10*a* is provided an operation portion log having operation keys with which to control the operation of the electric vacuum cleaner, a display for indicating the operation status thereof, and the like.

When the electric blower 1*a* is driven, air is sucked in through the nozzle 4*a* of the nozzle unit 4 as indicated by arrow f1, and the air thus introduced flows through the connection pipe 3 into the cyclone dust collector 5 through an inlet 5*a* thereof. Inside the cyclone dust collector 5, the air is turned into a whirling air flow by which dust is separated and removed from the air. Thereafter, by the suction force of the electric blower 1*a*, the air is exhausted out of the main body 1 of the electric vacuum cleaner as indicated by arrow f2.

FIGS. 50, 51, and 52 are a perspective view, a vertical sectional view, and a horizontal sectional view, respectively, showing the details of the cyclone dust collector 5. The cyclone dust collector 5 has, in an upper portion thereof, a suction air guide 20 having the inlet 5*a* formed therethrough, and is coupled to the connection pipe 3 through this suction air guide 20. The cyclone dust collector 5 is substantially cylindrical in shape, and is arranged parallel to the connection pipe 3. The introduced air flows into the cyclone dust collector 5 through the inlet 5*a* in the direction of a line tangent to the inner wall 5*c* of the cyclone dust collector 5.

The coupling member 10 has a coupling pipe 10*b* formed integrally therewith. The coupling pipe 10*b* has a closed end surface 10*c* at one end, and, at this end, reaches into the cyclone dust collector 5. In the peripheral surface of the coupling pipe 10*b* is formed, in a position lower than the inlet 5*a*, an outlet 5*b* through which the introduced air is exhausted out of the cyclone dust collector 5. The outlet 5*b* is fitted with a mesh filter having a large number of through holes.

Inside the suction air guide 20 is provided a valve 13 formed out of an elastic material such as rubber. The vacuum pressure of the introduced air bends this valve 13 in the direction of the flow of the air, and this causes the air that flows in through the inlet 5*a* to flow in the direction of a line tangent to the cyclone dust collector 5 as shown in FIG. 52. As a result, the introduced air collides with the inner wall 5*c* of the cyclone dust collector 5 and is thereby turned into a whirling air flow, of which the centrifugal force separates dust and collects it in a first dust collection chamber 7.

When no air is being sucked in, the valve 13, by its own elasticity, keeps the inlet 5*a* closed so as to prevent backflow of dust. This prevents the collected dust from scattering around, for example, when the electric vacuum cleaner is stored away.

Under the first dust collection chamber 7 is provided, substantially coaxially therewith, a second dust collection chamber 8, with a partition wall 9 arranged in between. As shown in FIG. 53, the partition wall 9 has an opening 9*a* formed therein, and this opening 9*a* is fitted with a mesh filter having a large number of through holes. The filter is formed out of mesh of resin such as a nylon-based resin, mesh of metal, or the like, and is fixed to the partition wall 9 by double molding, welding, or bonding. Fine particles of dust pass through the filter of the opening 9*a* and are collected in the second dust collection chamber 8.

The dust that flows into the cyclone dust collector 5 as air is sucked in by driving the electric blower la contains very fine particles. Such fine particles of dust are extremely light, and therefore cannot be separated by the centrifugal force of the whirling air flow produced in the cyclone dust collector. Thus, when the introduced air is exhausted through the outlet 5*b*, fine particles of dust are caught on the filter of the outlet 5*b*, and, as a result, this filter becomes clogged. In this case, the clogged portion of the filter exerts resistance to the air passing through the outlet 5*b*, and thereby makes the obtained suction force lower than is expected from the output of the electric blower 1*a*, leading to lower dust suction efficiency.

Much of the dust caught at the outlet 5*b* remains there even after the electric blower *a* stops being driven. Consequently, unless the electric vacuum cleaner is subjected to clearing on a regular basis, every time it is operated, dust collects and the clogging of the filter as described above lowers dust suction efficiency accordingly. That is, regular maintenance, such as the cleaning of the outlet 5*b*, is indispensable, which requires much time and trouble.

In addition, the outlet 5*b* is formed in the coupling pipe 10*b* that reaches into the cyclone dust collector 5, and thus is not easily detachable from the cyclone dust collector 5. This makes it difficult to keep the outlet 5*b* well-maintained by cleaning or the like. Hence, an attempt to clean the outlet 5*b* caked with dust by rubbing it with cloth or the like tends to leave not only the fingers and hands of the user but also the floor surface soiled and thus unhygienic with dust that has fallen off. Moreover, giving the outlet 5*b* a through cleaning takes considerable time and trouble, which makes the electric vacuum cleaner unsatisfactory in terms of user-friendliness.

Moreover, when relatively coarse pieces of dust, such as pieces of paper, collect in the first dust collection chamber 7, they may partially or totally clog the filter fitted in the opening 9*a* of the partition wall 9, hindering fine pieces of dust from being collected sufficiently in the second dust collection chamber 8. In this case, when the electric vacuum cleaner is operated next time, the dust left in the first dust collection chamber 7 is blown up by the whirling air flow produced in the cyclone dust collector 5. As a result, fine particles of dust are more likely to be caught at the outlet 5*b* as described above.

SUMMARY OF THE INVENTION

An object of the present invention is to provide an electric vacuum cleaner that permits easy maintenance, as in the cleaning of a filter disposed in a suction air passage, and in particular an electric vacuum cleaner of a cyclone type that separates dust with centrifugal force produced in a dust collector portion thereof and that permits easy maintenance of a filter provided at an outlet of the dust collector portion.

To achieve the above object, according to one aspect of the present invention, in an electric vacuum cleaner provided with a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a removable exhaust tube that permits the suction air flow to flow to the downstream side of the suction air passage.

In this arrangement, the exhaust tube can be detached from the cyclone dust collector, and thus it is easy to maintain the exhaust tube. It is possible even to clean the exhaust tube with water.

According to another aspect of the present invention, in an electric vacuum cleaner provided with a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a dust collection chamber for collecting separated dust, and the dust collection chamber is divided into a first compartment closer to where the suction air flow enters the dust collection chamber and a second compartment farther from where the suction air flow enters the dust collection chamber with a partition wall having an opening and arranged along the direction in which the suction air flow whirls around.

In this arrangement, the separated dust is transferred through the opening formed in the partition wall to the second compartment farther from where the suction air flow flows in, and this helps alleviate the mixing of the already collected dust with the suction air flow. This dust collection chamber has a simple structure, and is thus easy to maintain.

According to another aspect of the present invention, in an electric vacuum cleaner provided with a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a detachable dust collection chamber for collecting separated dust and a holding mechanism for detachably holding the dust collection chamber.

In this arrangement, the dust collection chamber is detachable, and is thus easy to maintain. In addition, the provision of the holding mechanism helps prevent unexpected detachment of the dust collection chamber.

According to another aspect of the present invention, an electric vacuum cleaner provided with a nozzle unit having a nozzle, an electric blower for producing a suction air flow, a suction air passage running between the nozzle unit and the electric blower, and a separator arranged in the suction air passage for separating dust from the suction air flow is further provided with: a detachable dust collection chamber that communicates with the separator and in which separated dust is collected; a filter through which the suction air flow from the separator passes to flow to the downstream side of the suction air passage; and cleaning means that cleans the filter in a manner interlocked with the movement of the dust collection chamber as the dust collection chamber is attached and detached.

In this arrangement, the filter is cleaned automatically every time the dust collection chamber is attached and detached. This makes it easy to maintain the filter.

According to another aspect of the present invention, an electric vacuum cleaner provided with a nozzle unit having a nozzle, an electric blower for producing a suction air flow, a suction air passage running between the nozzle unit and the electric blower, and a separator arranged in the suction air passage for separating dust from the suction air flow is further provided with: a detachable dust collection chamber that functions as the separator and in which separated dust is collected; an exhaust tube that has an outlet, fitted with a filter, formed in a peripheral surface thereof, that is inserted into the dust collection chamber through an opening formed in a wall of the dust collection chamber in such a way that the outlet is located inside the dust collection chamber, and that permits the suction air flow from the dust collection chamber to flow through the outlet to the downstream side of the dust suction passage; and cleaning means provided at the rim of the opening of the dust collection chamber for cleaning the filter.

In this arrangement also, the provision of the cleaning means makes it easy to maintain the filter. The exhaust tube may be fixed to the suction air passage, or may be fitted to the dust collection chamber. It is possible to additionally provide guiding means for guiding the attachment and detachment of the dust collection chamber.

According to another aspect of the present invention, an electric vacuum cleaner provided with a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow is further provided with: compressing means for compressing dust collected inside the cyclone dust collector.

In this arrangement, it is possible to secure a free space in the dust collector simply by compressing the collected dust. This helps reduce the frequency with which the collected dust needs to be disposed of In addition, since the collected dust is compressed, it is less likely to scatter around.

According to another aspect of the present invention, in an electric vacuum cleaner provided with a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with: an exhaust tube having an outlet, fitted with a filter, formed in a peripheral surface thereof so as to permit the suction air flow to flow through the outlet to the downstream side of the suction air passage; and cleaning means that cleans the filter by exploiting the force of the suction air flow that is flowing out of the exhaust tube.

In this arrangement, the filter is cleaned all the time, and is thus easy to maintain.

According to another aspect of the present invention, an electric vacuum cleaner provided with a nozzle unit having a nozzle, an electric blower for producing a suction air flow, a suction air passage running between the nozzle unit and the electric blower, and a separator arranged in the suction air passage for separating dust from the suction air flow is further provided with: a dust collection chamber that communicates with the separator and in which separated dust is collected; an exhaust tube having an outlet, fitted with a filter, formed in a peripheral surface thereof so as to permit the suction air flow to flow from the separator through the outlet to the downstream side of the suction air passage; and a cleaning member that moves while keeping contact with the filter and thereby cleans the filter.

In this arrangement, the filter can be cleaned simply by moving the cleaning member, and is thus easy to maintain. The cleaning member may be moved with a motor, or by exploiting the suction air flow produced by the electric blower, or even through manual operation.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
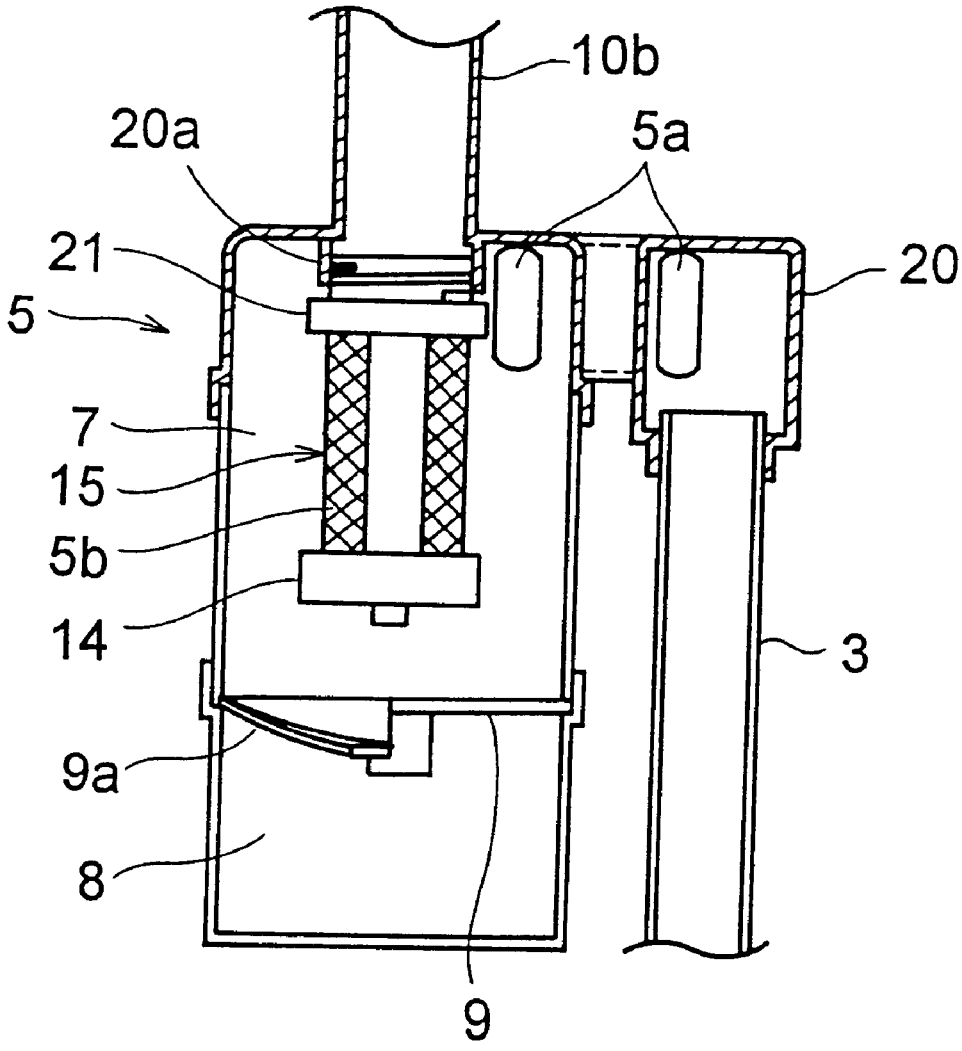
FIG. 1 is a vertical sectional view of the cyclone dust collector of the electric vacuum cleaner of a first embodiment.

Hereinafter, embodiments of the present invention will be described with reference to the drawings. The electric vacuum cleaners of the individual embodiments of the invention are characterized by different structures of their cyclone dust collectors, and, in other respects, have the same overall construction as the conventional electric vacuum cleaner shown in FIGS. 49 to 52. Accordingly, in the following descriptions and the drawings referred to, such members as are common to the embodiments of the invention and the conventional example are identified with the same reference numerals, and their detailed explanations will not be repeated.

First Embodiment

FIG. 1 is a vertical sectional view of the cyclone dust collector of the electric vacuum cleaner of a first embodiment of the invention. The cyclone dust collector 5 has, in an upper portion thereof, a suction air guide 20 having an inlet 5*a* formed therethrough. The cyclone dust collector 5 communicates with a connection pipe 3 that, together with the suction air guide 20, forms a suction air passage. The cyclone dust collector 5 is cylindrical in shape, and is arranged substantially parallel to the connection pipe 3. The air sucked in flows into the cyclone dust collector 5 through the inlet 5*a* along a path substantially perpendicular to the path of the air exhausted out of the cyclone dust collector 5.

On the suction air guide 20, a coupling pipe 10*b* that communicates with a coupling member 10 (see FIG. 50) is formed so as to protrude from approximately the center of the top surface of the cyclone dust collector 5. On the suction air guide 20, a holder portion 20*a* is also formed so as to communicate with the coupling pipe 10*b*. With this holder portion 20*a*, an exhaust tube 15 (described later) is detachably screw-engaged.

Figure 49:
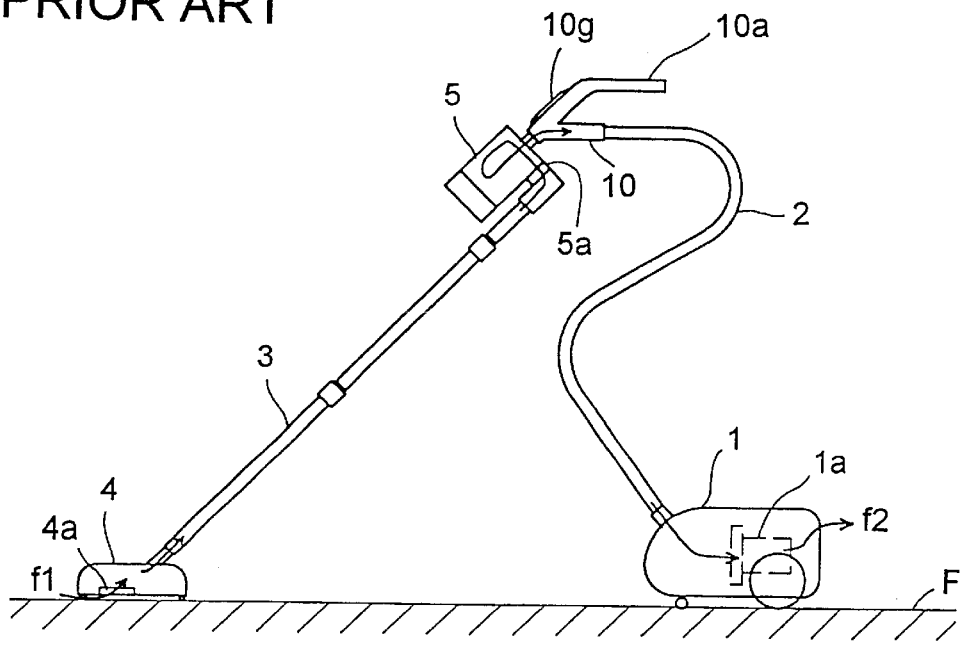
FIG.49 PRIOR ART
FIG. 49 is a diagram schematically showing the overall construction of a conventional electric vacuum cleaner.
Figure 50:
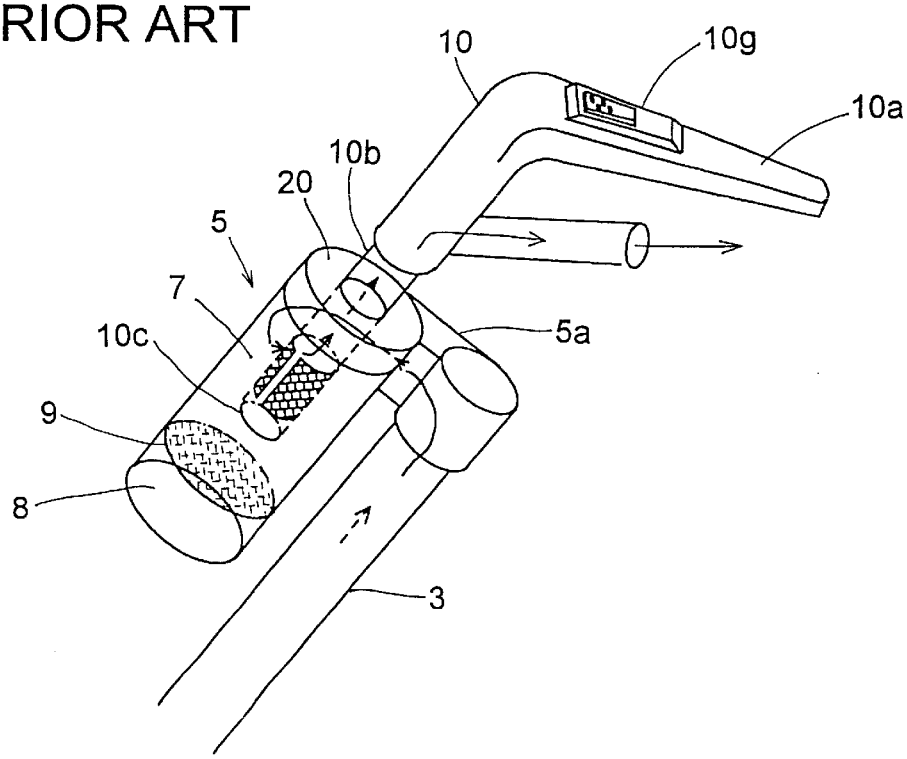
FIG.50 PRIOR ART
FIG. 50 is a perspective view of and around the cyclone dust collector of the conventional electric vacuum cleaner.
Figure 51:
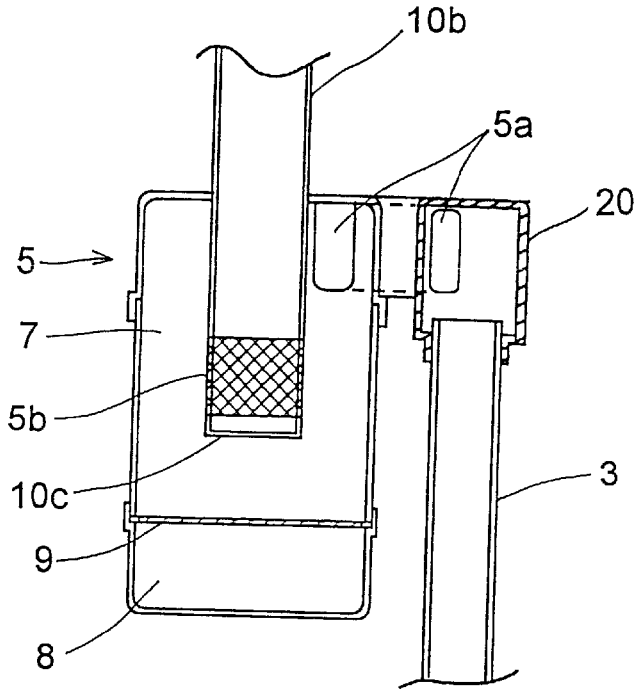
FIG.51 PRIOR ART
FIG. 51 is a vertical sectional view of the cyclone dust collector of the conventional electric vacuum cleaner.
Figure 52:
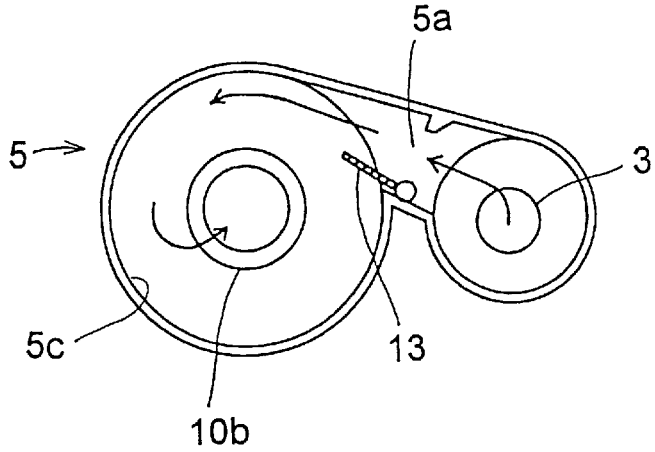
FIG.52 PRIOR ART
FIG. 52 is a horizontal sectional view of the cyclone dust collector of the conventional electric vacuum cleaner.
Figure 53:
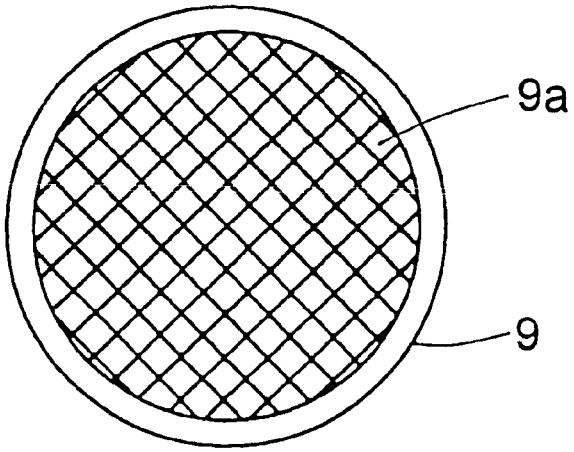
FIG.53 PRIOR ART
FIG. 53 is a top view of the partition wall provided in the cyclone dust collector of the conventional electric vacuum cleaner.

The cyclone dust collector 5 is arranged on the opposite side of the connection pipe 3 to the floor surface F (see FIG. 49). This permits the connection pipe 3 to be inclined until it makes contact with the floor surface F when the user cleans a gap under a bed or the like, and in addition prevents the cyclone dust collector 5 from colliding with the floor and being damaged even when the user happens to drop the connection pipe 3.

Figure 9:
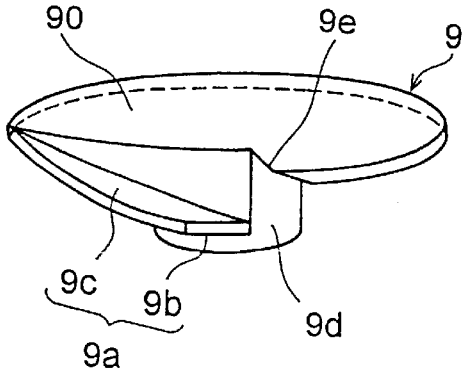
FIG. 9 is a perspective view of the partition wall provided in the cyclone dust collector of the electric vacuum cleaner of the first embodiment.
Figure 10:
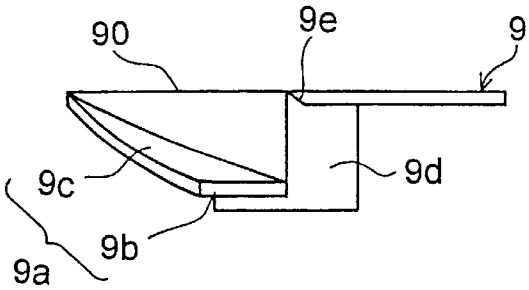
FIG. 10 is a side view of the partition wall.
Figure 11:
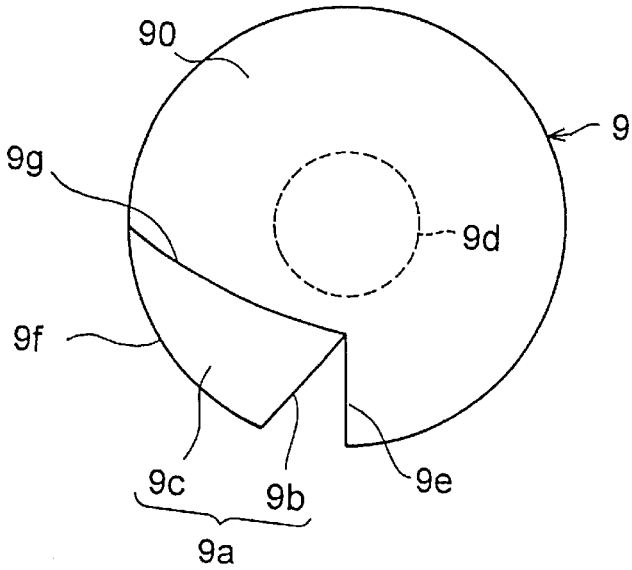
FIG. 11 is a top view of the partition wall.

Under a first dust collection chamber 7 is provided a partition wall 9, and, under the partition wall 9 is provided, substantially coaxially with the first dust collection chamber 7, a second dust collection chamber 8. The partition wall 9 is bonded or welded to the inner wall of the first dust collection chamber 7, or is formed integrally with the first dust collection chamber 7. As shown in FIGS. 9, 10, and 11, which are a perspective view, a side view, and a top view, respectively, the partition wall 9 has an opening 9*a* formed therein. The partition wall 9 is divided into a partition portion 90 that is flat, a horizontal portion 9*b* formed so as to be substantially horizontal in the direction of the air flow whirling inside the first dust collection chamber 7 and in a position lower than the partition portion 90, and a slope portion 9*c* formed by making part of the peripheral portion of the partition wall 9 describe a downward spiral with a gentle inclination. The horizontal portion 9*b* and the slope portion 9*c* together form the opening 9*a*. The opening 9*a* may be formed by the slope portion 9*c* alone.

In this way, the opening 9*a* is formed in the direction of the air flow whirling inside the first dust collection chamber 7 (FIG. 1). This permits the dust whirling together with the whirling air flow to be introduced smoothly into the second dust collection chamber 8, and thereby enhances the effect of separate collection of dust in the first and second dust collection chambers 7 and 8.

The edge portion 9*e* of the partition portion 90 of the partition wall 9 that faces the opening 9*a* is chamfered from the top to the bottom surface of the partition portion 9*a* in the direction of the whirling air flow. That is, the edge portion 9*e* is slanted with the same inclination as the slope portion 9*c*. This permits the dust separated by the centrifugal force of the air flow whirling inside the first dust collection chamber 7 to be collected in the second dust collection chamber 8 more easily.

Reference numeral 9*d* represents a dust retainer portion having substantially the shape of a hollow or solid cylinder protruding toward the second dust collection chamber 8. When a large amount of dust, such as fine particles of dust, is collected in the second dust collection chamber 8, the dust retainer portion 9*d* holds down the collected dust, and thereby effectively prevents the dust collected in the second dust collection chamber 8 from flowing back into the first dust collection chamber 7 and being thrown up.

Specifically, in FIG. 11, air, together with dust, flows into the second dust collection chamber 8 along an outer portion 9*f* of the opening 9*a*, and the air is sucked out of the second dust collection chamber 8 along an inner portion 9*g* of the opening 9*a*. Thus, the dust inside the second dust collection chamber 8 is collected mainly in a central portion thereof. The dust thus collected in the central portion of the second dust collection chamber 8 swells up as it follows the air flowing along the inner portion 9*g* of the opening 9*a*, and tends to flow back to the first dust collection chamber 7, but the dust retainer portion 9*d* prevents the dust from heaping up above a permissible level. In this way, it is possible to prevent backflow of dust into the first dust collection chamber 7. In addition, the dust retainer portion 9*d* is so formed as to be substantially circular in its horizontal section. This ensures smooth whirling of the air flow, and thereby permits dust to be collected evenly in the second dust collection chamber 8.

Figure 12:
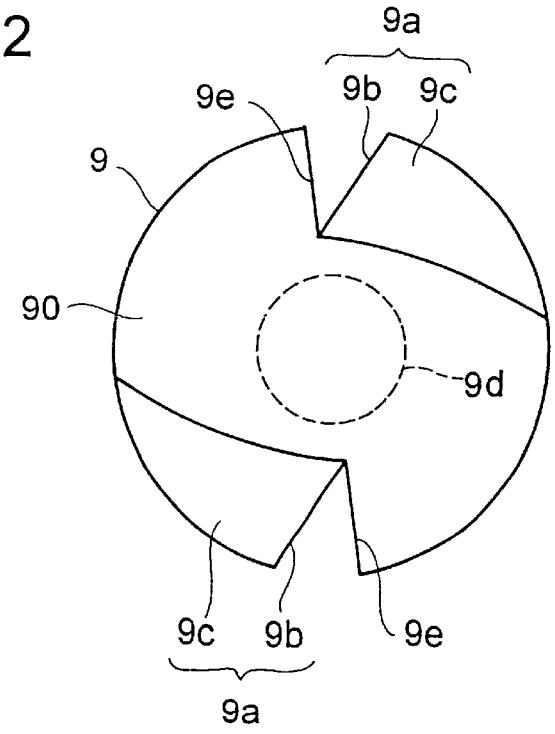
FIG. 12 is a top view of a modified example of the partition wall.

The partition wall 9 may have two openings 9*a* as shown in FIG. 12, or even more than two openings 9*a*.

Figure 2:
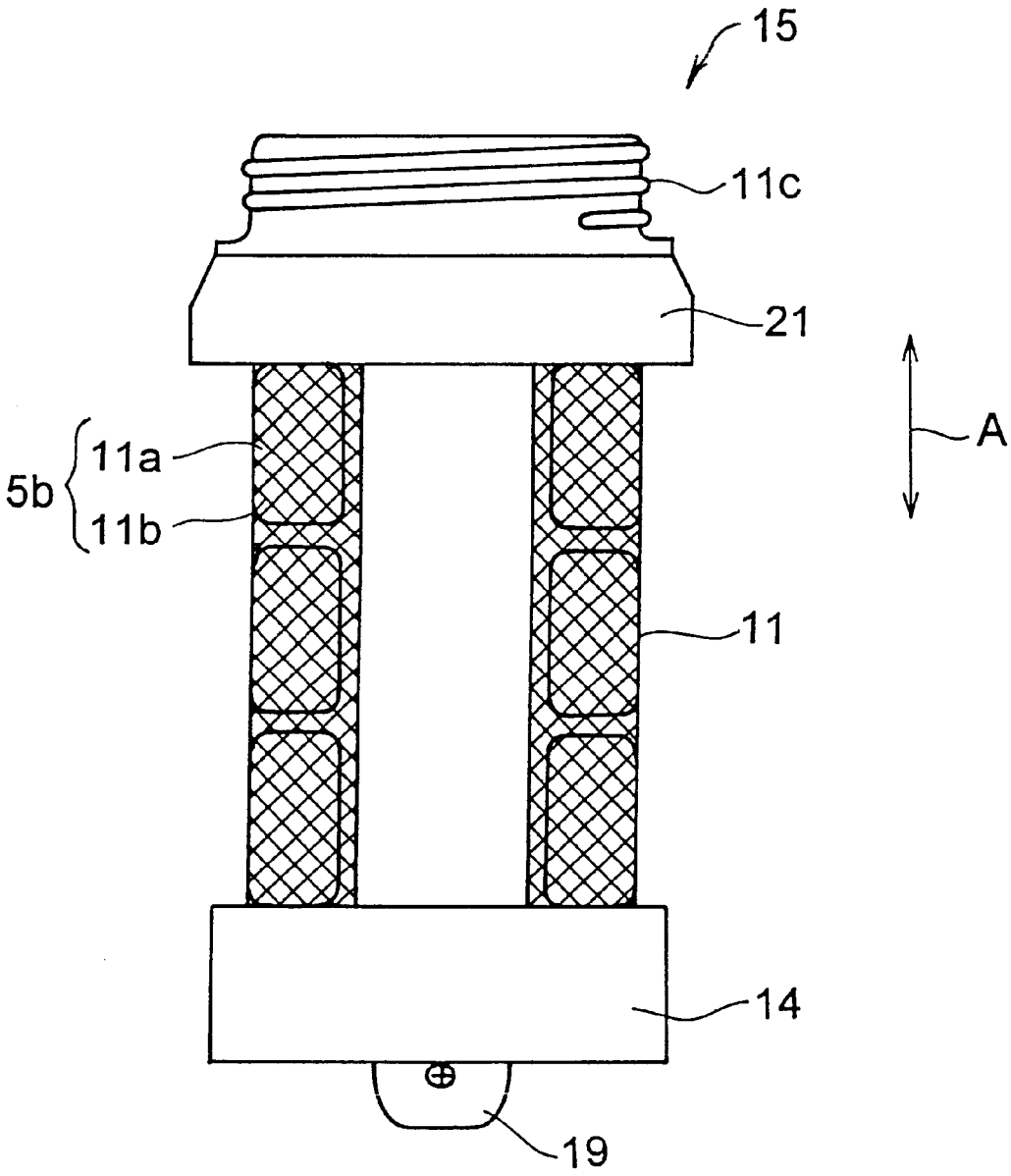
FIG. 2 is a side view of the exhaust tube provided in the cyclone dust collector in the first embodiment.

FIG. 2 is an external view of the exhaust tube 15, in its state when fitted with a cleaning member. The exhaust tube 15 is cylindrical in shape. In the peripheral surface of an exhaust tube body 11, an outlet 5*b* is formed through which the air introduced together with dust into the cyclone dust collector 5 and then separated from the dust by centrifugal force is exhausted out of the cyclone dust collector 5. As shown in FIG. 2, this outlet 5*b* is formed by fitting a plurality of window-like openings 11*a* (air vents) with mesh filters 11*b* having a large number of through holes.

The filters 11*b* are formed out of thin film of resin, such as a nylon-based resin, and are fixed to the exhaust tube body 11 by being formed integrally therewith or welded or bonded thereto in such a way as to leave no bumps between the edges of the filters 11*b* and the peripheral surface of the exhaust tube body 11. This is because such bumps tend to catch dust and encourage the clogging of the outlet 5*b*.

In an upper portion of the exhaust tube body 11 of the exhaust tube 15, a screw portion 11*c* is provided that is to be screw-engaged with the holder portion 20*a* (FIG. 1) of the suction air guide 20. Reference numeral 21 represents a ring fitted around the exhaust tube body 11 so as to be slidable along the axis of the peripheral surface of the exhaust tube body 11 (i.e. in the direction indicated by arrow A). Reference numeral 14 represents a dust tray detachably fitted at the bottom of the exhaust tube body 11 by boss-and-hole fitting or the like.

Figure 4:
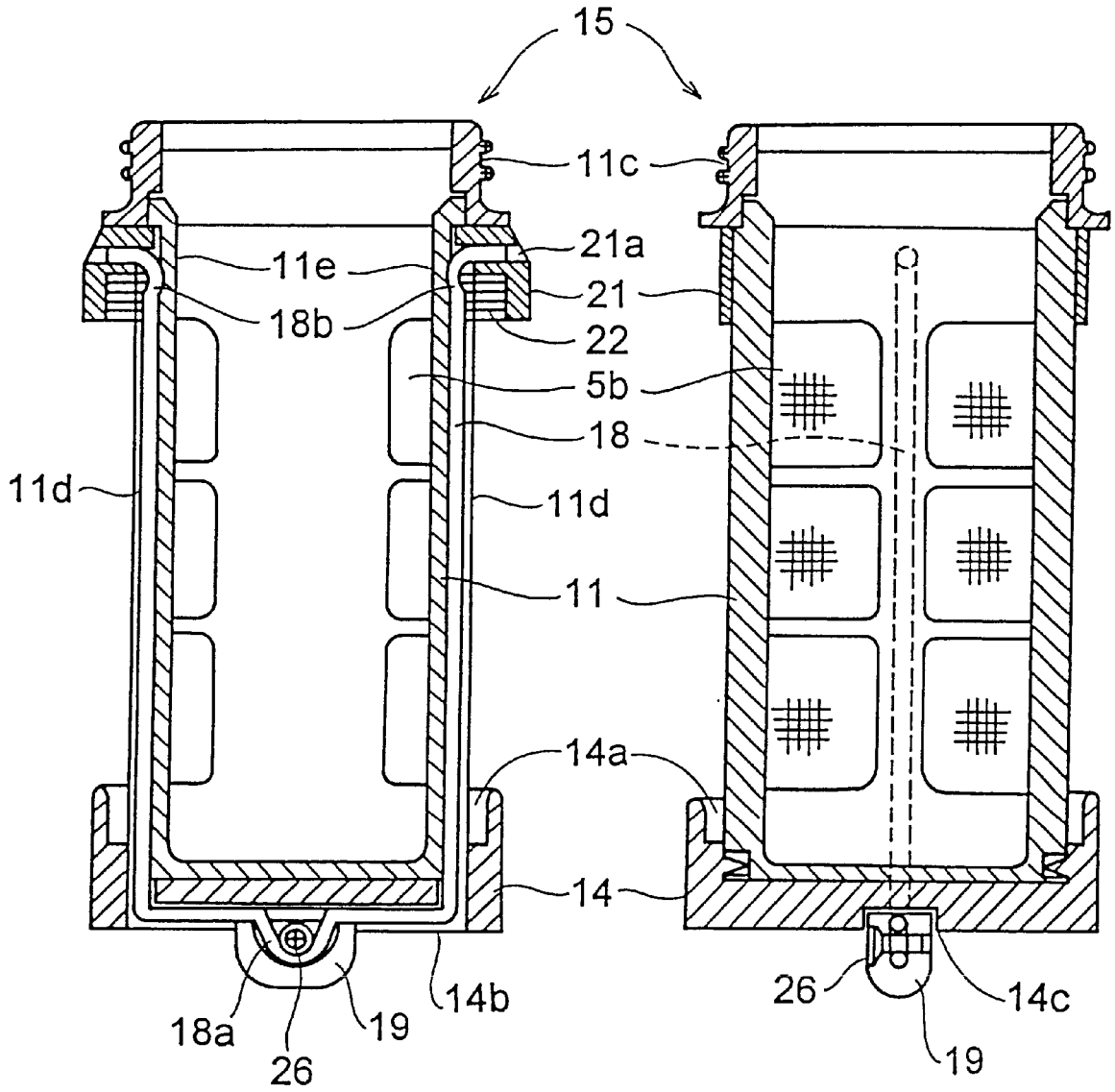
FIG. 4 is a vertical sectional view of the exhaust tube.
Figure 5:
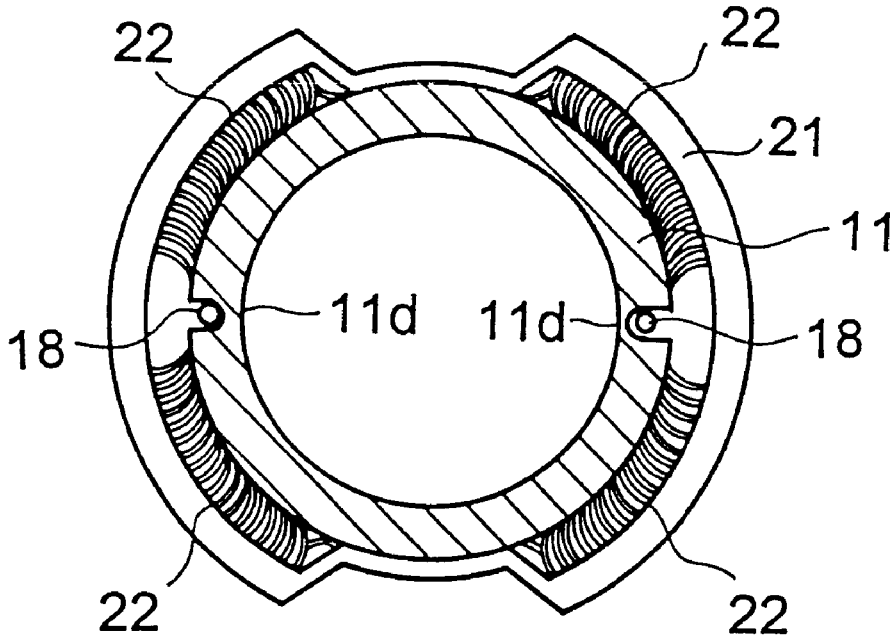
FIG. 5 is a horizontal sectional view of the exhaust tube.
Figure 6:
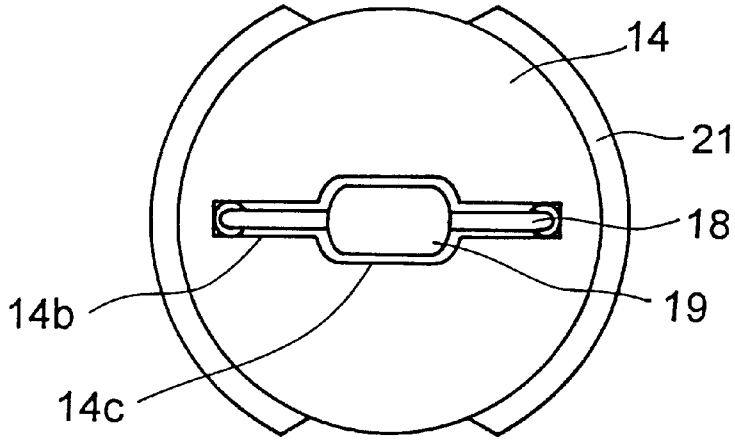
FIG. 6 is a bottom view of the exhaust tube.

FIGS. 4, 5, and 6 are a vertical sectional view, a horizontal sectional view, and a bottom view, respectively, showing the details of the exhaust tube 15 composed of the main exhaust tube body 11 and members fitted thereto. FIG. 4 shows two cross-sectional views taken in two mutually perpendicular directions. At a plurality of locations (in FIG. 5, at four locations) on the inner surface of the ring 21 are provided brushes 22 for cleaning the outlet 5*b* formed in the exhaust tube body 11. The brushes 22 are formed out of fibers having appropriate elasticity, and the length of the fibers is so determined that their tips barely touch the peripheral surface of the exhaust tube body 11.

The dust tray 14 has, in an upper portion thereof, an internal diameter that is a little larger than the external diameter of the exhaust tube body 11 so that a dust gap 14*a* is formed all around between that portion of the dust tray 14 and the peripheral surface of the exhaust tube body 11. Reference numeral 18 represents a wire that is, as a whole, so bent as to run along the external shape of the exhaust tube body 11. The upper ends of this wire 18 are bent and inserted into a support portion 21*a*, consisting of substantially horizontal through holes, of the ring 21. On the other hand, the lower end of the wire 18 penetrates the dust tray 14, with a central portion thereof bent in the shape of U so as to form a U-shaped portion 18*a*. The U-shaped portion 18*a* is inserted in a knob 19 and is held therein with a pin 26. The lower end of the wire 18 itself may be used as a knob.

At opposite locations in the peripheral surface of the exhaust tube body 11, two grooves 11*d* are formed along the axis. The wire 18 is laid in these grooves 11*d* so as to be slidable along them. This prevents the wire 18 from sticking from the peripheral surface of the exhaust tube body 11. Thus, it is possible to obtain acceptable appearance, and prevent the disturbance of the air flow whirling inside the cyclone dust collector 5.

The wire 18 has, near the upper ends thereof, bent portions 18*b* that overhang inward, and depressions 11*e* that are so shaped as to fit the curves of those bent portions 18*b* are formed in upper-end portions of the grooves 11*d* of the exhaust tube body 11. Thus, when the ring 21 supported by the wire 18 is located at the upper end of the exhaust tube body 11, the bent portions 18*b* of the wire 18 engage with the depressions 11*e* of the exhaust tube body 11. This prevents the ring 21 from sliding down in the presence of vibration that accompanies the driving of the electric blower 1*a* (FIG. 49) or by other causes.

In the bottom surface of the dust tray 14 are formed a groove 14 which the wire 18 is laid and a groove 14*c* in which one end of the knob 19 is put. Thus, when the ring 21 is held at the upper end of the exhaust tube body 11, the wire 18 does not stick from the bottom surface of the dust tray 14, and one end of the knob 19 sinks into the bottom surface of the dust tray 14. Thus, it is possible to obtain an acceptable appearance, and it is also possible to prevent the disturbance of the flow of the air exhausted through the exhaust tube 15 after being separated from dust inside the cyclone dust collector 5 as well as the clogging of this portion with dust.

Figure 3:
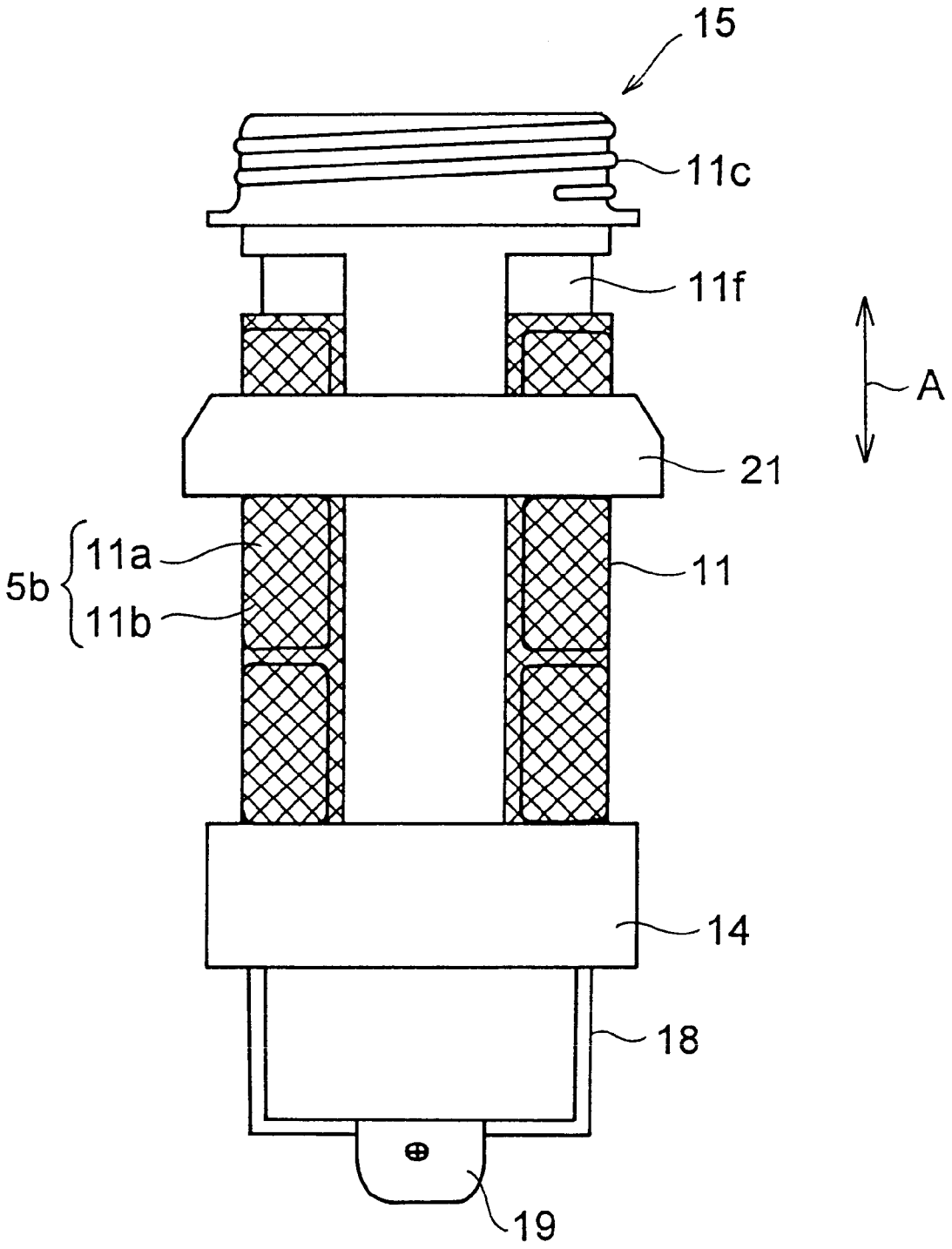
FIG. 3 is a side view of the exhaust tube, showing its state when it is cleaned.

In the structure described above, as shown in FIG. 3, the vertical movement (in the direction indicated by arrow A) of the knob 19 is transmitted through the wire 18 to the ring 21, and therefore, as the knob 19 is operated, the ring 21 slides along the axis of the peripheral surface of the exhaust tube body 11 (in the direction indicated by arrow A). As the knob 19 is pulled down to the end, the brushes 22 (FIG. 4) rake out the dust clogging the filter 11*b* of the exhaust tube body 11 and collects it in the dust gap 14*a* of the dust tray 14.

As a result, when the electric vacuum cleaner is operated next time, the dust collected in the dust gap 14*a* is blown off by the suction air flow whirling inside the cyclone dust collector 5 and is collected in the first and second dust collection chambers 7 and 8. Thus, it is possible to clean the exhaust tube 15 quickly without directly touching the exhaust tube 15 soiled with dust.

Figure 7:
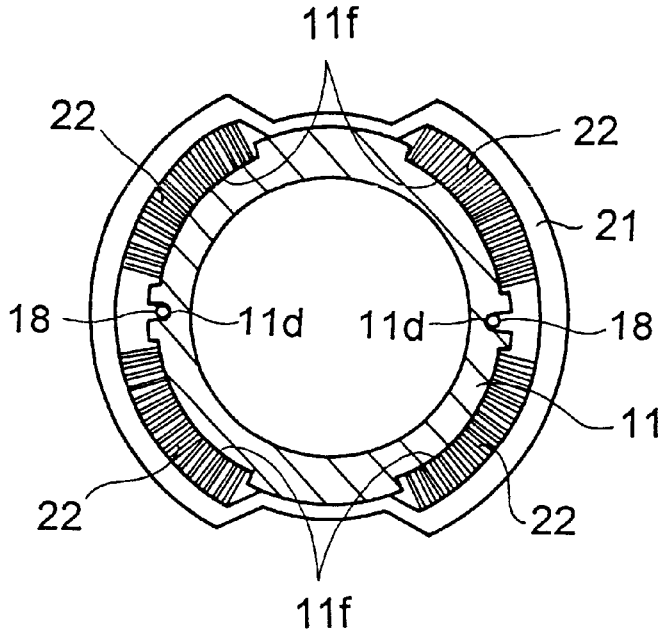
FIG. 7 is a horizontal sectional view of a modified example of the exhaust tube.

This embodiment deals with a case in which the brushes 22 serve as a means of raking off the dust that has settled on the exhaust tube body 11. However, it is also possible to fit the ring 21 with, instead of the brushes 22, pieces of a required size formed out of a material such as fabric, rubber, or resin foam. It is also possible, as shown in FIG. 7, to form recessed portions 1 if in an upper-end portion of the exhaust tube body 11 to accommodate the tips of the brushes 22. This prevents curling of the brushes 22 while the ring 21 is held at the upper end of the exhaust tube body 11, and thus helps prolong the lift of the brushes 22, which are expendable components.

Figure 8:
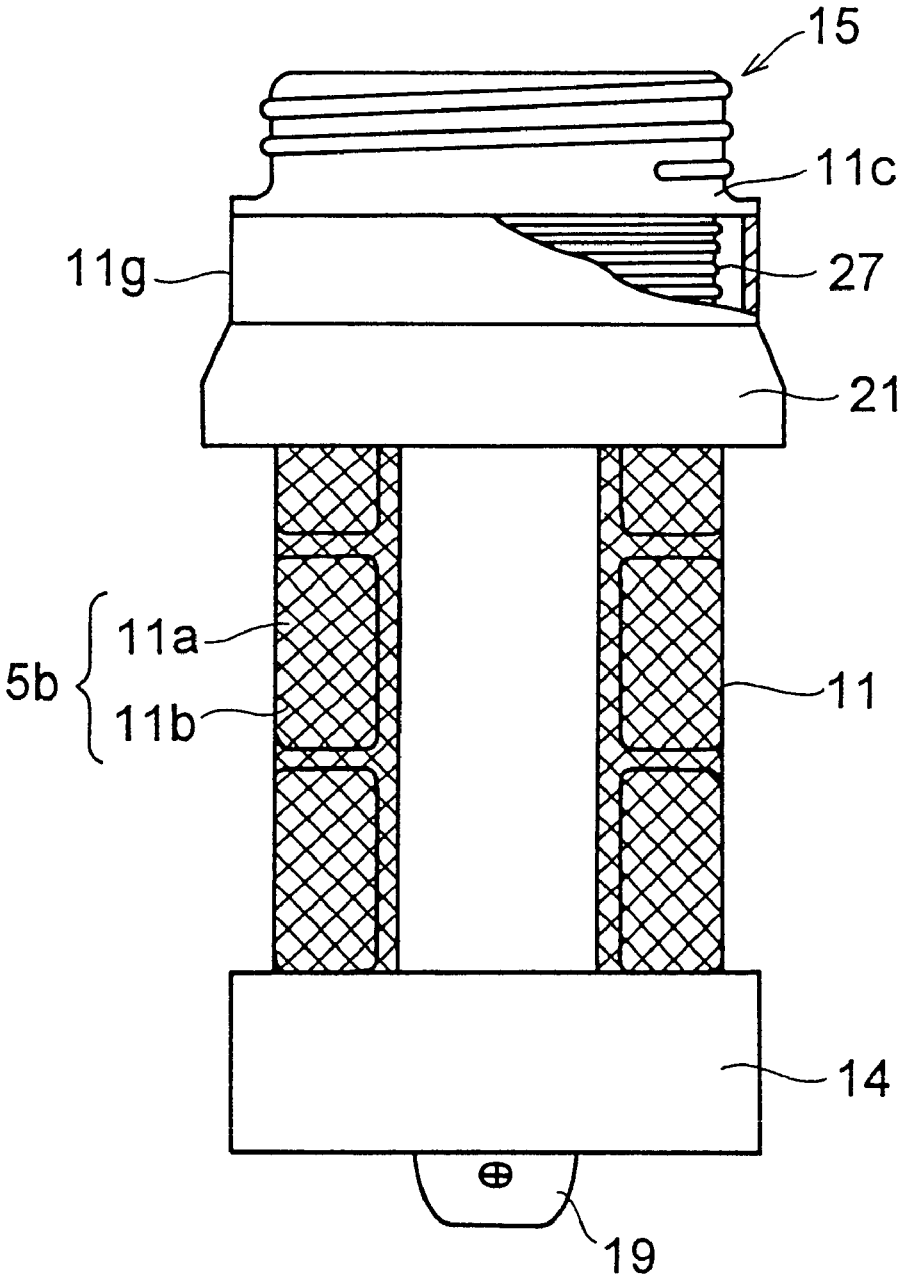
FIG. 8 is a cutaway side view of an exhaust tube of another design.

Moreover, it is also possible, as shown in FIG. 8, to fix the ring 21 to one end of a spring 27 of which the other end is connected to the screw portion 11*c* of the exhaust tube body 11 so that the ring 21 is kept charged with a force that tends to pull it upward. This permits the ring 21 to move back to its original position automatically by the resilience of the spring 27 when the knob 19 is pulled down and then simply released, and thus prevents the ring 21 from being left in the pulled-down position. The spring 27 may be covered with a cover 11*g* to prevent dust from settling on the spring 27.

Figure 13:
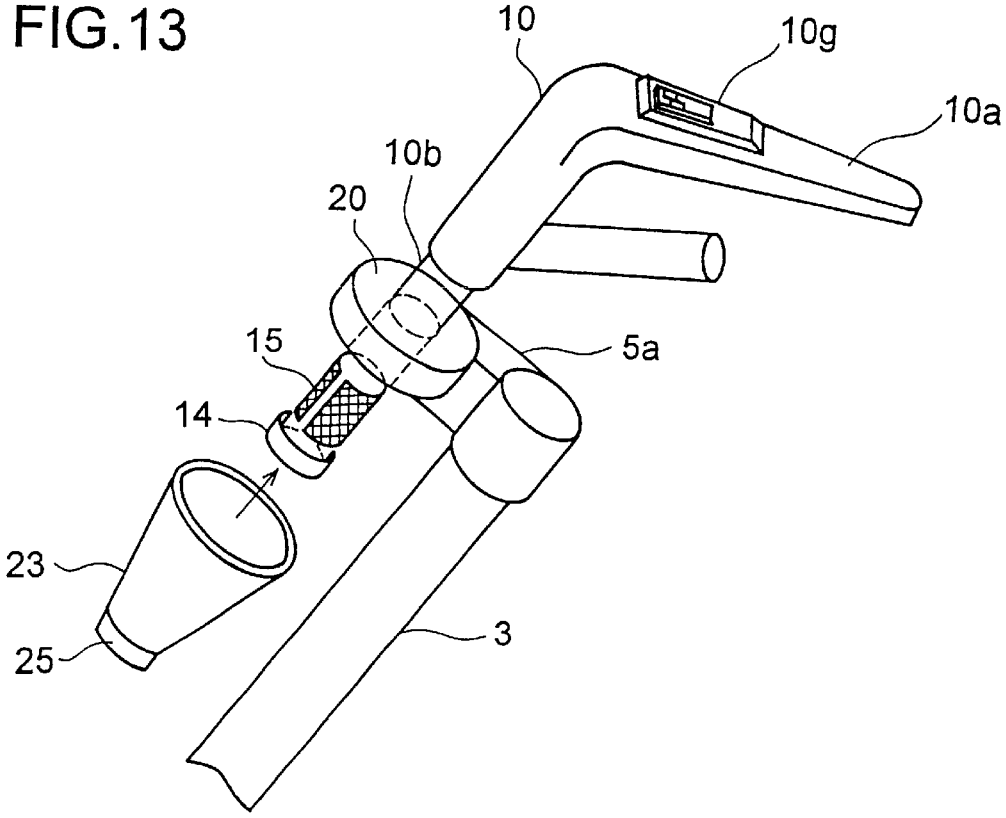
FIG. 13 is a perspective view showing how the cleaning cup is fitted to the exhaust tube.

When the dust that has settled on the exhaust tube body 11 is thick, or when hairs or the like have tangled around the exhaust tube body 11, simply pulling down the ring 21 once may be insufficient to clean the exhaust tube body 11 and collect the dust in the dust gap 14*a* of the dusty tray 14 in a satisfactory manner. In such a case, as shown in FIG. 13, the exhaust tube body 11 is cleaned with the first and second dust collection chambers 7 and 8 detached from the suction air guide 20 of the cyclone dust collector 5 (FIG. 1) and instead a cleaning cup 23 held around the exhaust tube 15.

Figure 14:
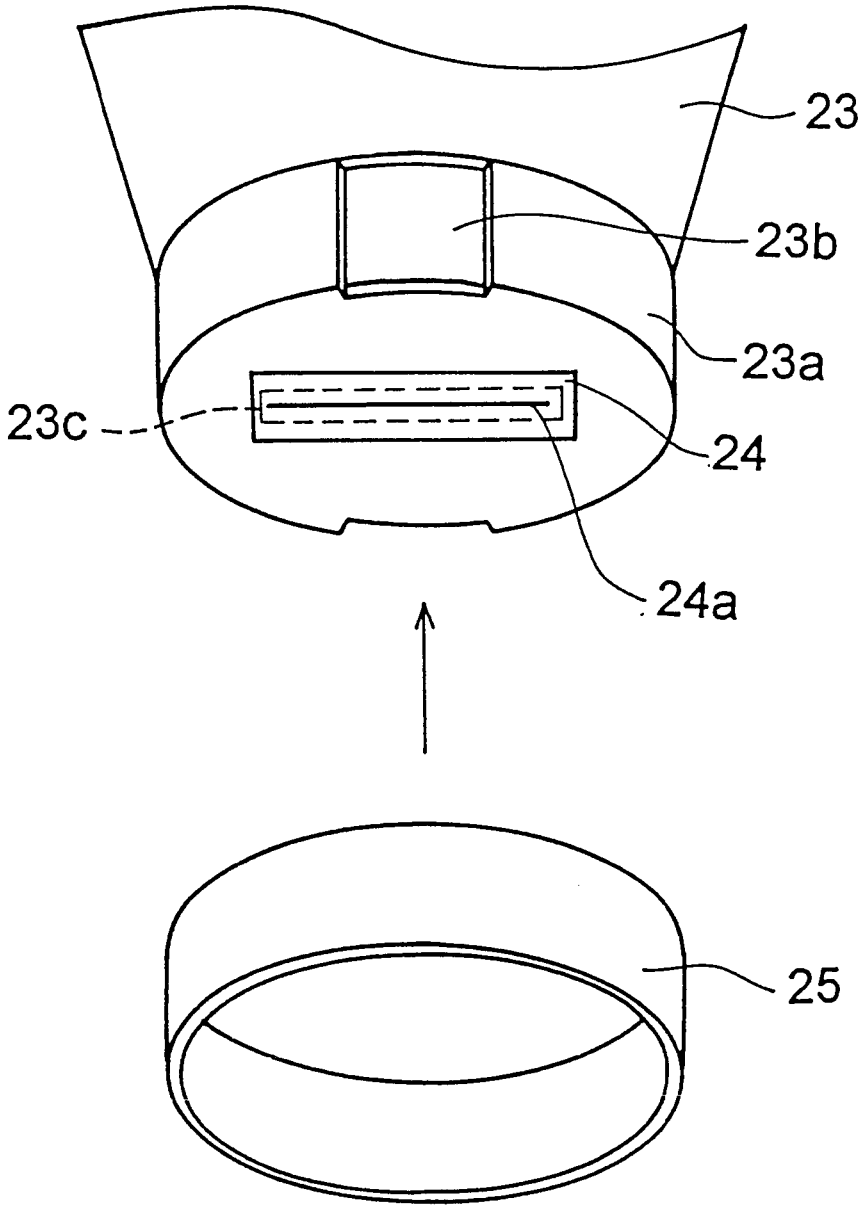
FIG. 14 is an exploded perspective view of the cleaning cup.

As shown in FIG. 14, the cleaning cup 23 has, in a portion thereof within a predetermined height from the bottom surface thereof, a cylindrical portion 23*a* having an internal diameter substantially equal to the external diameter of the dust tray 14. At opposite locations in the peripheral surface of this cylindrical portion 23*a*, openings 23*b* are formed that are so large that one can put a finger therein. In the bottom surface of the cylindrical portion 23*a*, a substantially rectangular opening 23*c* is formed that is so sized as to allow the wire 18 and the knob 19 (FIG. 2) to be put therethrough.

Figure 15:
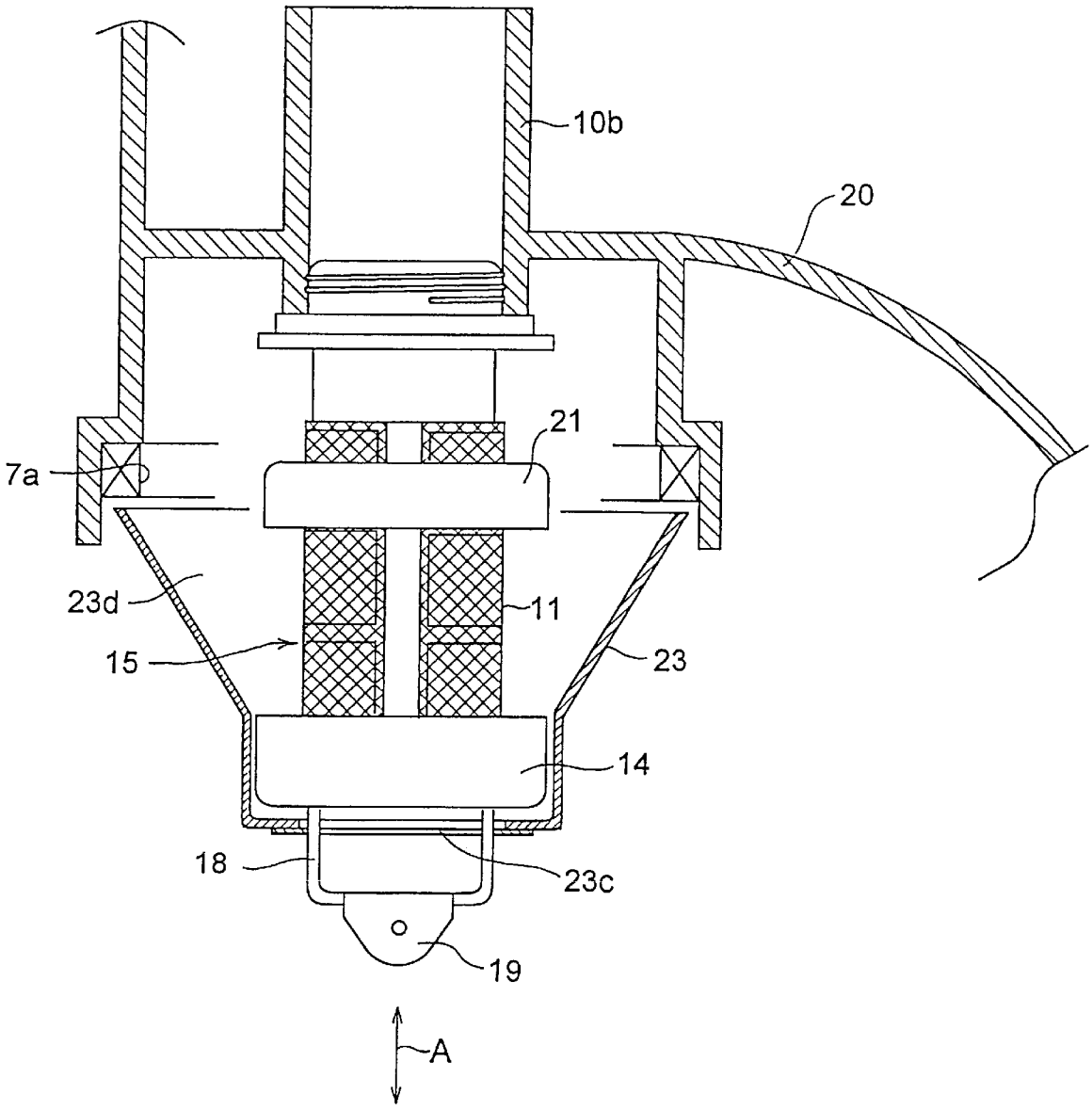
FIG. 15 is a vertical sectional view of the cyclone dust collector with the cleaning cup fitted thereto.

Over the opening 23*b*, a thin piece of film 24 is bonded that is formed out of an elastic material such as rubber and that has a cut formed therein along the straight line passing through the centers of the shorter sides of the opening 23*c*. On the peripheral surface of the cylindrical portion 23*a*, a ring-shaped member 25 is fitted that is formed out of an elastic material such as rubber and that has substantially the same height as the cylindrical portion 23*a*. Inside the cleaning cup 23 is secured a space 23*d* that encloses the exhaust tube 15. As shown in FIG. 15, the user holds the cleaning cup 23 in an appropriate position around the exhaust tube 15 by pressing the cleaning cup 23 toward the suction air guide 20, and then, from outside the cleaning cup 23, pulls down and pushes up the knob 19 vertically (in the direction indicated by arrow A). This causes the dust that has settled on the peripheral surface of the exhaust tube 11 to be raked off by the brushes 22 (FIG. 4) arranged on the ring 21 and collected in the cleaning cup 23. In this way, it is possible to clean the exhaust tube 15 quickly.

Thereafter, the user presses the two openings 23*b* formed in the cylindrical portion 23*a* from outside the ring-shaped member 25 so as to hold the dust tray 14 between his fingers, and then rotates the exhaust tube 15 together with the dust tray 14 so as to detach the exhaust tube 15 from the holder portion 20*a*. The user then disposes of the dust collected in the cleaning cup 23, and cleans the exhaust tube 15 by washing or the like. In this way, it is possible to detach the exhaust tube 15 from the cyclone dust collector 5 without directly touching the exhaust tube 15 soiled with dust, and thus it is possible to maintain the electric vacuum cleaner efficiently and hygienically.

Moreover, the user can disengage and thereby detach the dust tray 14 from the exhaust tube body 11, then pull down the knob 19 together with the wire 18, and then detach the ring 21 from the exhaust tube body 11. This makes it possible to clean the individual components in a disassembled state.

To dispose of the dust collected in the first and second dust collection chambers 7 and 8, these dust collection chambers are first detached together from the suction air guide 20, and are then separated from each other above a trash can or the like. In this way, it is possible to securely dispose of the dust collected in the individual dust collection chambers without scattering it around. One or both of the first and second dust collection chambers 7, 8 may be formed out of a transparent material such as glass or transparent resin. This permits the user to visually confirm the amount of dust collected in the first and second dust collection chambers and readily know when to dispose of the dust.

Second Embodiment

Figure 16:
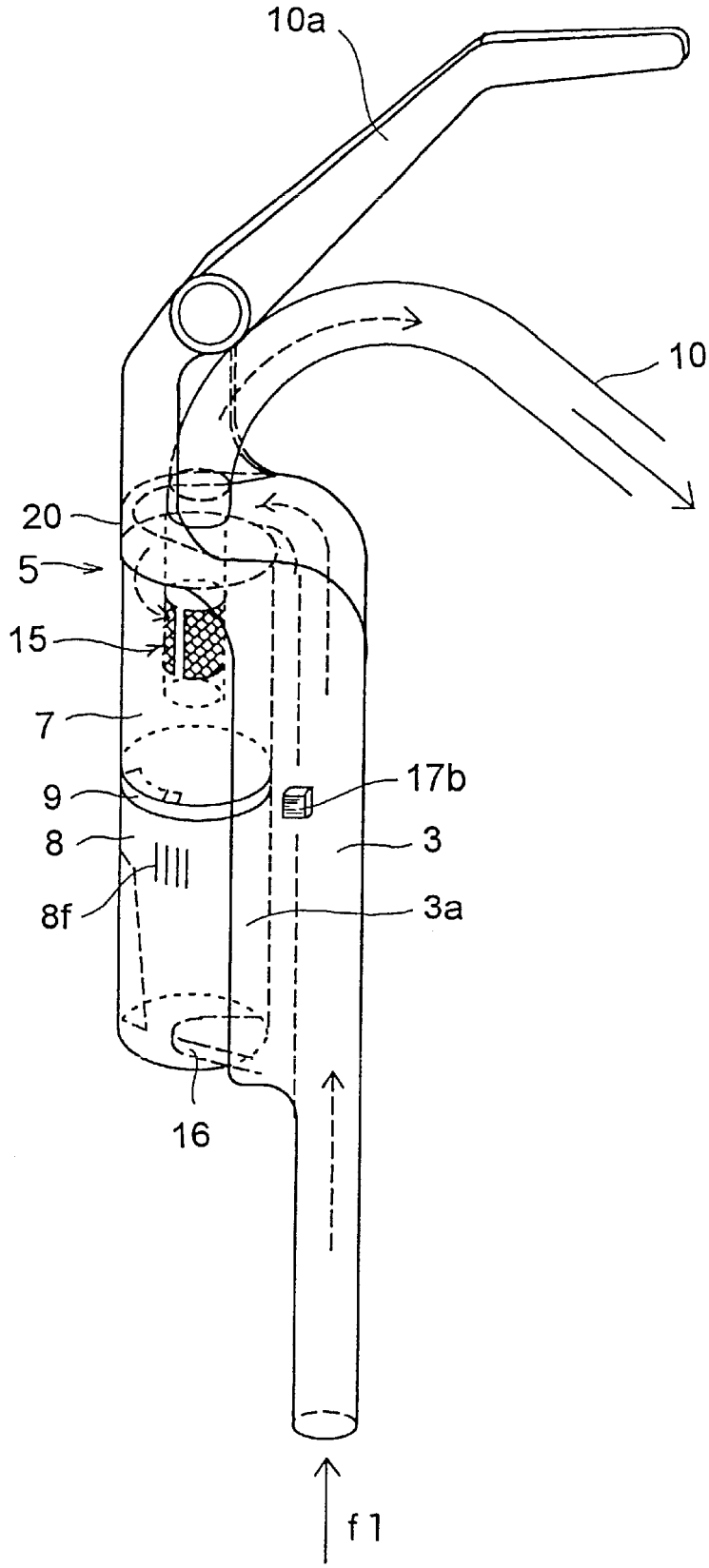
FIG. 16 is a perspective view of and around the cyclone dust collector of the electric vacuum cleaner of a second embodiment.
Figure 17:
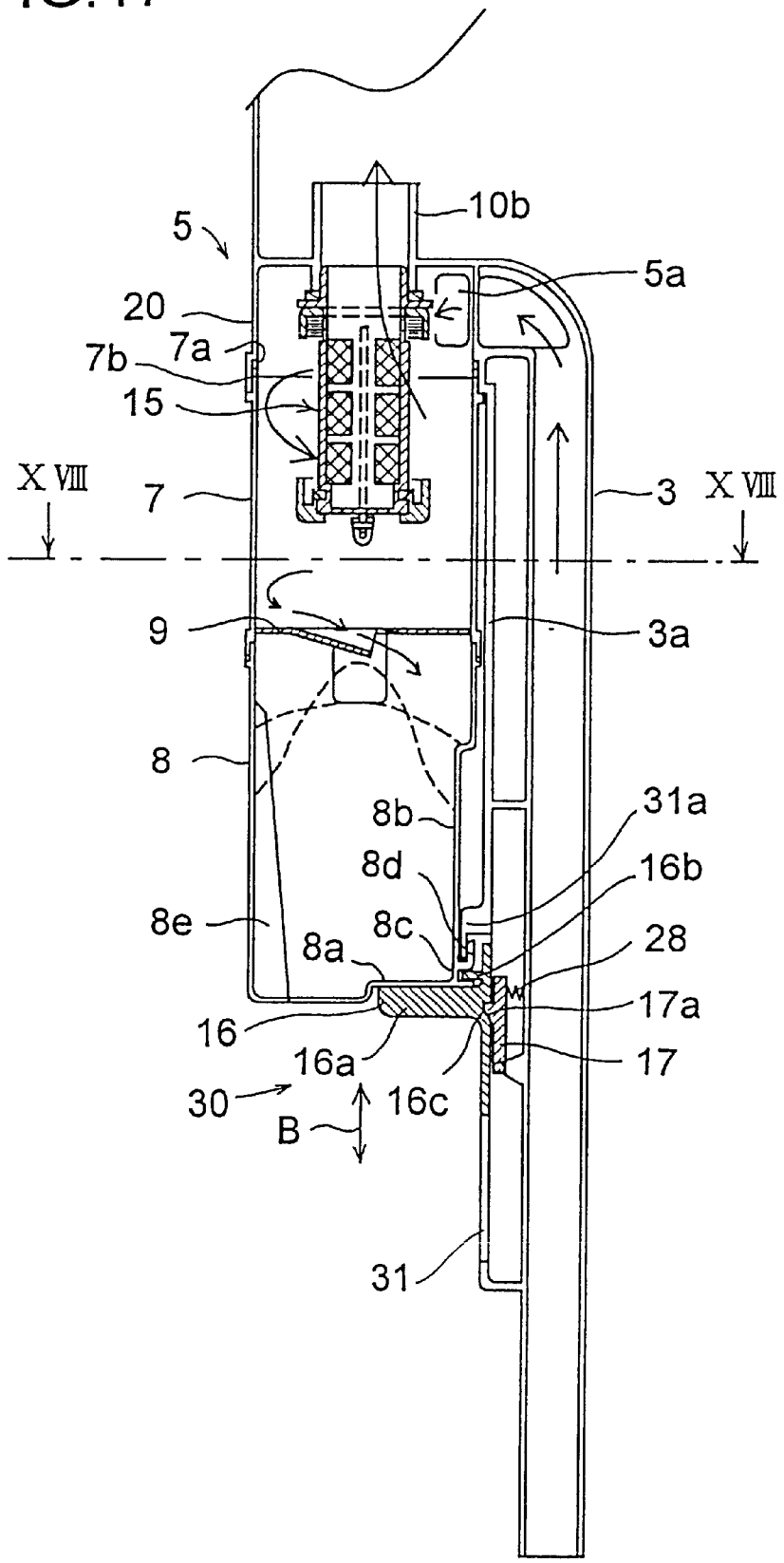
FIG. 17 is a vertical sectional view of the cyclone dust collector of the electric vacuum cleaner of the second embodiment.

FIGS. 16 and 17 are a perspective view and a vertical sectional view, respectively, of and around the cyclone dust collector of the electric vacuum cleaner of a second embodiment of the invention. In this embodiment, the suction air guide 20 and the connection pipe 3 are formed integrally, which contributes to better appearance and higher user-friendliness.

Figure 18:
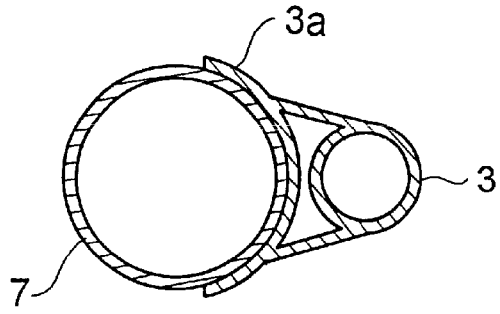
FIG. 18 is a horizontal sectional view of the cyclone dust collector of the electric vacuum cleaner of the second embodiment.

FIG. 18 is a horizontal sectional view taken along line XVIII—XVIII shown in FIG. 17. On the suction air guide 20 side of the connection pipe 3, a dust collection chamber mount portion 3*a* is formed along the length of the connection pipe 3. The first and second dust collection chambers 7 and 8 are mounted on this dust collection chamber mount portion 3*a*. In a lower portion of the dust collection chamber mount portion 3*a*, a slit 31 is formed into which a sliding member 16 fits. The sliding member 16 is slidable vertically along the slit 31 (in the direction indicated by arrow B), and thus the slit 31 restricts the movement stroke of the slide 16.

Figure 19:
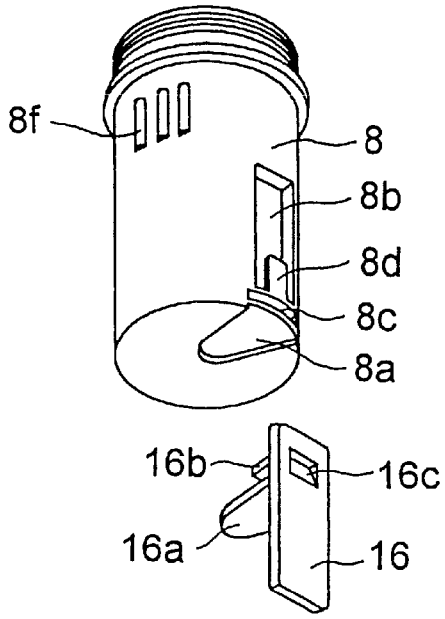
FIG. 19 is a perspective view of the second dust collection chamber provided in the cyclone dust collector and the sliding member used to attach the second dust collection chamber.

As shown in FIG. 19, on the front surface of the sliding member 16 are formed a dust collection chamber stopper 16*a* and a projection 16*b*, and in the back surface of the sliding member 16 is formed a notch 16*c* with which a projection 17*a* (described later) formed on a locking member 17 (FIG. 17) provided in the dust collection chamber mount portion 3*a* engages. In the bottom surface of the second dust collection chamber 8, a first recessed portion 8*a* is formed into which the stopper 16*a* of the sliding member 16 fits.

In the peripheral surface of the second dust collection chamber 8 are formed a groove 8*c* into which the projection 16*b* of the sliding member 16 is inserted and a projection 8*d* that extends upward from a bottom-end portion of the peripheral surface. At the upper end of the slit 31, an L-shaped rib 31*a* (FIG. 17) is formed that extends downward therefrom. When the sliding member 16 is slid upward in the direction indicated by arrow B, this rib 31*a* clamps the projection 8*d* so that the second dust collection chamber 8 is held on the dust collection chamber mount portion 3*a*. In this embodiment, a second recessed portion 8*b* is formed in the peripheral surface of the second dust collection chamber 8 in such a way that the projection 8*d* does not stick out of the second recessed portion 8*b*.

On the inner surface of the peripheral wall of the second dust collection chamber 8, a protuberance 8*e* as shown in FIG. 17 is formed. This protuberance 8*e* hinders dust from swirling around by following the air flow whirling inside the second dust collection chamber 8. This prevents the collected dust from being thrown up, and thus helps enhance dust collection efficiency. Reference numeral 8*f* represents a position mark formed as an embossed or carved marking on the peripheral surface of the second dust collection chamber 8. The user, by holding the second dust collection chamber 8 while referring to this position mark 8*f* as a reference for positioning, can fit the first and second dust collection chambers 7 and 8 in appropriate positions on the dust collection chamber mount portion 3*a* in correct orientation.

The locking member 71 is pivotably supported in the dust collection chamber mount portion 3*a*. The locking member 17 has projection 17*a* formed on the front surface thereof, and is located with a force that presses it toward 4 the sliding member 6 by a spring 28 provided between the back surface of the locking member 17 and the peripheral surface of the connection pipe 3. This permits the projection 17*a* of the locking member 17 to protrude toward the sliding member 16.

The members described above together constitute a mounting mechanism 30 that permits the first and second dust collection chambers 7 and 8 to be detachably fitted to the suction air guide 20 and the connection pipe 3. In this structure, to mount the first and second dust collection chambers 7 and 8 on the dust collection chamber mount portion 3*a*, the user inserts the projection 16*b* of the sliding member 16 into the groove 8*c* of the second dust collection chamber 8, and engages the stopper 16*a* with the first recessed portion 8*a*. Furthermore, in this state, the user lifts up the first and second dust collection chambers 7 and 8 while keeping them pressed toward the connection pipe 3, and thereby locks the projection 8*d* of the second dust collection chamber 8 in the rib 31*a*. This causes the projection 17*a* of the locking member 17, which is loaded with a force by the spring 28, to fit into the notch 16*c* of the sliding member 16.

As a result, the opening in the top surface of the first dust collection chamber 7 is pressed onto the suction air guide 20 with gaskets 7*a* and 7*b* in between, and thus the first and second dust collection chambers 7 and 8 are held in position with the spaces inside them kept air-tight. In this state, the two dust collection chambers 7 and 8 and the suction air guide 20 together form the cyclone dust collector 5.

Figure 20:
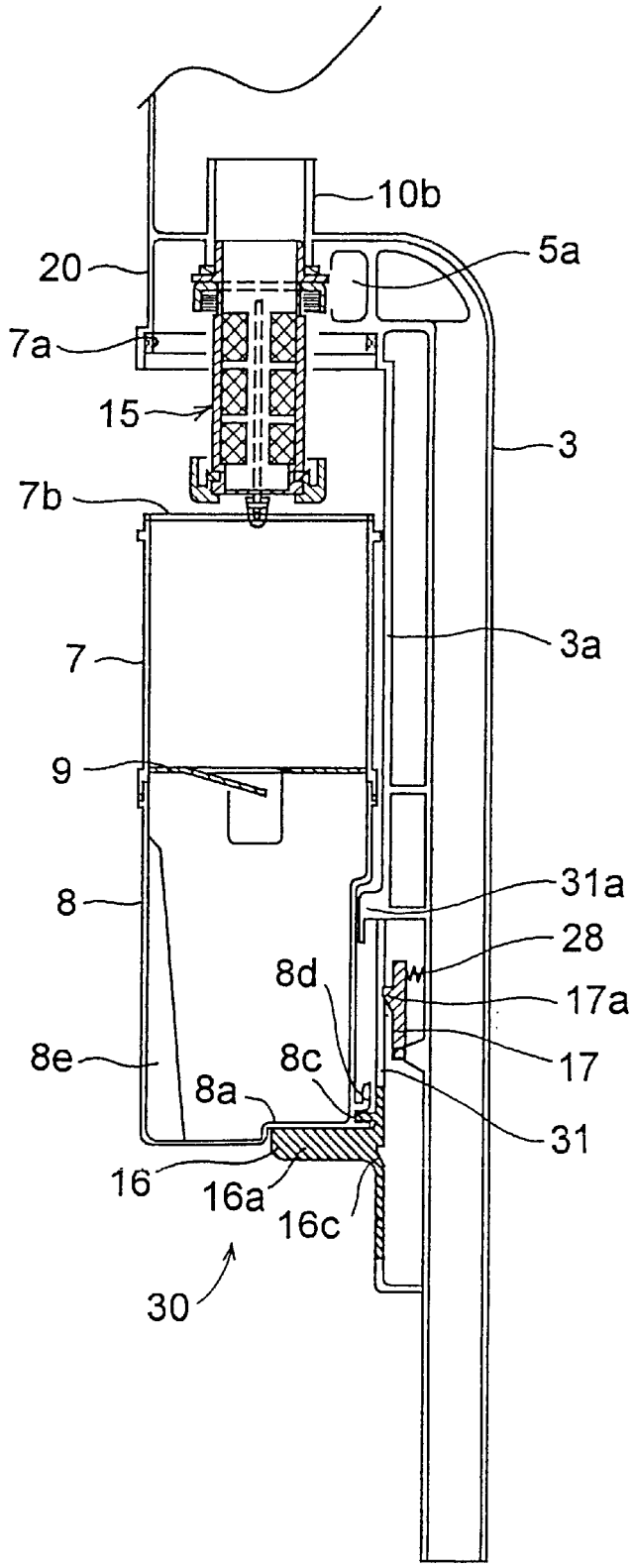
FIG. 20 is a vertical sectional view of the cyclone dust collector, showing its state when the dust collection chamber is detached.

Reversely, to dismount the first and second dust collection chambers 7 and 8, as shown in FIG. 20, the user first presses an unlocking button 17*b* (FIG. 16) that is interlocked with the locking member 17, and thereby disengages the projection 17*a* from the notch 16*c*. The user then pulls down the first and second dust collection chambers 7 and 8 while keeping them pressed toward the dust collection chamber mount portion 3*a*. In this state, the user then pulls the first and second dust collection chambers 7 and 8 away from the dust collection chamber mount portion 3*a*, and thereby dismounts them from the dust collection chamber mount portion 3*a*.

The user then carries the first and second dust collection chambers 7 and 8 thus dismounted to above a trash can or the like and separates them from each other. In this way, it is possible to securely dispose of the dust collected separately in the individual dust collection chambers without scattering it around.

Third Embodiment

Figure 21:
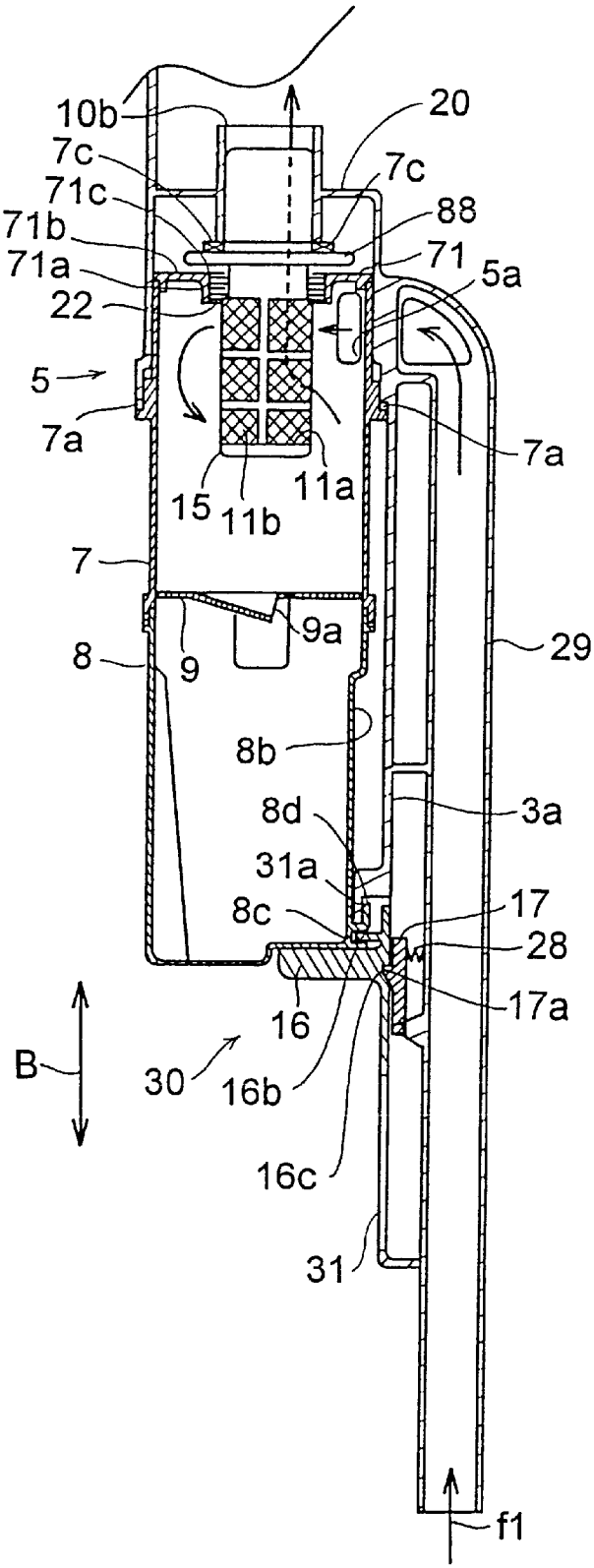
FIG. 21 is a vertical sectional view of the cyclone dust collector of the electric vacuum cleaner of a third embodiment.

A third embodiment of the invention will be described below. FIG. 21 is a vertical sectional view of the cyclone dust collector 5 of the cyclone-type electric vacuum cleaner of this embodiment. In this embodiment, an adaptor pipe is formed integrally with suction air guide 20, and a connection pipe 3 is fitted to the lower end of the adaptor pipe 29. On the adaptor pipe 29 and the second dust collection chamber 8, a mounting mechanism as described in the second embodiment is provided.

The exhaust tube 15 is inserted into the coupling pipe lob, and is fixed thereto with a screw (not shown). To the lower end of the coupling pipe lob, a gasket 7*c* is fitted. Above air vents 11*a* and filters 11*b* of the exhaust tube 15, a flange 88 is provided perpendicularly to the axial direction, with the top surface of the flange 88 kept in intimate contact with the gasket 7*c*.

To an opening at the top end of a first dust collection chamber 7, a frame member 71 is detachably fitted. The frame member 71 consists of a cylindrical portion 71*a* that is cylindrical in shape and a flange portion 71*b* that is formed at the top end of the cylindrical portion 71*a*. On the inner peripheral surface of the cylindrical portion 71*a*, a brush 22 is provided as a cleaning member. The frame member 71, the first dust collection chamber 7, and the second dust collection chamber 8, when assembled together, form a dust collection chamber unit. As shown in FIG. 21, when the dust collection chamber unit is fitted to the suction air guide 20, the exhaust tube 15 is put through an opening 71*c* of the cylindrical portion 71*a*, and the brush 22 is located above the air vents 11*a* and the filters 11*b*.

In this embodiment, simply detaching the dust collection chamber unit from the member to which it is fitted makes it possible to clean the filters 11*b*. When the user, as described previously, operated the unlocking button 17*b* to disengage the sliding member 16 from the locking member 17 and then pulls down the dust collection chamber unit, while pressing it toward the adaptor pipe 29, together with the sliding member 16, since the exhaust tube 15 is fixed to the suction air guide 20, the exhaust tube 15 comes out of the cylindrical portion 71 a of the frame member 71. Meanwhile, the brush 22 rakes the surfaces of the filters 11*b*, and thus the dust that has settled on the filters 11*b* is raked off by the brush 22 so as to scatter into the first and second dust collection chambers 7 and 8, where the dust is collected.

Figure 22:
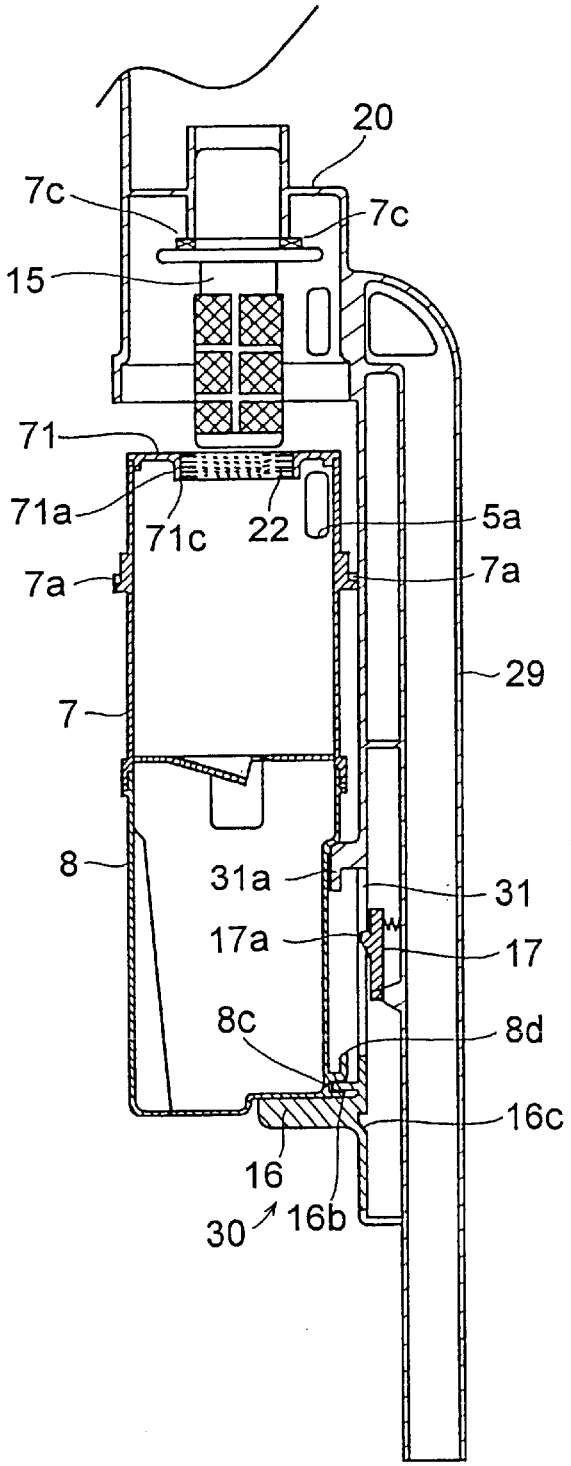
FIG. 22 is a vertical sectional view of the cyclone dust collector, showing its state when the dust collection chamber is detached.

FIG. 22, is a vertical sectional view of the cyclone dust collector 5, showing its state when the dust collection unit is detached from the suction air guide 20. As shown in this figure, when the sliding member 16 is pulled down to the lower end of a slit 31, the exhaust tube 15 comes completely out of the cylindrical portion 7*a* of the frame member 71. In this state, the user pulls the dust collection chamber unit away from the adaptor pipe 29 to disengage the groove 8*c* of the second dust collection chamber 8 from the projection 16*c* of the sliding member 16 and thereby detach the dust collection chamber unit. The user then disposes of the dust collected in the dust collection chambers 7 and 8.

In the electric vacuum cleaner of this embodiment, when the dust collected in the second dust collection chamber 8 is disposed of, the filters 11*b* are cleaned simultaneously. This saves trouble, and thus enhances user-friendliness. Moreover, not only is the cleaning of the filters 11*b* achieved simply by detaching the dust collection chamber unit, but the dust raked off the filters 11*b* is kept inside the first and second dust collection chambers 7 and 8. This prevents the user's hands and clothes from being soiled with dust, and thus contributes to the user's hygiene.

Fourth Embodiment

Figure 23:
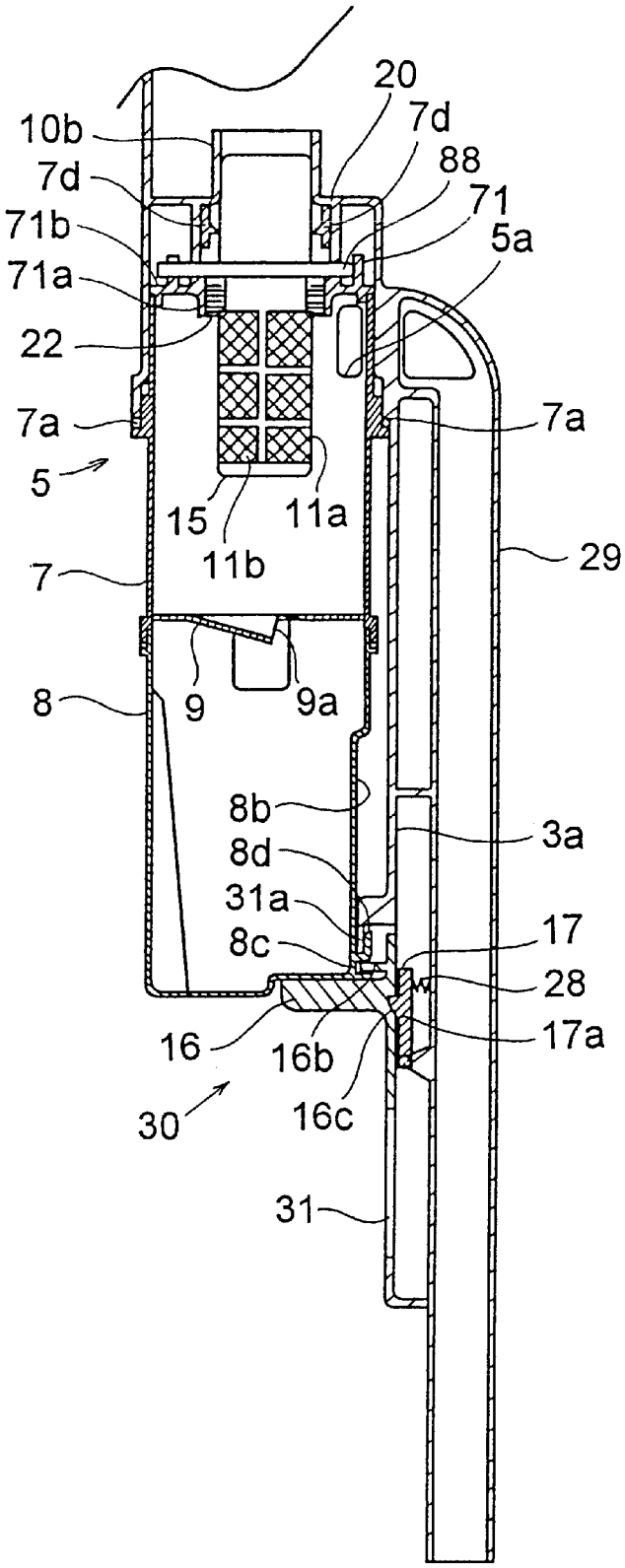
FIG. 23 is a vertical sectional view of the cyclone dust collector of the electric vacuum cleaner of a fourth embodiment.

A fourth embodiment of the invention will be described below. FIG. 23 is a vertical sectional view of the cyclone dust collector 5 of the cyclone-type electric vacuum cleaner of this embodiment. The electric vacuum cleaner of this embodiment is the same as that of the third embodiment except for the structures of the exhaust tube 15, the frame member 71, and the first and second dust collection chambers 7 and 8, which will be described below.

In this embodiment, the exhaust tube 15 is detachably inserted into the coupling pipe 10*b* of the suction air guide 20. On the inner wall of the coupling pipe 10*b*, a gasket 7*d* is fitted to seal the gap between the exhaust tube 15 and the coupling pipe 10*b*. This ensures that all the air inside the first dust collection chamber 7 is guided through the exhaust tube 15 and then through the coupling pipe 10*b* into the suction air passage. Thus, almost no dust settles in the portion of the exhaust tube 15 that is inserted into the coupling pipe 10*b*. The gasket 7*d* may be fitted at the lower end of the coupling pipe 10 as is the gasket 7*c* shown in FIG. 21.

The exhaust tube 15 is put through the cylindrical portion 71*a* of the frame member 71, and is fixed to the frame member 71 by a first engagement mechanism (described later). In this state, the brush 22 is located above the air vents 11*a* and the filters 11*b* of the exhaust tube 15. The frame member 71 is fixed to the peripheral surface of the first dust collection chamber 7 by a second engagement mechanism (described later).

Now, how the filters 11*b* are cleaned in this embodiment will be described below. First, the user operates the unlocking button 17*b* to disengage the sliding member 16 from the locking member 17, and then pulls down the dust collection chamber unit, while pressing it toward the adaptor pipe 29, together with the sliding member 16. As a result, since the exhaust tube 15 is fixed to the frame member 71, the exhaust tube 15 moves downward together with the dust collection chamber unit, and separates from the suction air guide 20. After pulling the sliding member 16 down to the lower end of the slit 31, the user pulls the dust collection chamber unit away from the adaptor pipe 29 to disengage the groove 8*c* of the second dust collection chamber 8 from the projection 16*b* of the sliding member 16 and thereby detach the dust collection chamber unit.

Figure 24:
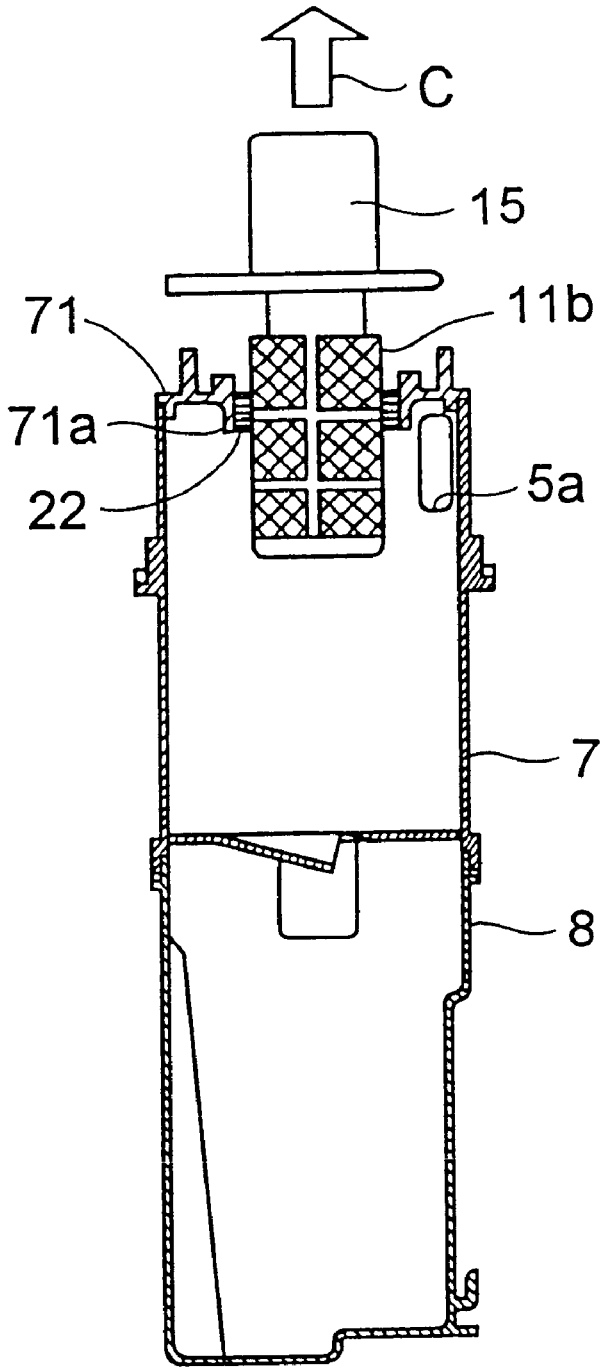
FIG. 24 is a vertical sectional view of the dust collection chamber detached from the cyclone dust collector.

The user then releases the engagement by the first engagement mechanism between the exhaust tube 15 and the frame member 71, and then, as shown in FIG. 24, holding the portion of the exhaust tube 15 that has been inserted into the coupling pipe 10*b*, pulls the exhaust tube 15 upward (in the direction indicated by arrow C) out of the frame member 71. Thus, the exhaust tube 15 comes out of the cylindrical portion 71*a* of the frame member 71. Meanwhile, the brush 22 rakes the surfaces of the filters 11*b*, and thus the dust that has settled on the filters 11*b* is raked off by the brush 22 so as to scatter into the first and second dust collection chambers 7 and 8, where the dust is collected. Lastly, the user disassembles the dust collection chamber unit, and disposes of the dust collected in the dust collector 5.

In the electric vacuum cleaner of this embodiment, the exhaust tube 15 is detachable. Here, the exhaust tube 15 is detached together with the dust collection chamber unit, and is then pulled out of the dust collection chamber unit with only that portion thereof where almost no dust has settled held by the user. This prevents the user's hands and clothes from being soiled with dust, and thus contributes to the user's hygiene. Moreover, quite conveniently, the dust raked off the filters 11*b* is kept inside the first and second dust collection chambers 7 and 8.

Figure 25:
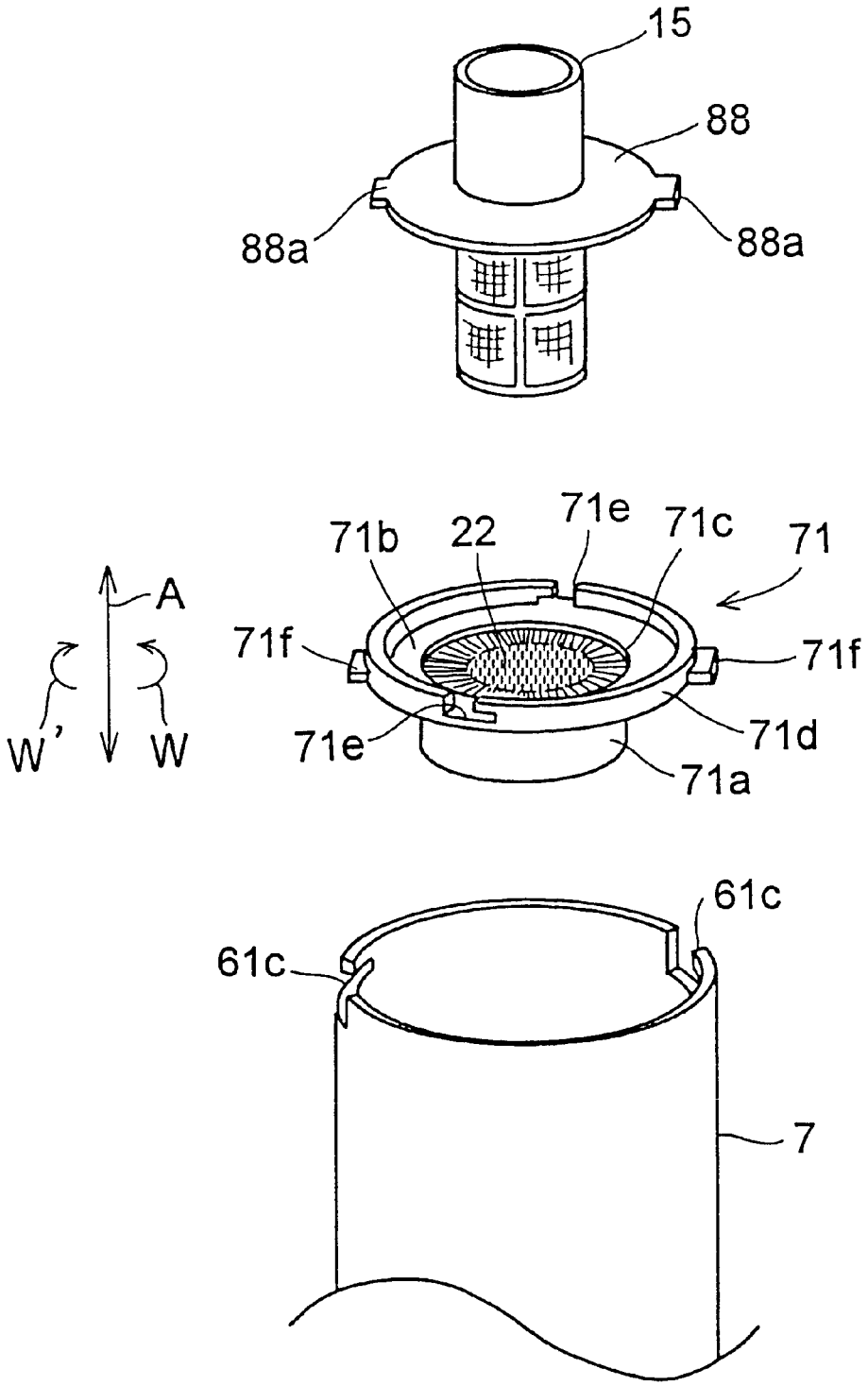
FIG. 25 is an exploded perspective view of the exhaust tube, the frame, and the first dust collection chamber provided in the cyclone dust collector in the fourth embodiment.

Next, examples of the first and second engagement mechanisms of this embodiment will be described. FIG. 25 is an exploded perspective view of the exhaust tube 15, the frame member 71, and the first dust collection chamber 7 of this embodiment. First, the first engagement mechanism will be described. At two opposite locations on the peripheral edge of the flange 88 of the exhaust tube 15, first projections 88*a* are formed so as to extend horizontally.

On the other hand, on the frame member 71, a peripheral wall portion 71*d* is formed so as to extend upward from the peripheral edge of the flange 71*b*. At two opposite locations in the peripheral wall portion 71*d*, first cuts 71*e* are formed that are L-shaped and extend first downward from the top end of the peripheral wall portion 71*d* along the axis of the exhaust tube 15 (in the direction indicated by arrow A) and then counter-clockwise along the periphery of the peripheral wall portion 71*d* (in the direction indicated by arrow W).

To engage the exhaust tube 15 with the frame member 71, the user, while inserting the exhaust tube 15 into the cylindrical portion 71*a* of the frame member 71, fits the first projections 88*a* into those portions of the first cuts 71*e* that extend axially (in the direction indicated by arrow A). The user then rotates the exhaust tube 15 counter-clockwise (in the direction indicated by arrow W) to move the first projections 88*a* to the ends of the first cuts 71*e*. In this way, the exhaust tube 15 is fixed in the axial direction with respect to the frame member 71.

Next, the second engagement mechanism will be described. At two opposite locations on the outer surface of the peripheral wall portion 71*d* of the frame member 71, second projections 71*f* are formed so as to extend horizontally. At two opposite locations in the peripheral surface of the first dust collection chamber 7, second cuts 61*c* are formed that are L-shaped and extend first downward from the top end of the first dust collection chamber 7 along the axis of the exhaust tube 15 (in the direction indicated by arrow A) and then clockwise along the periphery of the first dust collection chamber 7 (in the direction indicated by arrow W').

To engage the frame member 71 with the first dust collection chamber 7, the user first fits the second projections 71*f* into those portions of the second cuts 61*c* that extend axially (in the direction indicated by arrow A). The user then rotates the frame member 71 clockwise (in the direction indicated by arrow W') to move the second projections 71*f* to the ends of the second cuts 61*c*. In this way, the frame member 71 is fixed in the axial direction with respect to the first dust collection chamber 7.

In the first and second engagement mechanisms described above, the first cuts 71*e* and the second cuts 61*c* are both L-shaped, but are bent in opposite directions. This prevents the engagement by the second engagement mechanism between the frame member 71 and the first dust collection chamber 7 from being inadvertently released when the user rotates the exhaust tube 15 to release the engagement by the first engagement mechanism.

The structures of the first and second engagement mechanisms are not limited to those specifically described above.

Fifth Embodiment

Figure 26:
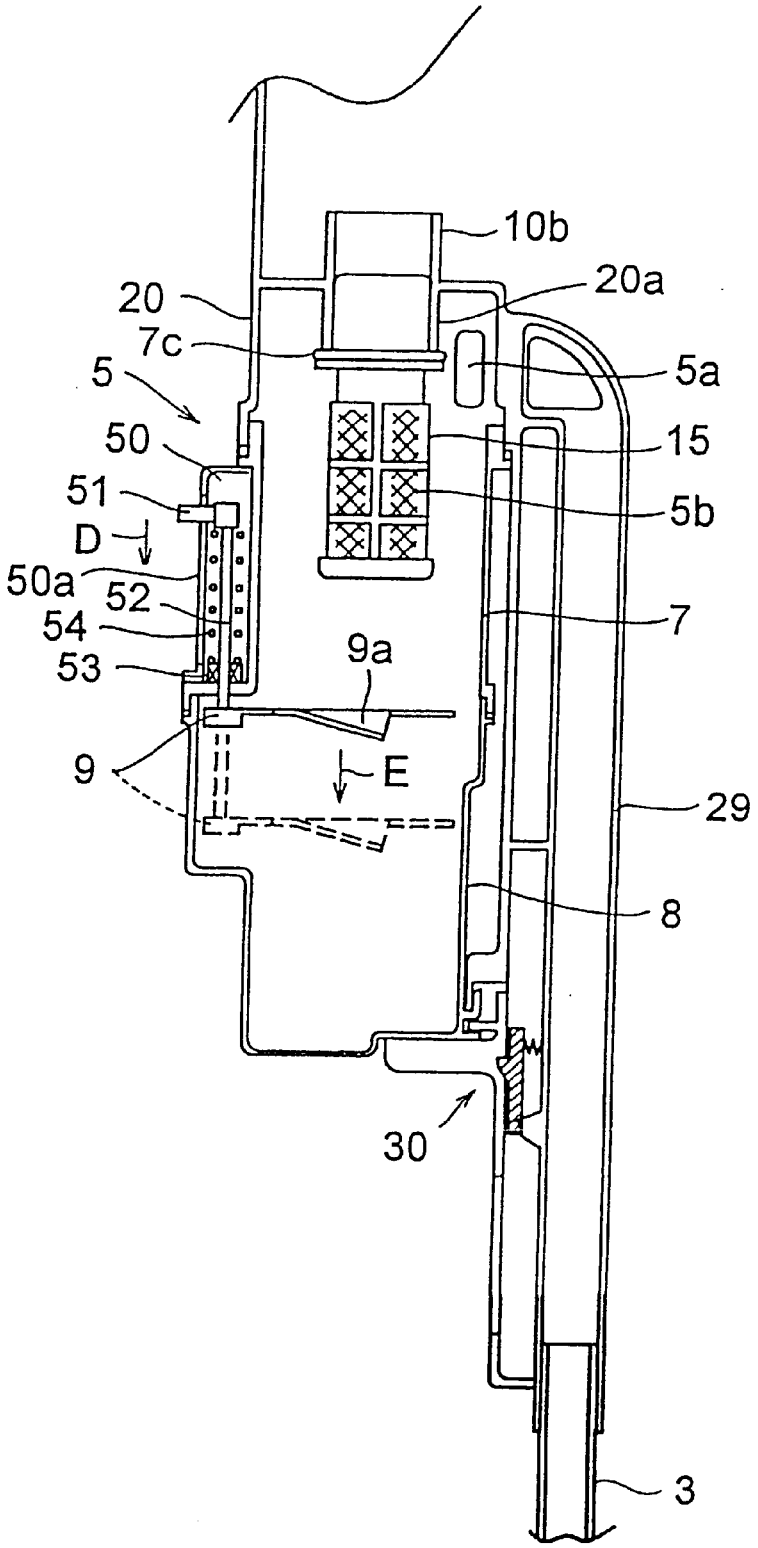
FIG. 26 is a vertical sectional view of the cyclone dust collector of the electric vacuum cleaner of a fifth embodiment.

A fifth embodiment of the invention will be described below. FIG. 26 is a vertical sectional view of the cyclone dust collector 5 of the electric vacuum cleaner of this embodiment. On the peripheral surface of the first dust collection chamber 7, on the opposite side thereof to the adaptor pipe 29, an operation chamber 50 is formed integrally with the first dust collection chamber 7 so as to extend vertically. In the front surface of the operation chamber 50, a slit 50*a* is formed through which an operation portion 51 protrudes from inside the operation chamber 50 and along which the operation portion 51 slides vertically between the upper and lower ends of the operation chamber 50.

Reference numeral 52 represents an operation rod that is inserted in the operation chamber 50 so as to protrude toward the second dust collection chamber 8. One end of the operation rod 52 is fixed to the operation portion 51, and the disk-shaped partition wall 9 is fitted to the other end of the operation rod 52. The partition wall 9 has an external diameter that is somewhat smaller than the internal diameter of the second dust collection chamber 8 so that a gap is left between the partition wall 9 and the inner wall of the second dust collection chamber 8. The inside of the operation chamber 50 is sealed off from the inside of the first and second dust collection chambers 7 and 8 by a gasket 53.

The operation rod 52 is put through a spring 54 so that the operation portion 51 is loaded with a force that presses it upward within the operation chamber 50. Thus, when the user pulls down the operation portion 51, holding it between his fingers, downward along the slit 50*a* (in the direction indicated by arrow D) against the force exerted by the spring 54, the partition wall 9 moves downward (in the direction indicated by arrow E) together. When the user releases the operation portion 51, the resilience of the spring 54 brings the operation portion 51 back to the upper end of the slit 50*a*, and thus the partition wall 9 moves back to its initial position.

When dust has collected to a considerably high level in the second dust collection chamber 8, the user pulls the operation portion 51 down, holding it between his fingers, from the upper to the lower end of the slit 50*a*, and then releases the operation portion 51 to let it move back to the upper end. In this way, it is possible to compress the dust to a lower level with the partition wall 9 and thereby reduce its volume. If performing this operation once is insufficient to compress the dust satisfactorily, the operation may be repeated several times.

In this embodiment, where the partition wall 9 is movable so that the collected dust can be compressed therewith, it is possible to increase the free space in the second dust collection chamber 8 and collect more dust without disposing of the already collected dust. This helps reduce the frequency with which the user needs to dispose of the collected dust, and thus helps make the second dust collection chamber 8 more compact. To dispose of the dust collected in the first and second dust collection chambers 7 and 8, the user first pushes down the first and second dust collection chambers 7 and 8 integrally, then dismounts them integrally from the mounting mechanism 30, and then separates the two dust collection chambers from each other. Here, since the collected dust is compressed, it is less likely to scatter around.

Sixth Embodiment

Figure 27A:
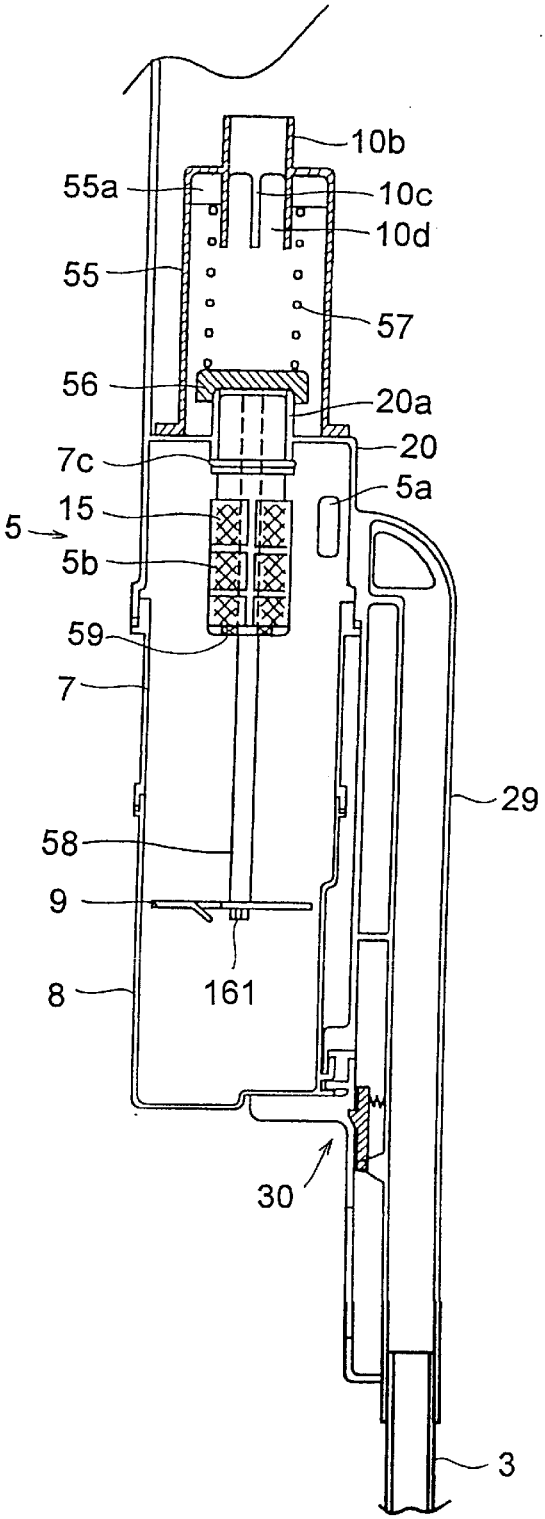
FIGS. 27A and 27B are vertical sectional views of the cyclone dust collector of the electric vacuum cleaner of a sixth embodiment.
Figure 27B:
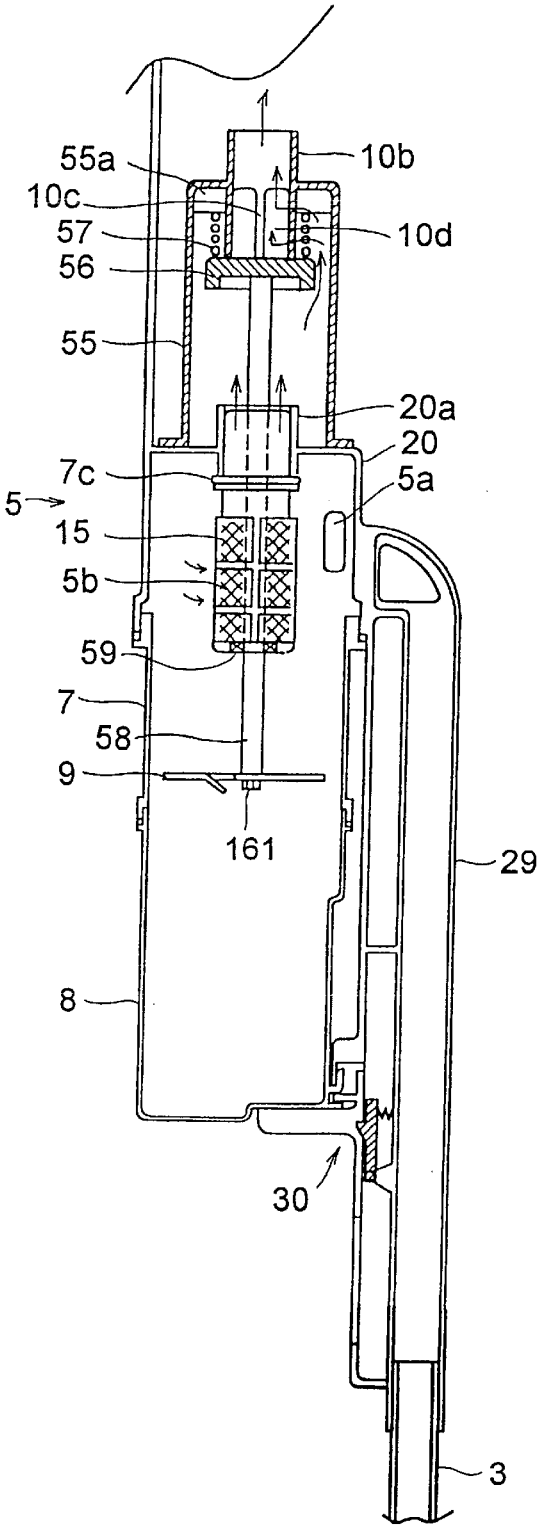
Figure 28:
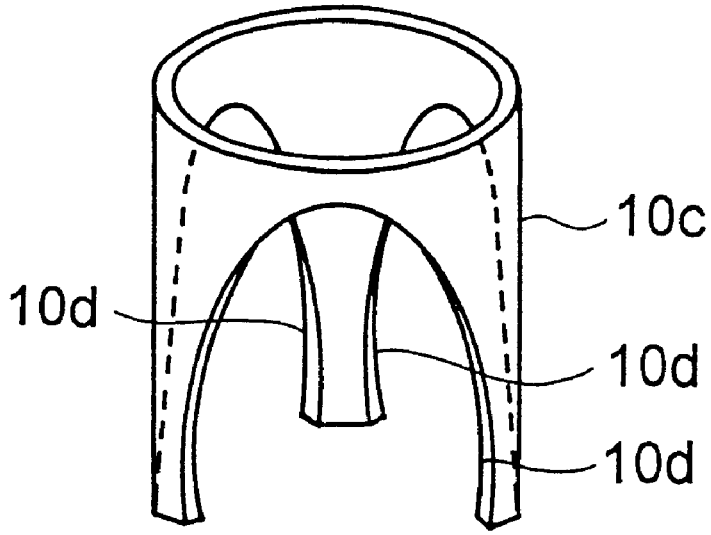
FIG. 28 is a perspective view of a lower portion of the coupling pipe provided in the cyclone dust collector in the sixth embodiment.

A sixth embodiment of the invention will be described below. FIGS. 27A and 27B are vertical sectional views of the cyclone dust collector 5 of the electric vacuum cleaner of this embodiment. In these figures, reference numeral 55 represents a work chamber 55 that is disposed above the suction air guide 20 and that communicates through the dust collector 5 with the suction air passage. In the top surface of the work chamber 55, a cylindrical coupling pipe 10*b* is provided concentrically therewith. The portion of the coupling pipe 10*b* that is located inside the work chamber 55 is, as shown in FIG. 28, formed into a stopper 10*c* having arch-shaped openings 10*d* at a plurality of locations (in FIG. 28, at three locations) in the peripheral surface of the cylinder.

Inside the work chamber 55, a float 56 is provided coaxially with the coupling pipe 10*b* and the holder portion 20*a*, with a gap left between the float 56 and the inner wall of the work chamber 55. This float 56 is loaded with a force that presses it toward the holder portion 20*a* by a spring 57. One end of the spring 57 is fixed to ribs 55*a* provided on the lower side of the top surface of the work chamber 55, and the other end of the spring 57 is connected to the top surface of the float 56.

Figure 29:
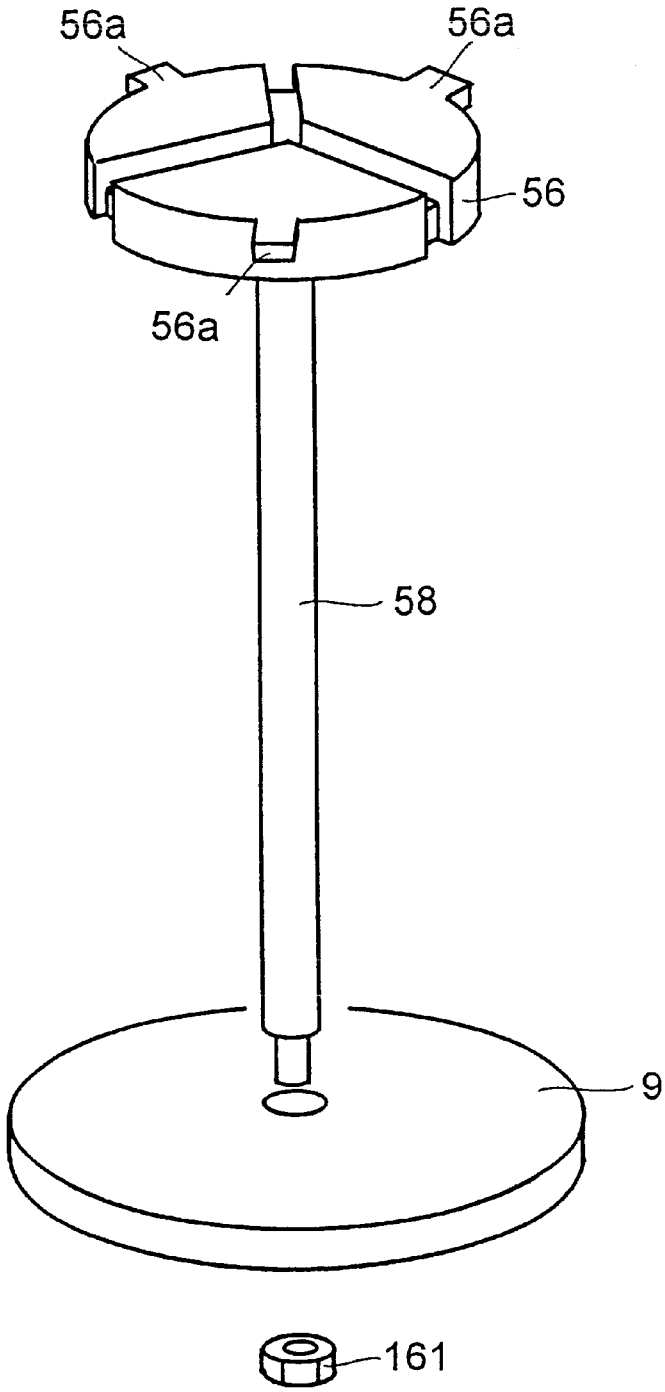
FIG. 29 is a perspective view of the float and the partition wall provided in the cyclone dust collector in the sixth embodiment.

As shown in FIG. 29, at a plurality of locations (in FIG. 29, at three locations) on the peripheral surface of the float 56, projections 56*a* are formed. These projections 56*a* permit the float 56 to slide stably along the inner wall of the work chamber 55. Reference numeral 58 represents a connecting rod having one end fixed at the center of the float 56. The connecting rod 58 is put through the exhaust tube 15, and is then, at the other end, fitted to the partition wall 9 with a nut 161. Reference numeral 59 represents a gasket fitted to the lower end of the exhaust tube 15 and formed out of rubber or the like. The gasket 59 prevents the suction air flow from flowing along that portion of the connecting rod 58 that is put through the exhaust tube 15.

As shown in FIG. 27A, the force exerted by the spring 57 presses the float 56 onto the holder portion 20*a* side of the suction air guide 20. In this state, when the electric blower 1*a* starts being driven, the resulting suction air flow produces a negative pressure inside the work chamber 55, and thus, as shown in FIG. 27B, the float 56 is sucked up toward the coupling pipe 10*b* against the force exerted by the spring 57 until it makes contact with the stopper 10*c*. As a result, a suction air passage is formed that runs through the electric blower 1*a*, the suction hose 2, the work chamber 55, the cyclone dust collector 5, the connection pipe 3, and the nozzle unit 4 in this order.

The suction air flow, together with dust, flows from the connection pipe 3 into the cyclone dust collector 5 through the inlet 5*a* thereof, and then, while whirling around inside the first dust collection chamber 7, separates the dust. Part of the separated dust passes around the partition wall 9 and is collected in the second dust collection chamber 8. The suction air flow, after the dust has been separated therefrom, flows through the outlet 5*b* formed in the exhaust tube 15, then through the exhaust tube 15, then through the gap around the float 56, and then through the openings 10*d* to reach the electric blower 1*a*, and is thereby exhausted.

When the electric blower la stops being driven, the negative pressure inside the work chamber 55 ceases to exist. Thus, the force exerted by the spring 57 moves the float 56 and the partition wall 9 down so as to restore the state shown in FIG. 27A. Meanwhile, the partition wall 9 moving down compresses the dust collected in the second dust collection chamber 8 downward, and thereby reduces its volume. When the electric blower la starts being driven next time, dust is sucked in with the partition wall 9 up again so that part of the dust is collected in the second dust collection chamber 8.

In this way, every time the electric blower 1*a* starts and stops being driven, the dust collected in the second dust collection chamber 8 is compressed. This makes it possible to increase the free space inside the second dust collection chamber 8 and collect more dust without disposing of the already collected dust. This helps reduce the frequency with which the user needs to dispose of the dust collected in the second dust collection chamber 8, and thus helps make the second dust collection chamber 8 more compact. To dispose of the dust collected in the first and second dust collection chambers 7 and 8, the user first pushes down the first and second dust collection chambers 7 and 8 integrally, then dismounts them integrally from the mounting mechanism 30, and then separates the two dust collection chambers from each other.

Seventh Embodiment

Figure 30A:
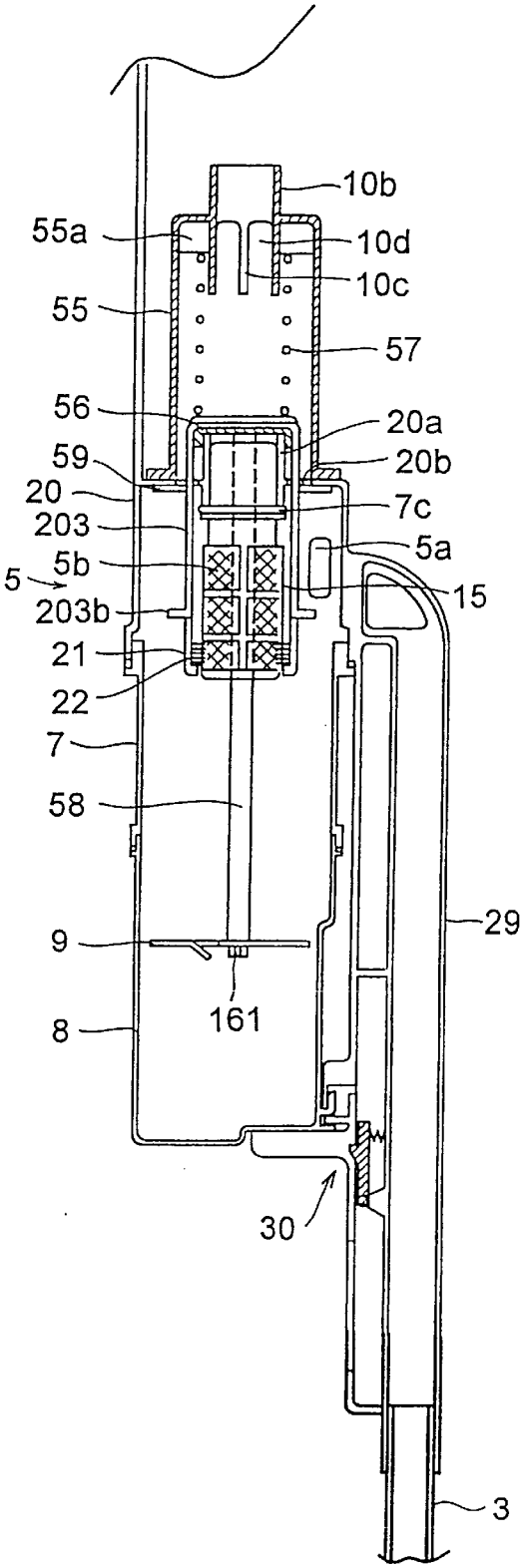
FIGS. 30A and 30B are vertical sectional views of the cyclone dust collector of the electric vacuum cleaner of a seventh embodiment.
Figure 30B:
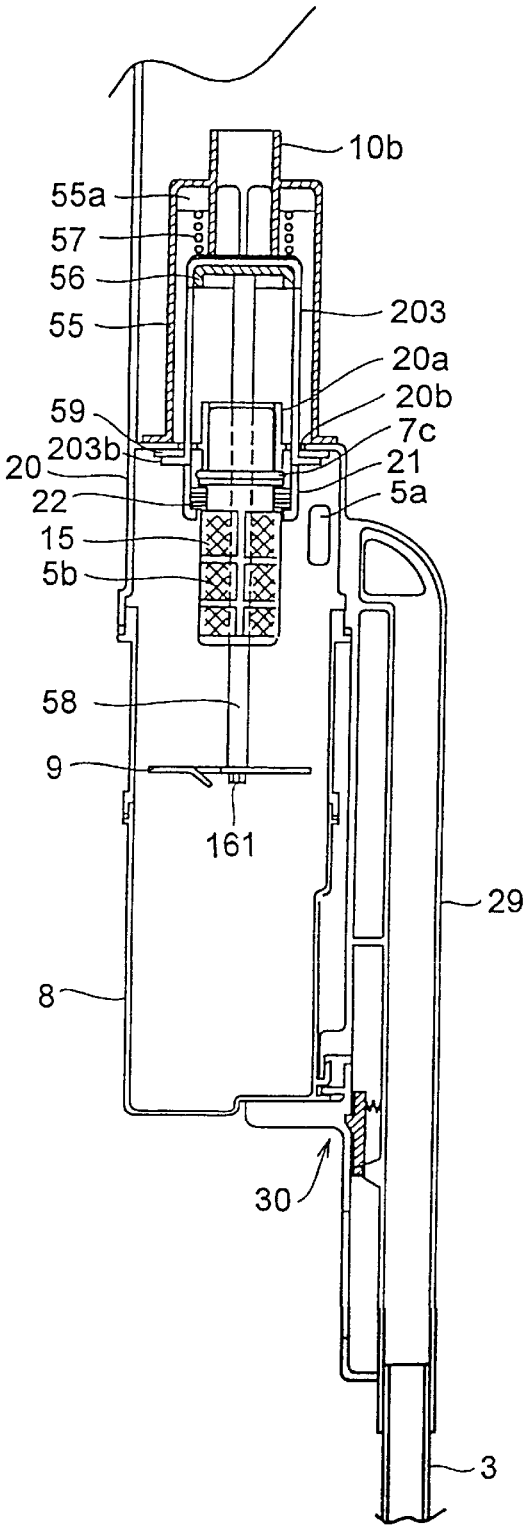

A seventh embodiment of the invention will be described below. FIGS. 30A and 30B are vertical sectional views of the cyclone dust collector 5 of the electric vacuum cleaner of this embodiment. In these figures, reference numeral 203 represents a coupling arm firmly fitted to the float 56. At the lower end of the coupling arm 203, the ring 21 is provided. Around the inner peripheral surface of this ring 21 is provided the brush 22 for cleaning the outlet 4*b* formed in the peripheral surface of the exhaust tube 15. In the top surface of the suction air guide 20, at a plurality of locations around a circle somewhat outside a base portion of the holder portion 20*a* that protrude from that surface, guide holes 20*b* are formed that guide the vertical movement of the coupling arm 203. The outer portions of these guide holes 20*b* are sealed with a ring-shaped gasket 59 formed out of rubber or the like.

Figure 31:
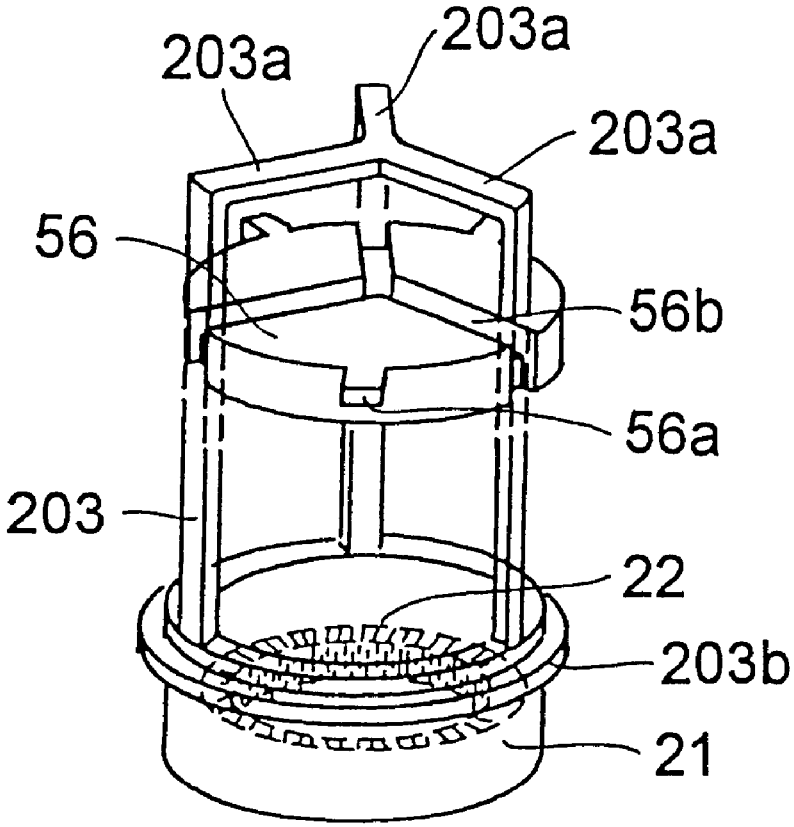
FIG. 31 is a perspective view of the float and the cleaning ring provided in the cyclone dust collector in the seventh embodiment.

FIG. 31 is a perspective view showing the relationship among the float 56, the coupling arm 203, and the ring 21. In the top surface of the float 56, grooves 56*b* are formed so as to extend from the center of the float 56 outward in directions about 120° apart from one another. The top end of the coupling arm 203 is formed into a branching portion 203*a* that extends from the center thereof outward in directions about 120° apart from one another. By engaging the branching portion 203*a* with the grooves 56*b* of the float 56, the coupling arm 203 is fitted firmly to the float 56. This permits the float 56 and the ring 21 to be moved integrally. Reference numeral 203*b* represents a brim portion formed at the lower end of the coupling arm 203 integrally therewith and having an external diameter larger than that of the coupling arm 203.

As shown in FIG. 30A, the force exerted by the spring 57 presses the float 56 onto the holder portion 20*a* side of the suction air guide 20. In this state, when the electric blower 1*a* starts being driven, the resulting suction air flow produces a negative pressure inside the work chamber 55, and thus, as shown in FIG. 30B, the float 56 is sucked up toward the coupling pipe 10*b* until it makes contact with the stopper 10*c*. As a result, a suction air passage is formed that runs through the electric blower 1*a*, the suction hose 2, the work chamber 55, the cyclone dust collector 5, the connection pipe 3, and the nozzle unit 4 in this order.

As the float 56 is sucked up, the ring 21 and the partition wall 9 move up together. Meanwhile, the brush 22 provided on the ring 21 rubs the surface of the outlet 5*b* formed in the peripheral surface of the exhaust tube 15, and thereby removes the dust that has settled thereon. Simultaneously, the partition wall 9 moves up, and thereby increases the volume inside the second dust collection chamber 8.

When the ring 21 moves up together with the float 56, the brim portion 203*b* of the coupling arm 203 is pressed onto the gasket 59. This prevents the suction air flow from flowing into the work chamber 55 through the guide holes 20*b*. Thus, the suction air flow flows through the exhaust tube 15 without leaking anywhere, and is sucked efficiently by the electric blower 1*a*.

The suction air flow, together with dust, flows from the connection pipe 3 into the cyclone dust collector 5 through the inlet 5*a* thereof, and then, while whirling around inside the first dust collection chamber 7, separates the dust. Part of the separated dust passes around the partition wall 9 and is collected in the second dust collection chamber 8. The suction air flow, after the dust has been separated therefrom, flows through the outlet 5*b* formed in the exhaust tube 15, then through the exhaust tube 15, then through the gap around the float 56, and then through the openings 10*d* to reach the electric blower la, and is thereby exhausted.

When the electric blower 1*a* stops being driven, the negative pressure inside the work chamber 55 ceases to exist. Thus, the force exerted by the spring 57 moves the float 56, together with the partition wall 9 and the ring 21, down so as to restore the state shown in FIG. 30A. Meanwhile, the brush 22 provided on the ring 21 rubs the surface of the outlet 5*b* formed in the peripheral surface of the exhaust tube 15. Simultaneously, the partition wall 9 moving down compresses the dust collected in the second dust collection chamber 8 downward, and thereby reduces its volume. When the electric blower 1*a* starts being driven next time, dust is sucked in with the partition wall 9 up again so that part of the dust is collected in the second dust collection chamber 8.

In this way, every time the electric blower 1*a* starts and stops being driven, the dust collected in the second dust collection chamber 8 is compressed. This makes it possible to increase the free space inside the second dust collection chamber 8 and collect more dust without disposing of the already collected dust. This helps reduce the frequency with which the user needs to dispose of the dust collected in the second dust collection chamber 8, and thus helps make the second dust collection chamber 8 more compact.

Moreover, the outlet 5*b* formed in the peripheral surface of the exhaust tube 15 can be cleaned on a maintenance-free basis. This eliminates the need to clean the outlet 5*b* by hand, and thus saves trouble and contributes to the user's hygiene. To dispose of the dust collected in the first and second dust collection chambers 7 and 8, the user first pushes down the first and second dust collection chambers 7 and 8 integrally, then dismounts them integrally from the mounting mechanism 30, and then separates the two dust collection chambers from each other.

Eighth Embodiment

Figure 32:
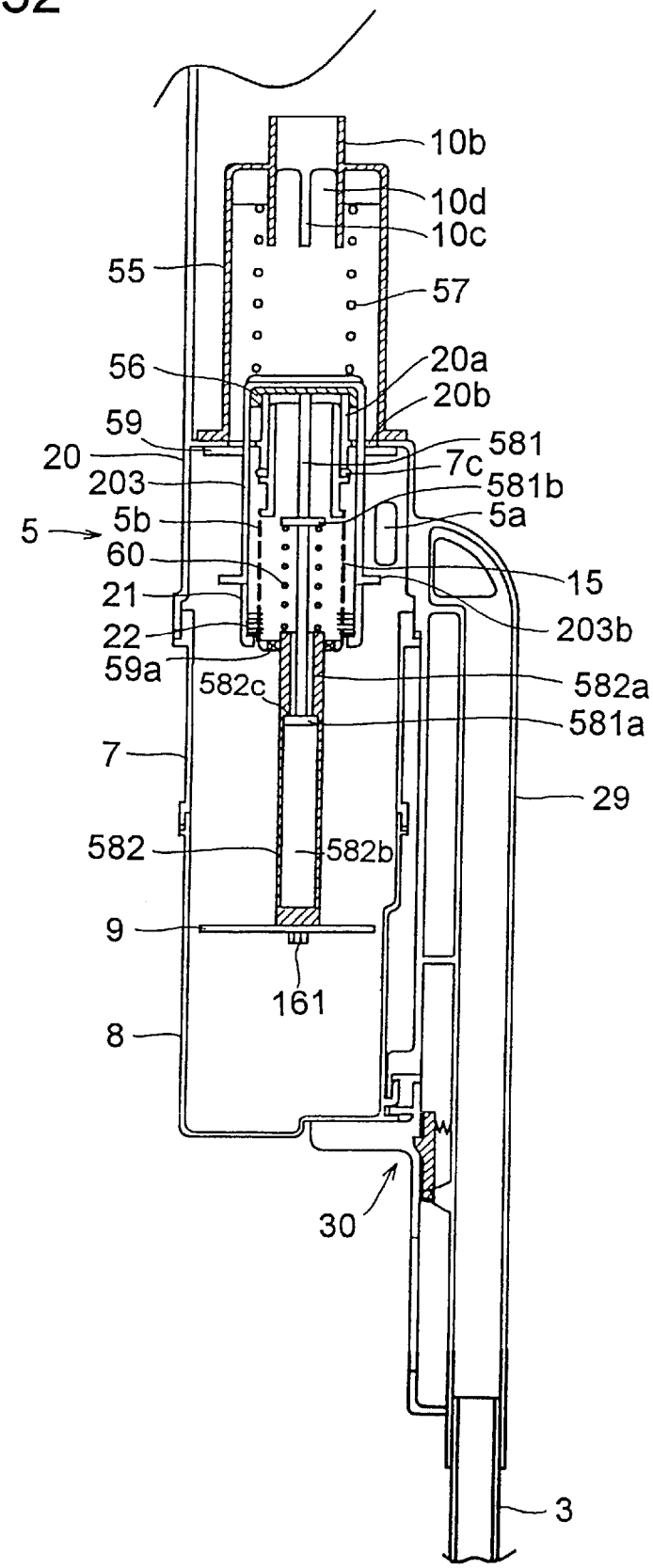
FIG. 32 is a vertical sectional view of the cyclone dust collector of the electric vacuum cleaner of an eighth embodiment.

An eighth embodiment of the invention will be described below. FIG. 32 is a vertical sectional view of the cyclone dust collector 5 of the electric vacuum cleaner of this embodiment. This embodiment is a modified version of the seventh embodiment described previously. FIG. 32 shows, in a sectional view, an example of how the float 56, the coupling arm 203, the ring 21, and the partition wall 9 are coupled together. In this embodiment, just as in the seventh embodiment, the ring 21 is coupled through the coupling arm 203 to the float 56 provided inside the work chamber 55 so that the ring 21 follows the vertical movement of the float 56.

The cyclone dust collector 5 of this embodiment is characterized by the following structural features. Reference numeral 581 represents a first coupling rod that has its upper end fixed to the lower side of the top surface of the float 56 and that hangs down along the central axis. The lower end of this first coupling rod 581 is formed into a disk-shaped brim portion 581*a*, and the first coupling rod 581 is put through a second coupling rod 582. Reference numeral 60 represents a spring hanging from a spring base 581*b* provided at an appropriate location on the first coupling rod 581. This spring 60 loads the second coupling rod 582 with a force, weaker than that exerted by the spring 57, that presses the second coupling rod 582 downward. To the lower end of the second coupling rod 582, the partition wall 9 is fitted with a nut 161. The second coupling rod 582 penetrates the lower-end surface of the exhaust tube 15, with a gasket 59*a* fitted in between.

Inside the second coupling rod 582, a first space 582*a* and a second space 582*b*, both cylindrical in shape but having different internal diameters, are formed coaxially, with a shoulder portion 582*c* formed in between. The second space 582*b* has an internal diameter that is substantially equal to the external diameter of the brim portion 581*a* of the first coupling rod 581 put through the first space 582*a* from the upper end thereof. Thus, in the state in which, as shown in the figure, the second coupling rod 582 is pressed fully down by the spring 60, the brim portion 581*a* of the first coupling rod 581 makes contact with the shoulder portion 582*c* so that the second coupling rod 582 is locked in a predetermined position.

In this structure, when the electric blower 1*a* starts being driven, the float 56 is sucked up toward the coupling pipe 10*b* until it makes contact with the stopper 10*c*. As a result, a suction air passage is formed that runs through the electric blower 1*a*, the suction hose 2, the work chamber 55, the cyclone dust collector 5, the connection pipe 3, and the nozzle unit 4 in this order.

As the float 56 is sucked up, the ring 21 and the partition wall 9 move up together. Meanwhile, the brush 22 provided on the ring 21 rubs the surface of the outlet 5*b* formed in the peripheral surface of the exhaust tube 15, and thereby removes the dust that has settled thereon. Simultaneously, the partition wall 9 moves up, and thereby increases the volume inside the second dust collection chamber 8.

When the ring 21 moves up together with the float 56, the brim portion 203*b* of the coupling arm 203 is pressed onto the gasket 59. This prevents the suction air flow from flowing into the work chamber 55 through the guide holes 20*b*. Thus, the suction air flow flows through the exhaust tube 15 without leaking anywhere, and is sucked efficiently by the electric blower 1*a*.

The suction air flow, together with dust, flows from the connection pipe 3 into the cyclone dust collector 5 through the inlet 5*a* thereof, and then, while whirling around inside the first dust collection chamber 7, separates the dust. Part of the separated dust passes around the partition wall 9 and is collected in the second dust collection chamber 8. The suction air flow, after the dust has been separated therefrom, flows through the outlet 5*b* formed in the exhaust tube 15, then through the exhaust tube 15, then through the gap around the float 56, and then through the openings 10*d* to reach the electric blower 1*a*, and is thereby exhausted.

When the electric blower 1*a* stops being driven, the negative pressure inside the work chamber 55 ceases to exist. Thus, the strong force exerted by the spring 57 moves the float 56, together with the partition wall 9 and the ring 21, down until the float 56 makes contact with the holder portion 20*a* of the suction air guide 20. Meanwhile, if a large amount of dust has collected in the second dust collection chamber 8, the partition wall 9 stops moving down on the way, because the force exerted by the spring 60 is weak.

In this structure, even if the dust collected in the second dust collection chamber 8 restricts the downward movement of the partition wall 9, the ring 21 can move down to the lower end of the exhaust tube 15 without fail. This permits the brush 22 provided on the ring 21 to remove, without fail, the dust that has settled on the surface of the outlet 5*b* provided in the peripheral surface of the exhaust tube 15.

Ninth Embodiment

Figure 33A:
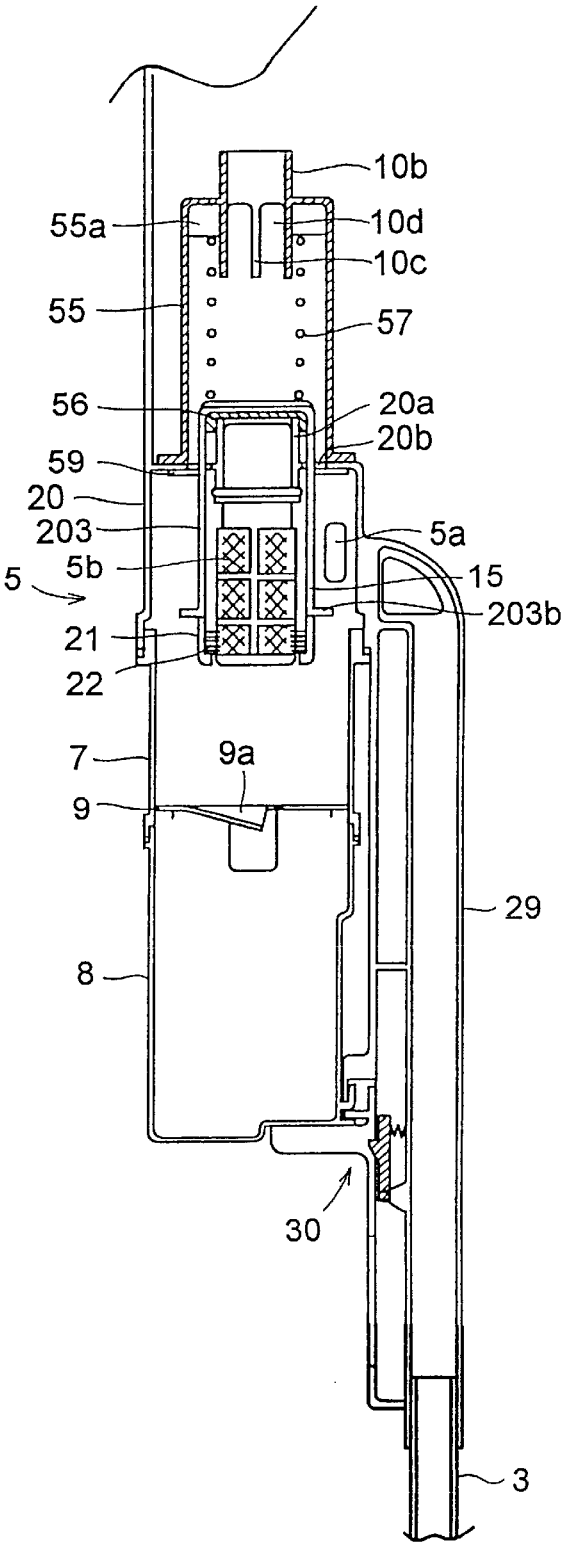
FIGS. 33A and 33B are vertical sectional views of the cyclone dust collector of the electric vacuum cleaner of a ninth embodiment.
Figure 33B:
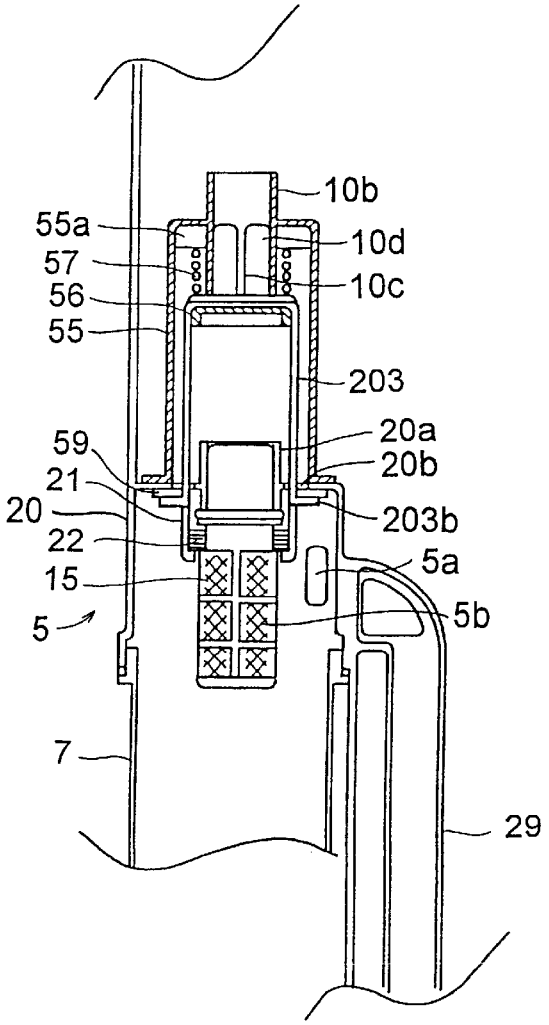

A ninth embodiment of the invention will be described below. FIGS. 33A and 33B are vertical sectional views of the cyclone dust collector 5 of the electric vacuum cleaner of this embodiment. As shown in these figures, the cyclone dust collector 5 of this embodiment is characterized in that the partition wall 9 that separates the first and second dust collection chambers 7 and 8 from each other is fixed to the first dust collection chamber 7, and that only the ring 21 is coupled through the coupling arm 203 to the float 56.

As shown in FIG. 33A, the force exerted by the spring 57 presses the float 56 onto the holder portion 20*a* side of the suction air guide 20, thereby blocking the suction air passage on the upstream side of the holder portion 20*a*. In this state, when the electric blower 1*a* starts being driven, the resulting suction air flow produces a negative pressure inside the work chamber 55, which is now air-tight, and thus, as shown in FIG. 33B, the float 56 is sucked up toward the coupling pipe 10*b* until it makes contact with the stopper 10*c*. As a result, a suction air passage is formed that runs through the electric blower 1*a*, the suction hose 2, the work chamber 55, the cyclone dust collector 5, the connection pipe 3, and the nozzle unit 4 in this order.

As the float 56 is sucked up, the ring 21 moves up together. Meanwhile, the brush 22 provided on the ring 21 rubs the surface of the outlet 5*b* formed in the peripheral surface of the exhaust tube 15, and thereby removes the dust that has settled thereon.

When the ring 21 moves up together with the float 56, the brim portion 203*b* of the coupling arm 203 is pressed onto the gasket 59. This prevents the suction air flow from flowing into the work chamber 55 through the guide holes 20*b*. Thus, the suction air flow flows through the exhaust tube 15 without leaking anywhere, and is sucked efficiently by the electric blower 1*a*.

The suction air flow, together with dust, flows from the connection pipe 3 into the cyclone dust collector 5 through the inlet 5*a* thereof, and then, while whirling around inside the first dust collection chamber 7, separates the dust. Part of the separated dust passes through the opening 9*a* formed in the partition wall 9 and is collected in the second dust collection chamber 8. The suction air flow, after the dust has been separated therefrom, flows through the outlet 5*b* formed in the exhaust tube 15, then through the exhaust tube 15, then through the gap around the float 56, and then through the openings 10*d* to reach the electric blower 1*a*, and is thereby exhausted.

When the electric blower 1*a* stops being driven, the negative pressure inside the work chamber 55 ceases to exist. Thus, the force exerted by the spring 57 moves the float 56, together with the ring 21, down so as to restore the state shown in FIG. 33A. Meanwhile, the brush 22 provided on the ring 21 rubs the surface of the outlet 5*b* formed in the peripheral surface of the exhaust tube 15, and thereby removes the dust that has settled thereon.

Thus, the outlet 5*b* formed in the peripheral surface of the exhaust tube 15 can be cleaned on a maintenance-free basis. This eliminates the need to clean the outlet 5*b* by hand, and thus saves trouble and contributes to the user's hygiene. To dispose of the dust collected in the first and second dust collection chambers 7 and 8, the user first pushes down the first and second dust collection chambers 7 and 8 integrally, then dismounts them integrally from the mounting mechanism 30, and then separates the two dust collection chambers from each other.

The members that are interlocked with the float 56 in this and the preceding embodiments, i.e. the float 56 itself, the ring 21, the partition wall 9, the connecting rods 58, 581, and 582, and others, may be formed of a material having a high specific gravity, such as metal or composite resin. In that case, when the electric blower 1*a* stops being driven, the float 56 returns to its initial position by its own weight. This eliminates the need to use the springs 57 and 60, and thus helps simplify the structure and reduce the cost of the cyclone dust collector 5.

Tenth Embodiment

Figure 34A:
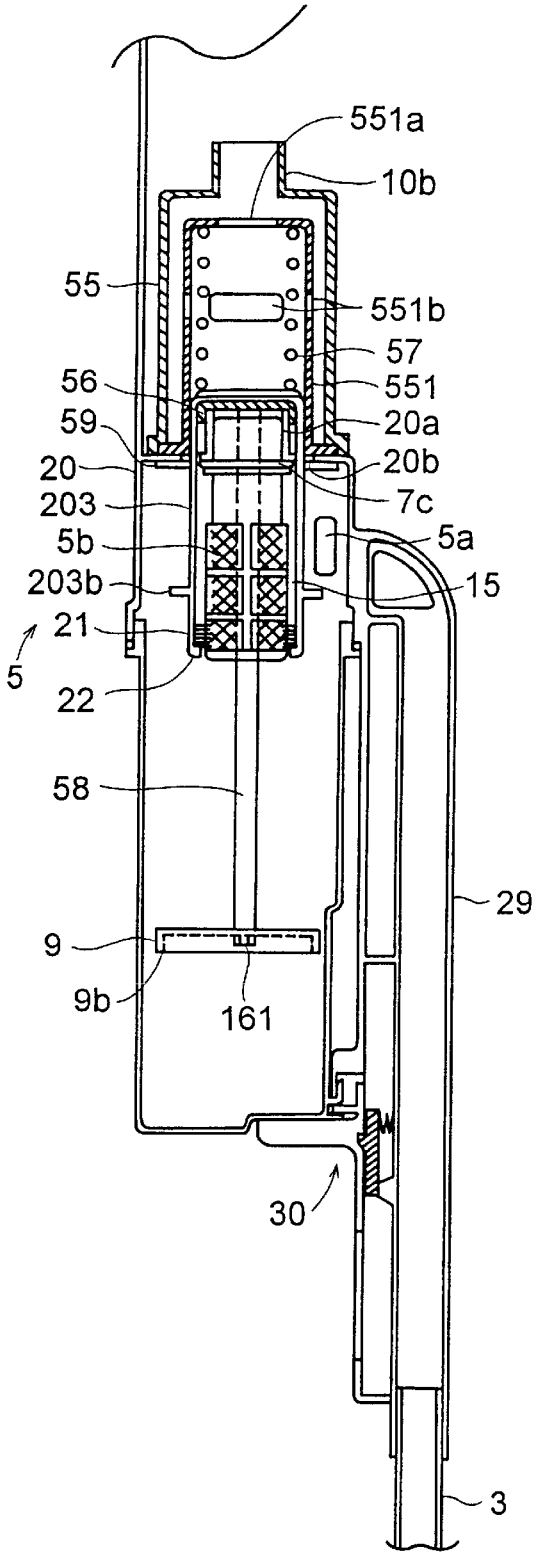
FIGS. 34A and 34B are vertical sectional views of the cyclone dust collector of the electric vacuum cleaner of a tenth embodiment.
Figure 34B:
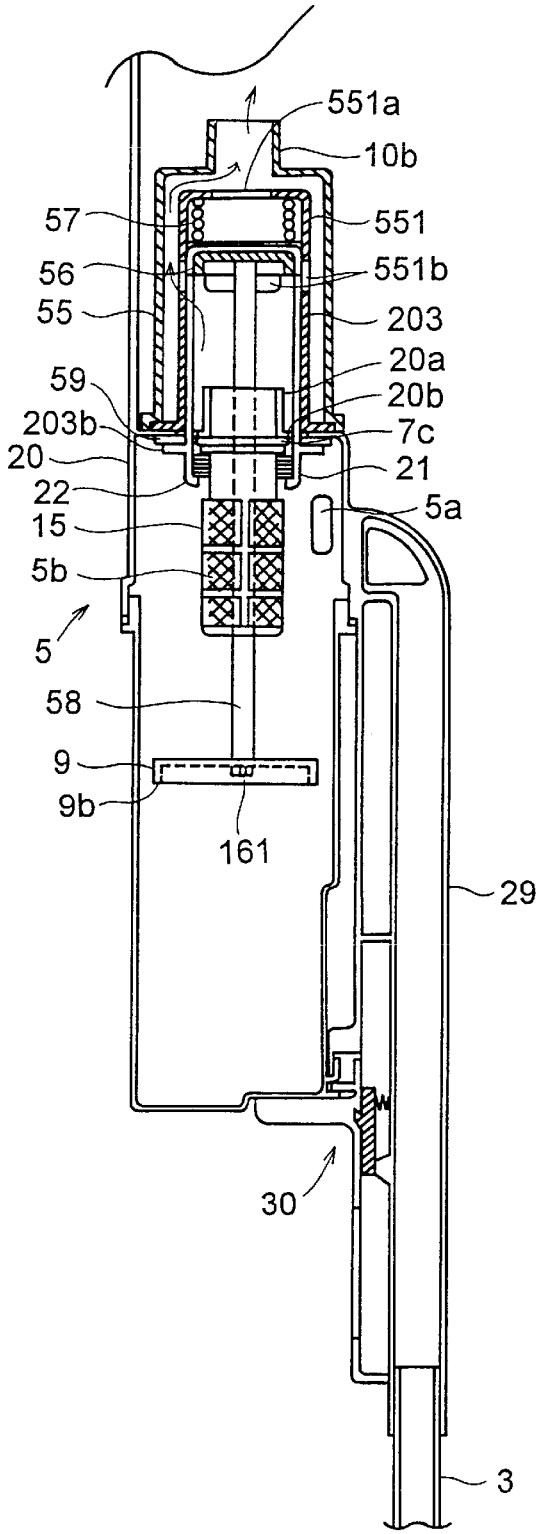

A tenth embodiment of the invention will be described below. FIGS. 34A and 34B are vertical sectional views of the cyclone dust collector 5 of the electric vacuum cleaner of this embodiment. This embodiment is a modified version of the seventh embodiment described previously.

In the sixth to ninth embodiments, for example in the work chamber 55 shown in FIGS. 27A and 27B, when the output of the electric blower 1*a* decreases, or when the resistance through the suction air passage increases, and as a result the amount of air flowing through the suction air passage decreases, the float 56 does not move up high enough to contact with the stopper 10*c*, but moves unstably up and down repeatedly on the way. This can be avoided by adopting the structure shown in FIGS. 34A and 34B. This structure ensures that the float 56 moves up stably over the desired distance, and thus ensures that the ring 21 or the partition wall 9 moves over the desired distance.

In FIGS. 34A and 34B, inside the work chamber 55 is provided a float guide 551 having an internal diameter substantially equal to the external diameter of the float 56. Inside the float guide 551, the float 56 is loaded with a force that presses it downward by a spring 57. The float guide 551 has an outlet 551*a* formed in the top surface thereof, and has another outlet 551*b* formed in the peripheral surface thereof.

In the state shown in FIG. 34A, when the electric blower 1*a* starts being driven, a negative pressure is produced inside the work chamber 55 and the float guide 551 that communicates with the inside of the work chamber 55 through the upper outlet 551*a* and the lower outlet 551*b*, and thus the float 56 is sucked up. When the float 56 reaches above the lower outlet 551*b*, the suction air flow sucked in through the nozzle unit 4 flows through the lower outlet 551*b*, then through the work chamber 55, and then through the coupling pipe 10*b* by being sucked by the electric blower 1*a*, and is thereby exhausted. This structure ensures that the float 56 moves up to just above the lower outlet 551*b*. Thus, by setting the distance over which the float 56 moves up equal to the distance over which the ring 21 and the partition wall 9 need to be moved, it is possible to clean the filters 11*b* and compress the collected dust without fail.

Moreover, by providing a wall 9*b* that extends downward from the peripheral edge of the partition wall 9, it is possible to alleviate the "soaring up" of the dust collected below the partition wall 9 back above the partition wall 9. The cyclone dust collector 5 has been described as having the first and second dust collection chambers 7 and 8 that are separable from each other, but may be built as a single unit having those dust collection chambers integrated together.

Eleventh Embodiment

Figure 35:
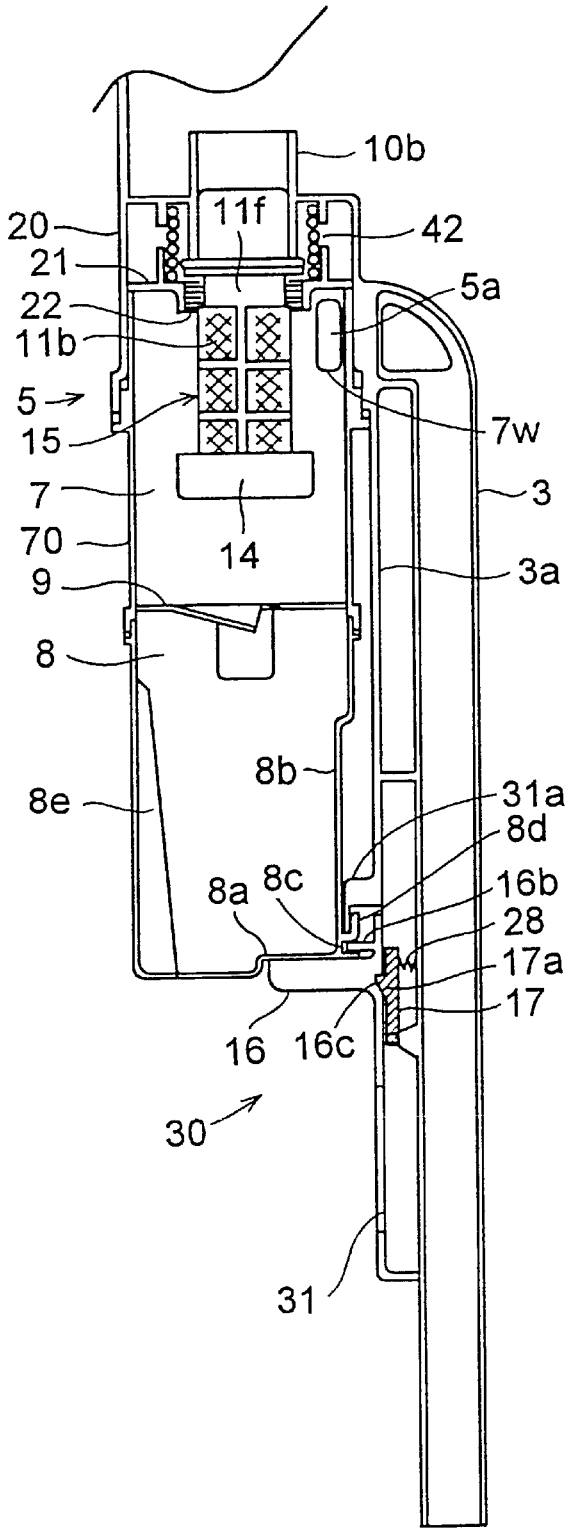
FIGS. 35 and 36 are vertical sectional views of the cyclone dust collector of the electric vacuum cleaner of an eleventh embodiment.
Figure 36:
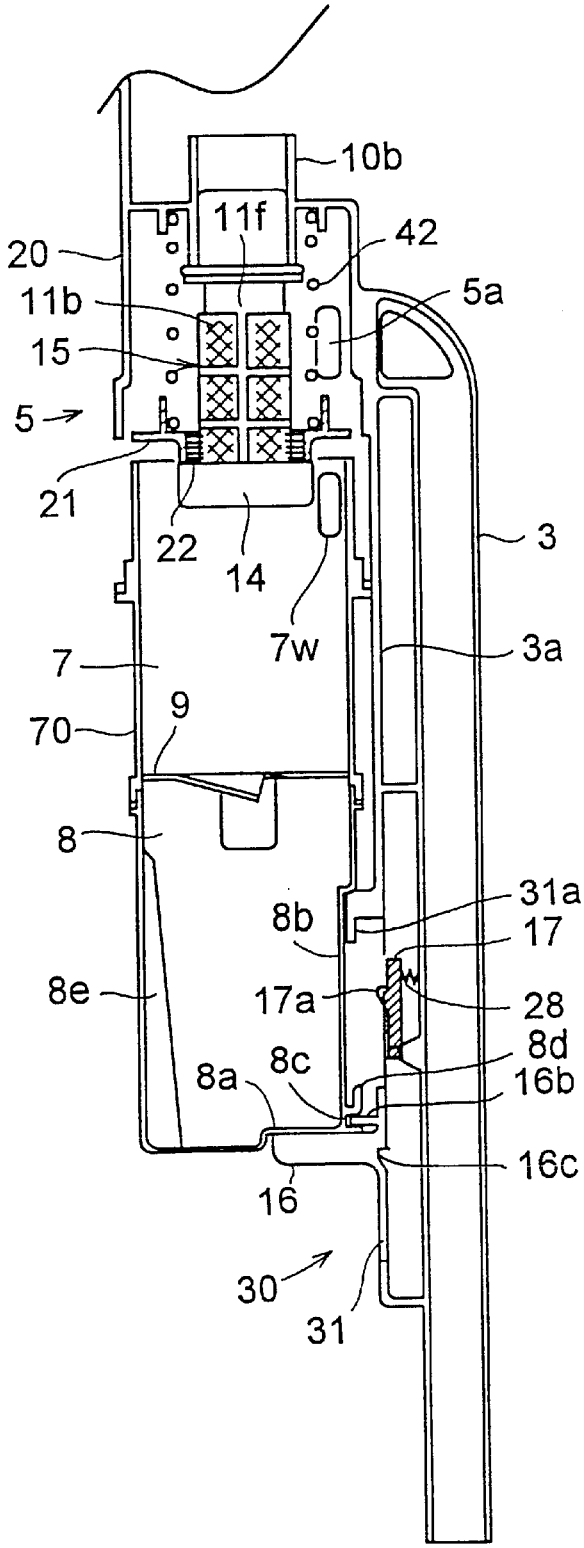

An eleventh embodiment of the invention will be described below. FIGS. 35 and 36 are vertical sectional views of the cyclone dust collector 5 of the electric vacuum cleaner of this embodiment. This embodiment is a modified version of the second embodiment described previously. The suction air guide 20 and the connection pipe 3 are formed integrally, and a mounting mechanism 30 is provided to permit the first and second dust collection chambers 7 and 8 to be detachably fitted to the suction air guide 20 and the connection pipe 3.

A ring 21 has a brush 22 provided inside, and has an external diameter slightly smaller than the internal diameter of the suction air guide 20. The screw portion 11*c* at the upper end of the exhaust tube 15 is put through this ring 21, and then the screw portion 11*c* is screw-engaged with the coupling pipe 10*b*. This permits the ring 21 to be fitted in position, with the dust tray 14 serving to prevent it from dropping out. The ring 21 is slidable along the axis of the exhaust tube 15, and is loaded with a force that presses it toward the dust tray 14 by a spring 42 inserted between the ring 21 and the ceiling surface of the suction air guide 20. In this embodiment, the peripheral wall 70 of the first dust collection chamber 7 extends upward so that the upper end of the peripheral wall 70 strikes the edge of the ring 21 and moves the ring 21 up to an upper-end portion of the exhaust tube 15 against the force exerted by the spring 42. FIG. 35 shows this state. In this state, the ring 21 is located above the inlet 5*a*. To secure an air inlet passage, the first dust collection chamber 7 has an opening 7*w* formed in the peripheral surface thereof where it overlaps the inlet 5*a*.

When, to dispose of the collected dust, the user disengages the locking member 17 form the sliding member 16, and then, as shown in FIG. 36, slides the sliding member 16 downward, the first and second dust collection chambers 7 and 8 move down together, and simultaneously the ring 21 moves down by being pressed by the spring 42. Meanwhile, the brush 22 slides along the filters 11*b*, keeping contact therewith, and thereby rakes off the dust that has been settled on the filters 11*b*. The dust thus raked off is collected in the dust tray 14 or in the first dust collection chamber 7. This raking continues until the ring 21 hits the dust tray 14 and stops moving. Meanwhile, the exhaust tube 15 is kept enclosed by the inner wall of the first dust collection chamber 7, and thus no dust scatters outside the first dust collection chamber 7. In all the embodiments described hereinafter also, the filters 11*b* are cleaned while the exhaust tube 15 is enclosed by the peripheral wall of the first dust collection chamber 7.

The dust raked off the filters 11*b* and collected in the first dust collection chamber 7 is disposed of together with the dust that had been collected there before. After the disposal of the collected dust, when the first and second dust collection chambers 7 and 8 are mounted again, while the first dust collection chamber 7 pushes up the ring 21, the brush 22 rubs the filters 11*b* from the bottom up, raking off dust. This time also, the upper end of the peripheral wall 70 of the first dust collection chamber 7 keeps intimate contact with the ring 21, and thus the exhaust tube 15 is kept enclosed by the inner wall of the first dust collection chamber 7. Thus, no part of the dust that has come off the exhaust tube 15 scatters outside the first dust collection chamber 7. In this way, every time the first and second dust collection chambers 7 and 8 are dismounted and mounted, the filters 11*b* are cleaned.

Twelfth Embodiment

Figure 37:
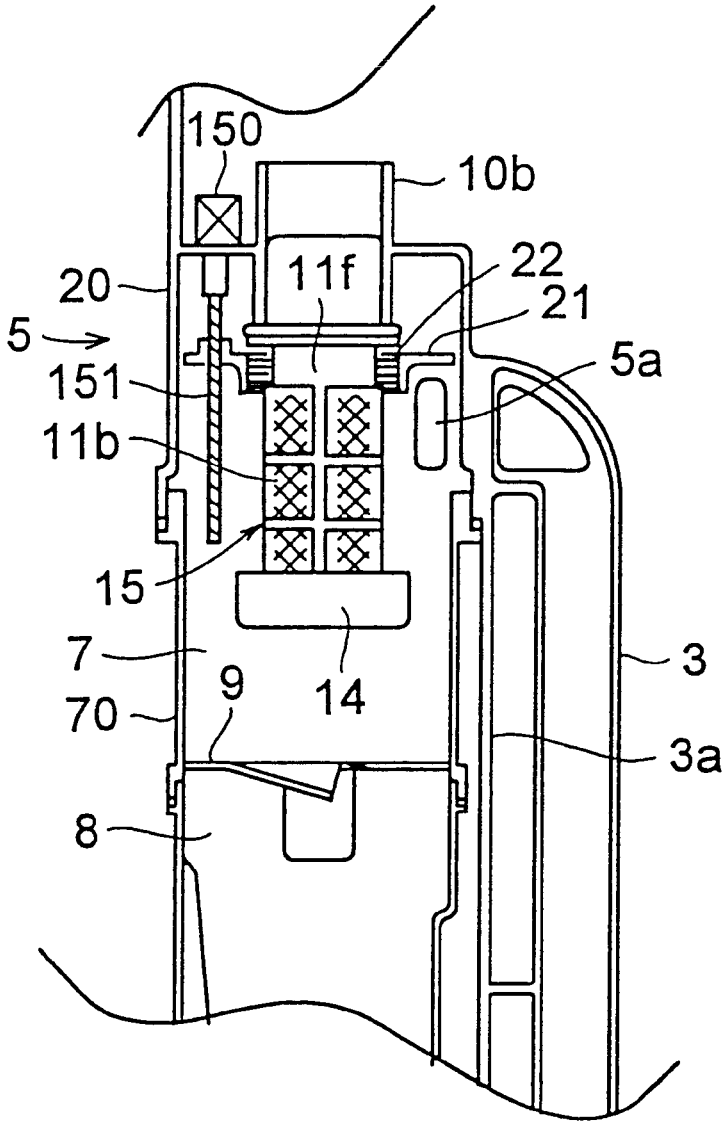
FIG. 37 is a vertical sectional view of the cyclone dust collector of the electric vacuum cleaner of a twelfth embodiment.

A twelfth embodiment of the invention will be described below. FIG. 37 is a vertical sectional view of the cyclone dust collector 5 of the electric vacuum cleaner of this embodiment. In this embodiment, the ring 21 has almost the same shape as in the eleventh embodiment, but is made to slide with a different mechanism. Specifically, on the back side of the ceiling surface of the suction air guide 20, a motor 150 is provided, and a screw shaft 151 that is coupled to the motor 150 is, as a driving mechanism for the ring 21, screw-engaged with the ring 21. When the motor 150 is driven, the screw shaft 151 rotates, and, according to the direction of the rotation thereof, the ring 21 slides toward the lower or upper end of the exhaust tube 15. Meanwhile, the brush 22 cleans the filters 11*b*.

An operation switch for controlling the motor 150 is arranged in the operation portion 10*g* (see FIG. 49) on the coupling member 10. For safety, and to prevent the scattering of dust outside the first dust collection chamber 7, the motor 150 cannot be driven when the first dust collection chamber 7 is dismounted from the dust collection chamber mount portion 3*a*.

The motor 150 may be driven not only through the operation of the operation switch by the user but also automatically at predetermined times. For example, the motor 150 may be so programmed as to start at predetermined time intervals, or start when triggered by a predetermined event. For example, the motor 150 may be so programmed as to start rotating when the power cord of the main body 1 of the electric vacuum cleaner is connected to a power outlet. This permits the filters 11*b* to be cleaned beforehand in preparation for floor cleaning. Or, the motor 150 may be so programmed as to start rotating when cleaning is finished and the operation switch of the electric blower 1*a* is turned off. This permits the filters 11*b* to be cleaned at this point in preparation for cleaning next time.

Or, pressure detectors may be provided inside and outside the exhaust tube 15 so that, when the difference between the pressures on the downstream and upstream sides of the filters 11*b* becomes greater than a predetermined value, the filters 11*b* are judged to be clogged and the motor 150 is made to start rotating. This permits the ring 21 to be activated to refresh the dust suction force every time there is a sign of loss in the dust suction force while the electric vacuum cleaner is being used. In this way, it is possible to keep the dust suction force above a predetermined level and perform cleaning efficiently.

In any case, it is preferable to keep the electric blower 1*a* off while the motor 150 is rotating and inhibit the driving of the motor 150 while the electric blower 1*a* is rotating. The reason is that, if the ring 21 falls below the inlet 5*a* while air is flowing in through the inlet 5*a*, dust is likely to collect on the top surface of the ring 21. To prevent dust from collecting on the top surface of the ring 21, the home position of the ring 21 is located at an upper portion of the exhaust tube 15, where the tips of the brush 22 are accommodated in the recessed portion 11*f*, and the ring 21 is always moved up to its home position before the motor 150 is made to stop rotating.

Thirteenth Embodiment

Figure 38:
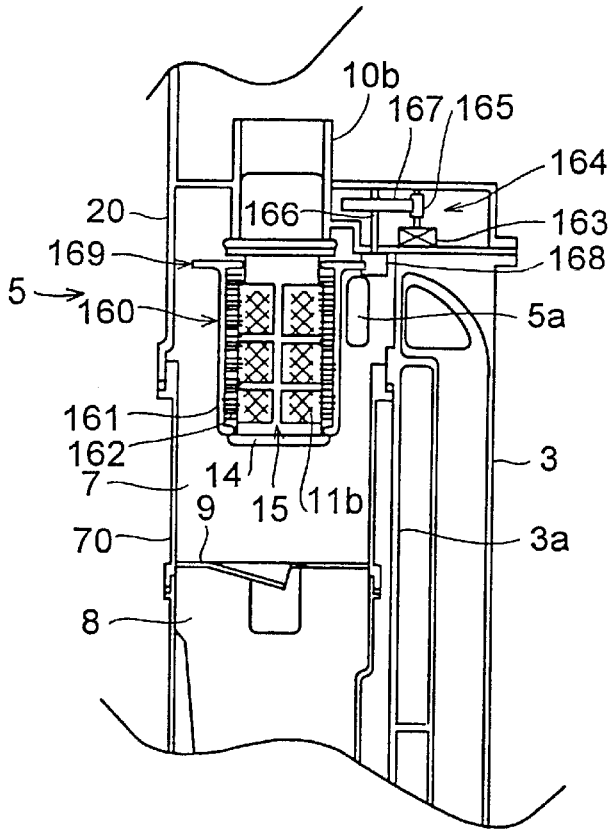
FIG. 38 is a vertical sectional view of the cyclone dust collector of the electric vacuum cleaner of a thirteenth embodiment.
Figure 39:
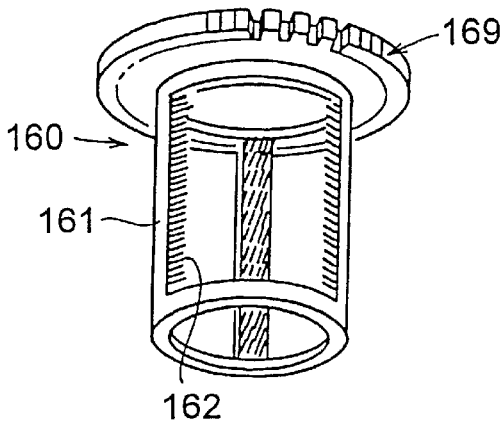
FIG. 39 is a perspective view of the cleaning member provided in the cyclone dust collector in the thirteenth embodiment.

A thirteenth embodiment of the invention will be described below. FIG. 38 is a vertical sectional view of the cyclone dust collector 5 of the electric vacuum cleaner of this embodiment. In this embodiment, the cleaning member is a cylindrical member 160 as shown in FIG. 39 is used to clean the filters 11*b*. The cleaning member 160 consists of a pair of upper and lower rings coupled together by a plurality of (in FIG. 39, three) vertical ribs 161. These vertical ribs 161 extend parallel to the axis of the exhaust tube 15, and have brushes 162 fitted on their respective inner surfaces. These brushes 162 flexibly make contact with the filters 11*b*. The cleaning member 160 is arranged substantially coaxially with the exhaust tube 15. The screw portion 11*c* at the upper end of the exhaust tube 15 is put through the cleaning member 160, and then the screw portion 11*c* is screw-engaged with the coupling pipe 10*b*. This permits the cleaning member 160 to be fitted in position in such a way as to be slidable around, and thus with respect to, the exhaust tube 15, with the dust tray 14 serving to prevent the cleaning member 160 from dropping out.

A motor 163 provided on the back side of the ceiling surface of the suction air guide 20 rotates the cleaning member 160 through a driving mechanism 164. The driving mechanism 164 is built as a reduction driving mechanism, and is composed of a pinion 165 fixed to the shaft of the motor 163, an intermediary shaft 166 that is rotatably pivoted on the suction air guide 20 and that has an intermediary gear 167 engaging with the pinion 165, and a large gear 169 that is formed at the upper end of the cleaning member 160 integrally therewith and that engages with another intermediary gear 168 on the intermediary shaft 166.

As with the motor 150 of the twelfth embodiment, the motor 163 cannot be driven when the first dust collection chamber 7 is dismounted from the dust collection chamber mount portion 3*a*. Moreover, as with the motor 150, the motor 163 may be driven not only through the operation of an operation switch by the user but also automatically at predetermined times.

It is preferable to provide a partition wall that shields the driving mechanism 164 from the flow of air that flows in through the inlet 5*a* and flows out through the coupling pipe 10*b*. This helps prevent dust from settling on, hampering the movement of, and eventually causing failure of the driving mechanism 164.

Fourteenth Embodiment

Figure 40:
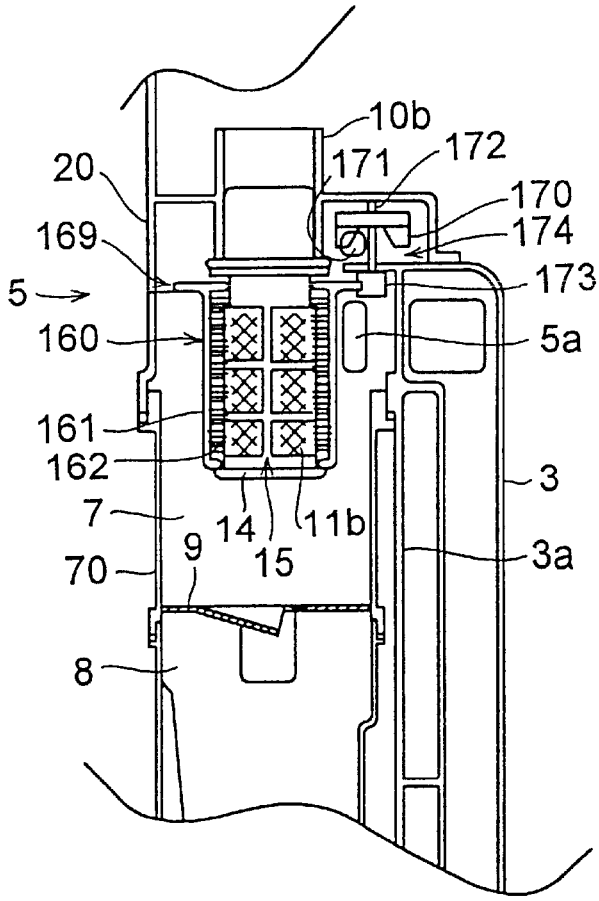
FIG. 40 is a vertical sectional view of the cyclone dust collector of the electric vacuum cleaner of a fourteenth embodiment.

FIG. 40 is a vertical sectional view of the cyclone dust collector 5 of the electric vacuum cleaner of a fourteenth embodiment of the invention. In this embodiment, the same cleaning member 160 as used in the thirteenth embodiment is used, but is driven not by a motor but by a pinwheel 170 that is rotated by the air that flows into the first dust collection chamber 7. The air passage running from the connection pipe 3 bifurcates inside the suction air guide 20, and an inlet 171 dedicated to the pinwheel 170 is formed above the inlet 5*a*. A shaft 172 fixed to the pinwheel 170, a pinion 173 fixed to the shaft 172, and large gear 169 formed at the upper end of the cleaning member 160 so as to engage with the pinion 173 together constitute a driving mechanism 174 for the cleaning member 160. When the electric blower la is driven and air is sucked in through the connection pipe 3, part of the air flows in through the inlet 171 and hits the pinwheel 170. As a result, the pinwheel 170 rotates, and its rotation is first reduced by the driving mechanism 174 and is then transmitted to the cleaning member 160. That is, during floor cleaning, the filters 11*b* continue being cleaned all the time.

Fifteenth Embodiment

Figure 41:
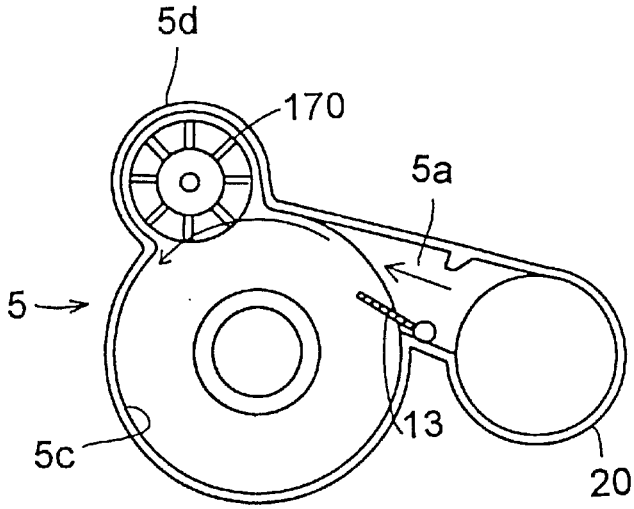
FIG. 41 is a horizontal sectional view of the cyclone dust collector of the electric vacuum cleaner of a fifteenth embodiment.

FIG. 41 is a horizontal sectional view of the cyclone dust collector 5 of the electric vacuum cleaner of a fifteenth embodiment of the invention. This embodiment is a modified version of the fourteenth embodiment, and differs therefrom only in the position of the pinwheel 170. Specifically, in this embodiment, part of the suction air guide 20 is expanded outward to form a pinwheel chamber 5*d*, and the pinwheel 170 is housed in this pinwheel chamber 5*d*. The suction air flow that flows in through the inlet 5*a* hits and thereby rotates the pinwheel 170.

In both the fourteenth and fifteenth embodiments, it is preferable to provide a partition wall that shields the driving mechanism 174 from the air that flows in through the inlets 5*a* and 171. This helps prevent dust from settling on, hampering the movement of, and eventually causing failure of the driving mechanism 174.

Sixteenth Embodiment

Figure 42:
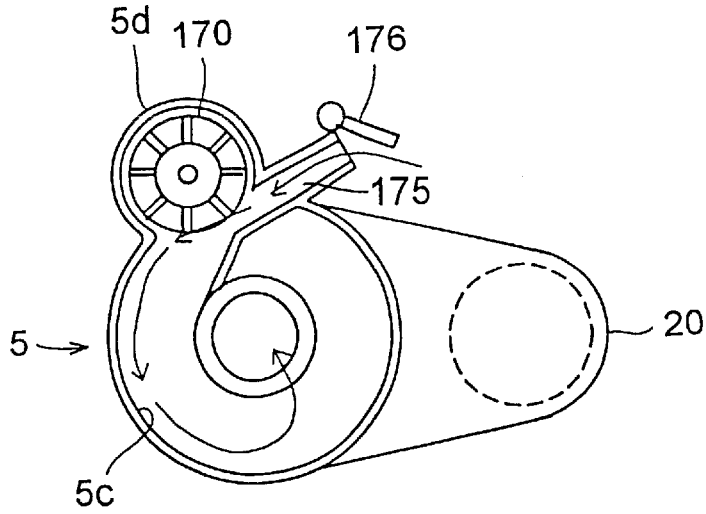
FIG. 42 is a horizontal sectional view of the cyclone dust collector of the electric vacuum cleaner of a sixteenth embodiment.

FIG. 42 is a horizontal sectional view of the cyclone dust collector 5 of the electric vacuum cleaner of a sixteenth embodiment of the invention. This embodiment is a modified version of the fifteenth embodiment. Specifically, in this embodiment, an inlet 175 through which to take in air directly from the outside is formed on the suction air guide 20, and the suction air flow that flows in through this inlet 175 hits the pinwheel 170 housed in the pinwheel chamber 5*d*. This air, as opposed to the air that flows in through the connection pipe 3, does not contain the dust sucked up from the floor surface, and therefore, even if it directly hits the driving mechanism, it is unlikely to cause failure thereof. At the entrance of the inlet 175, a valve 176 is provided so that the suction air flow is so controlled as to drive the driving mechanism 174 intermittently. The valve 176 is opened by being driven with a motor or a solenoid, and the opening and closing of the valve 176 are controlled through the operation of a switch provided near the user's hands. By using an electrically driven valve in this way, it is possible, just as in arrangements using a motor, to open the valve at predetermined times, or open it according to the difference between the pressures inside and outside the exhaust tube 15.

Seventeenth Embodiment

Figure 43:
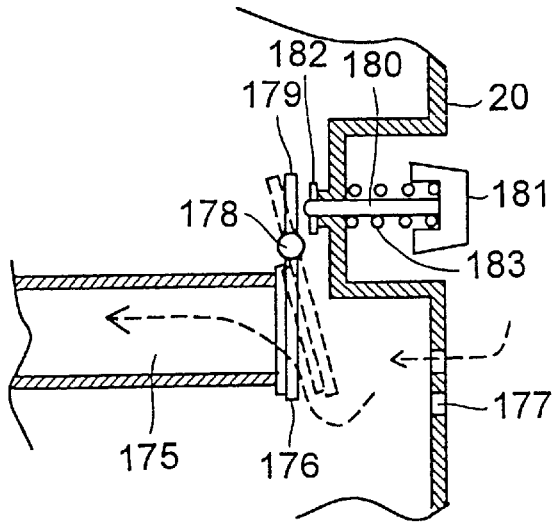
FIG. 43 is a horizontal sectional view of a portion of the cyclone dust collector of the electric vacuum cleaner of a seventeenth embodiment.

FIG. 43 is a horizontal sectional view of a portion of the cyclone dust collector 5 of the electric vacuum cleaner of a seventeenth embodiment of the invention. This embodiment is a modified version of the sixteenth embodiment. Specifically, the inlet 175 and the valve 176 provided at the entrance thereof are arranged inside the suction air guide 20, and an opening 177 through which to take in air from the outside is formed on the peripheral wall of the suction air guide 20. The valve 176 pivots on a shaft 178, and is loaded with a force that tends to make it close the inlet 175 by a spring (not shown). Reference numeral 179 represents a pressed portion that extends from the valve 176 past the shaft 178, and a rod 180 that penetrates the peripheral wall of the suction air guide 20 faces the pressed portion 179. To the rod 180, a push button 181 is fixed outside the suction air guide 20 and a stopper pin 182 is fixed inside the suction air guide 20. The rod 180 is loaded with a force that presses it outside the suction air guide 20 by a spring 183.

When the push button 181 is pressed while the electric blower 1*a* is rotating, the rod 180 presses the pressed portion 179 and causes the valve 176 to rotate to an open position. As a result, air is let in through the inlet 175, and thus the pinwheel 170 rotates. That is, the cleaning member 160 can be moved intermittently at will. It is also possible, as in the sixteenth embodiment, to drive the valve 176 with a motor, a solenoid, or the like.

Eighteenth Embodiment

Figure 44:
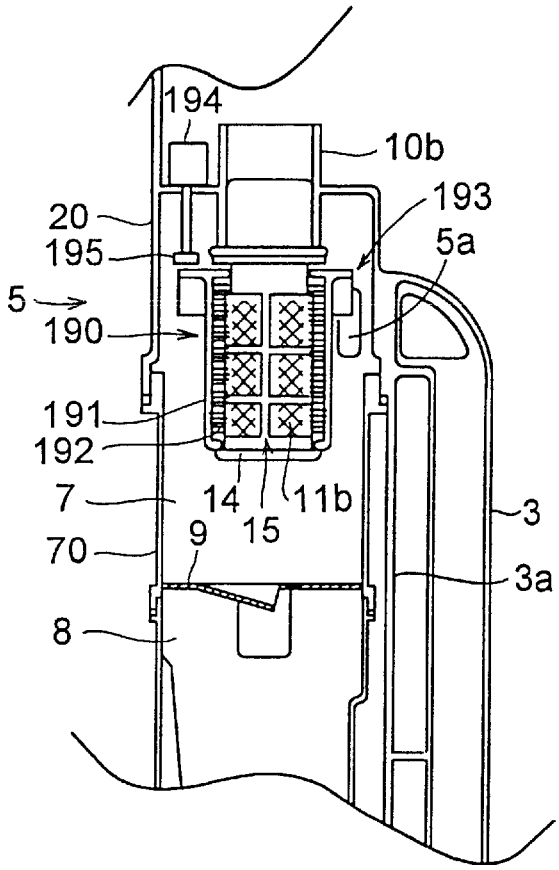
FIG. 44 is a vertical sectional view of the cyclone dust collector of the electric vacuum cleaner of an eighteenth embodiment.
Figure 45:
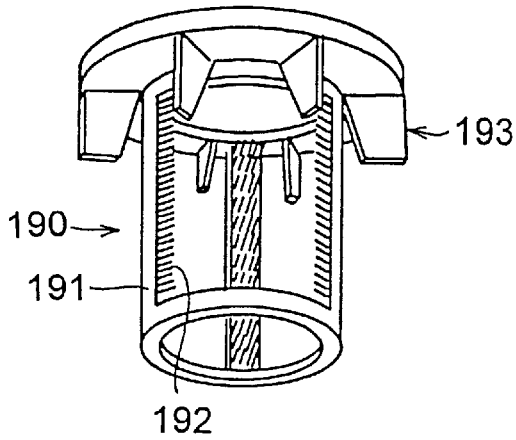
FIG. 45 is a perspective view of the cleaning member provided in the cyclone dust collector in the eighteenth embodiment.

An eighteenth embodiment of the invention will be described below. FIG. 44 is a vertical sectional view of the cyclone dust collector 5 of the electric vacuum cleaner of this embodiment. In this embodiment, a member 190 as shown in FIG. 45 is used to clean the filters 1 lb. This cleaning member 190, like the cleaning member 160 described previously, consists of a pair of upper and lower rings that are coupled together by a plurality of vertical ribs 191, and these vertical ribs 191 have brushes 192, which flexibly make contact with the filters 1*b*, fitted on their respective inner surfaces. The cleaning member 190 is arranged substantially coaxially with the exhaust tube 15. With the dust tray 14 detached from the exhaust tube 15, the cleaning member 190 is fit around the exhaust tube 15, and then the dust tray 14 is fixed to the exhaust tube 15 so as to prevent the cleaning member 190 from dropping out. In this way, like the cleaning member 160, the cleaning member 190 is fitted in position in such a way as to be slidable around, and thus rotatable with respect to, the exhaust tube 15.

The only difference is that the cleaning member 190 has, instead of a large gear, a pinwheel 193 formed at the upper end thereof The pinwheel 193 may be formed integrally with the ring-shaped upper portion of the cleaning member 190, or may be formed separately and then fixed to the cleaning member 190. The pinwheel 193 is located at the same level as the inlet 5*a* so as to rotate by receiving the air that flows in through the inlet 5*a*. This causes the entire cleaning member 190 to rotate and thereby clean the filters 11*b*. It is preferable that the cleaning member 190 rotate in the same direction as the flow of air whirling around the exhaust tube 15. This permits the cleaning member 190 to rotate more powerfully with the help of the force of the whirling air flow. This applies in the fourteenth to seventeenth embodiments also.

Reference numeral 194 represents a braking mechanism that is fitted on the suction air guide 20 and that has a brake shoe 195 that makes contact with the cleaning member 190. Normally, the brake shoe 195 is kept pressed against the cleaning member 190 by a spring (not shown) to keep the cleaning member 190 at rest. When the brake shoe 195 is pulled up with a motor, a solenoid, or the like so as to come away from the cleaning member 190, the cleaning member 190 starts rotating by being driven by the air flow that flows in through the inlet 5*a*. That is, by appropriately controlling the braking mechanism 194, the cleaning member 190 can be driven at will. As in arrangements in which the cleaning member is driven with a motor, the motor may be so programmed as to release braking at predetermined times, or release braking according to the difference between the pressures inside and outside the exhaust tube 15.

Nineteenth Embodiment

Figure 46:
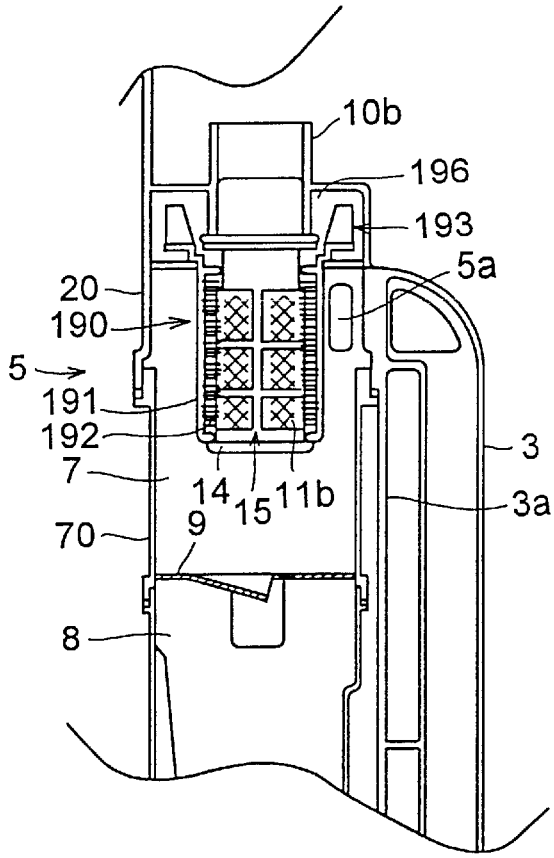
FIG. 46 is a vertical sectional view of the cyclone dust collector of the electric vacuum cleaner of a nineteenth embodiment.
Figure 47:
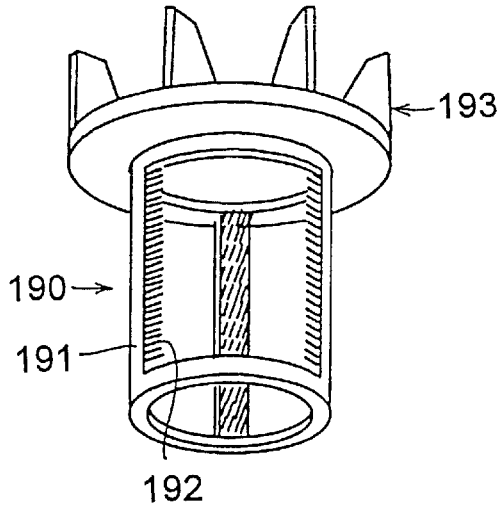
FIG. 47 is a perspective view of the cleaning member provided in the cyclone dust collector in the nineteenth embodiment.

FIG. 46 is a vertical sectional view of the cyclone dust collector 5 of the electric vacuum cleaner of a nineteenth embodiment of the invention, and FIG. 47 shows the cleaning member 190 used in this embodiment. This embodiment is a modified version of the eighteenth embodiment. The differences are that the vanes of the pinwheel 193 of the cleaning member 190 are so formed as to extend upward so that they are not hit by the air that flows in through the inlet 5*a*, and that a pinwheel chamber 196 is provided in the suction air guide 20 to house the pinwheel 193. The air with which to rotate the pinwheel 193 is introduced in the same manner as in the fourteenth, sixteenth, and seventeenth embodiments, where the air that flows in through the inlet 5*a* is not used to drive the pinwheel.

Twentieth Embodiment

Figure 48:
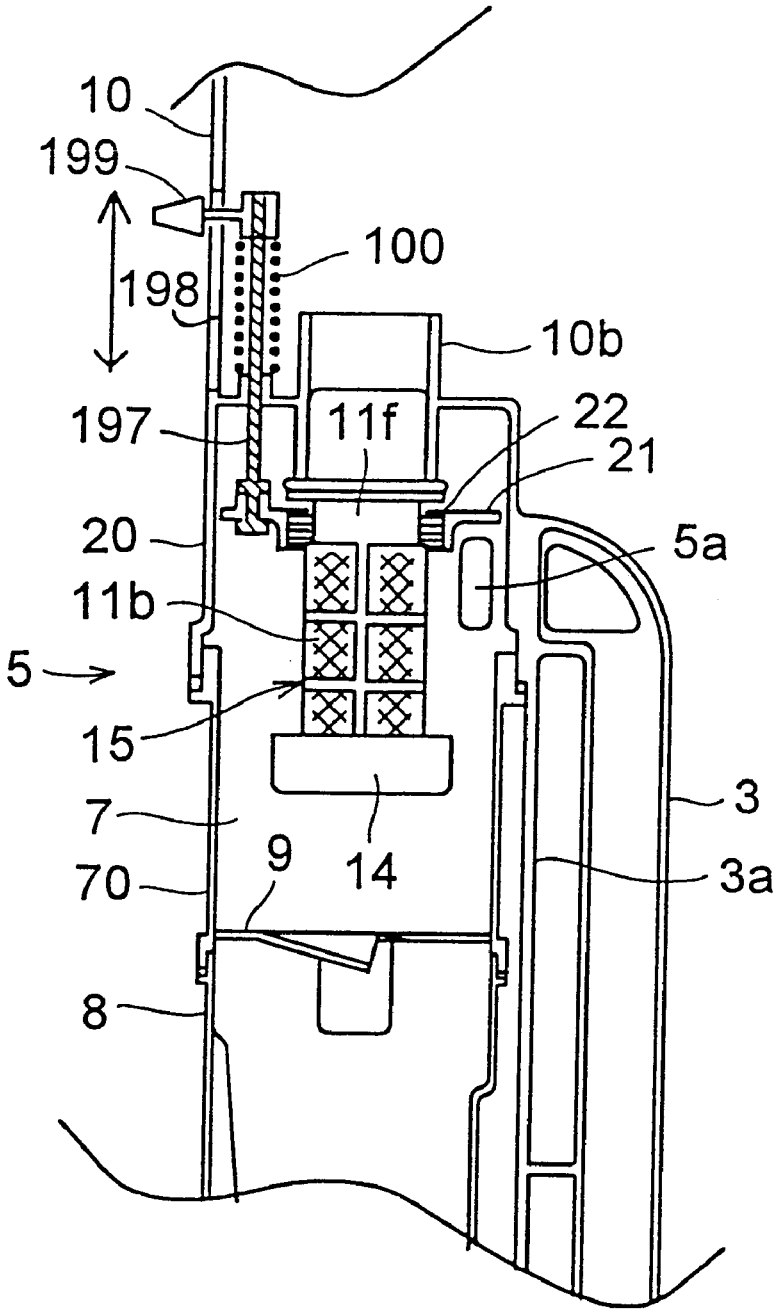
FIG. 48 is a vertical sectional view of the cyclone dust collector of the electric vacuum cleaner of a twentieth embodiment.

A twentieth embodiment of the invention will be described below. FIG. 48 is a vertical sectional view of the cyclone dust collector 5 of the electric vacuum cleaner of this embodiment. In this embodiment, the ring 21 of the same type as used in the eleventh and twelfth embodiments is used. This ring 21 is coupled to the lower end of a rod 197 that penetrates the upper partition wall of the suction air guide 20. To the upper end of the rod 197 is fixed a knob-like operation portion 199 that protrudes outward through a window 198 formed in the coupling member 10. The rod 197 is loaded with a force that presses it upward by a spring 100 inserted between the operation portion 199 and the upper partition wall of the suction air guide 20. Thus, the ring 21, which is coupled to the rod 197, is pulled up to the level at which the tips of the brush 22 are accommodated in the recessed portion 1 if. By repeatedly pressing down the operation portion 199 against the force exerted by the spring 100 and then releasing it, it is possible to move the ring 21 up and down together with the operation portion 199 and thereby clean the filters 11*b*.

The spring 100 may be omitted. Alternatively, the spring 100 may be so fitted as to exert its force in the opposite direction so that the ring 21 is loaded with a force that presses it downward. In this structure, by repeatedly pulling up the operation portion 199 against the force with which it is loaded and then releasing it, it is possible to clean the filters 11*b*. In this case, either an appropriate locking mechanism is provided to permit the ring 21 to stay around an upper portion of the exhaust tube 15, or the external dimensions of the ring 21 are reduced to widen the gap between the ring 21 and the inner wall of the suction air guide 20 to prevent obstruction of the air flow.

All the embodiments described above deal with cyclone-type electric vacuum cleaners. However, the structures that permit filter cleaning in the individual embodiments are applicable not only to cyclone-type electric vacuum cleaners but to electric vacuum cleaners of any type that is provided with a cylindrical filter.

Obviously, many modifications and variations of the present invention are possible in light of the above teachings. It is therefore to be understood that within the scope of the appended claims, the invention may be practiced other than as specifically described.

What is claimed is:

1. An electric vacuum cleaner comprising:

a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a removable exhaust tube that permits the suction air flow to flow to a downstream side of the suction air passage, the exhaust tube has an outlet formed in a peripheral surface thereof, and the outlet is fitted with a filter for removing dust, cleaning means for cleaning the filter and capable to be operated manually, and a dish-shaped member fitted on an end surface of the exhaust tube and having a gap for collecting dust between itself and the peripheral surface of the exhaust tube.

2. An electric vacuum cleaner comprising:

a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a removable exhaust tube that permits the suction air flow to flow to a downstream side of the suction air passage, the exhaust tube has an outlet formed in a peripheral surface thereof, and the outlet is fitted with a filter for removing dust, cleaning means for cleaning the filter and capable to be operated manually, and a cleaning cup that is fitted around the exhaust tube to prevent dust removed from the filter from being scattered when the filter is cleaned by the cleaning means.

3. An electric vacuum cleaner comprising:

a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a removable exhaust tube that permits the suction air flow to flow to a downstream side of the suction air passage, the exhaust tube has an outlet formed in a peripheral surface thereof, and the outlet is fitted with a filter for removing dust, cleaning means for cleaning the filter and capable to be operated manually, and a movable member coupled to the cleaning means and operated manually; and loading means for keeping the movable member pressed in a predetermined direction.

4. An electric vacuum cleaner comprising:

a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, the cyclone dust collector is provided with a dust collection chamber for collecting separated dust, and the dust collection chamber is divided by a first compartment close to where the suction air flow enters the dust collection chamber and a second compartment farther from where the suction air flow enters the dust collection chamber with a partition wall having an opening and arranged along a direction in which the suction air flow whirls around, wherein the opening of the partition wall has a slope portion formed so as to incline toward the second compartment the partition wall has a projection formed at substantially a center of a side thereof facing the second compartment.

5. The electric vacuum cleaner as claimed in claim 4, wherein the partition wall has a projection formed at substantially a center of a side thereof facing the second compartment.

6. The electric vacuum cleaner as claimed in claim 4, wherein, inside the second compartment, a projection is formed so as to obstruct the whirling air flow of the suction air flow.

7. An electric vacuum cleaner comprising:

a nozzle unit having a nozzle, an electric blower for producing a suction air flow, a suction air passage running between the nozzle unit and the electric blower, and a separator arranged in the suction air passage for separating dust from the suction air flow, further comprising:

a detachable dust collection chamber that communicates with the separator and in which separated dust is collected;

a filter through which the suction air flow from the separator passes to flow to a downstream side of the suction air passage; and cleaning means that cleans the filter in a manner interlocked with movement of the dust collection chamber as the dust collection chamber is attached and detached from a suction air guide.

8. An electric vacuum cleaner comprising a nozzle unit having a nozzle, an electric blower for producing a suction air flow, a suction air passage running between the nozzle unit and the electric blower, and a separator arranged in the suction air passage for separating dust from the suction air flow, further comprising:

the separator being a detachable dust collection chamber in which the separated dust is collected;

an exhaust tube that has an outlet, fitted with a filter, formed in a peripheral surface thereof, that is inserted into the dust collection chamber through an opening formed in a wall of the dust collection chamber in such a way that the outlet is located inside the dust collection chamber, and that permits the suction air flow from the dust collection chamber to flow through the outlet to a downstream side of the suction air passage; and cleaning means provided at a rim of the opening of the dust collection chamber for cleaning the filter.

9. An electric vacuum cleaner comprising a nozzle unit having a nozzle, an electric blower for producing a suction air flow, a suction air passage running between the nozzle unit and the electric blower, and a separator arranged in the suction air passage for separating dust from the suction air flow, further comprising:

a detachable dust collection chamber that functions as the separator and in which the separated dust is collected;

an exhaust tube that has an outlet, fitted with a filter, formed in a peripheral surface thereof, that is inserted into the dust collection chamber through an opening formed in a wall of the dust collection chamber in such a way that the outlet is located inside the dust collection chamber, and that permits the suction air flow from the dust collection chamber to flow through the outlet to a downstream side of the suction air passage, cleaning means provided at a rim of the opening of the dust collection chamber for cleaning the filter, wherein the exhaust tube is fixed in the suction air passage, the dust collection chamber is attached and detached from the vacuum cleaner by being moved along an axis of the exhaust tube, and the cleaning means cleans the filter as the dust collection chamber is attached and detached.

10. The electric vacuum cleaner as claimed in claim 9, further comprising:

guiding means for guiding movement of the dust collection chamber when the dust collection chamber is attached and detached, the guiding means comprising:

a slit that extends along the axis of the exhaust tube;

a sliding member that slides inside the slit and to which the dust collection chamber is detachably attached; and a locking member that engages with the sliding member at one end of the slit to keep the sliding member in a fixed position, wherein the dust collection chamber is attached to the suction air passage when the sliding member is located at said one end of the slit and the dust collection chamber is detached from the suction air passage when the sliding member is located at another end of the slit.

11. An electric vacuum cleaner comprising a nozzle unit having a nozzle, an electric blower for producing a suction air flow, a suction air passage running between the nozzle unit and the electric blower, and a separator arranged in the suction air passage for separating dust from the suction air flow, further comprising:

a detachable dust collection chamber that functions as the separator and in which the separated dust is collected;

an exhaust tube that has an outlet, fitted with a filter, formed in a peripheral surface thereof, that is inserted into the dust collection chamber through an opening formed in a wall of the dust collection chamber in such a N way that the outlet is located inside the dust collection chamber, and that permits the suction air flow from the dust collection chamber to flow through the outlet to a downstream side of the suction air passage;

cleaning means provided at a rim of the opening of the dust collection chamber for cleaning the filter, wherein the exhaust tube is freely detachable from the suction air passage, and is fitted to the dust collection chamber through engagement with a first engagement means.

12. The electric vacuum cleaner as claimed in claim 11, wherein the cleaning means cleans the filter when the engagement realized by the first engagement means is released and the exhaust tube is pulled out of the dust collection chamber.

13. The electric vacuum cleaner as claimed in claim 11, wherein, on the downstream side of the suction air passage, a coupling pipe is provided, and the exhaust tube is fitted into the coupling pipe with a gasket fitted in between.

14. The electric vacuum cleaner as claimed in claim 11, wherein the wall having the opening formed therein is detachable from a remaining portion of the dust collection chamber.

15. The electric vacuum cleaner as claimed in claim 11, wherein the first engagement means consists of a first projection that extends from the peripheral surface of the exhaust tube perpendicularly to an axis of the exhaust tube and a first L-shaped cut formed in the wall so as to extend from an exterior surface of the wall first along the axis of the exhaust tube and then along a periphery of the exhaust tube.

16. The electric vacuum cleaner as claimed in claim 15, wherein the wall is fitted to a remaining portion of the dust collection chamber through engagement with second engagement means, and the second engagement means consists of a second projection that extends from a periphery of the wall perpendicularly to the axis of the exhaust tube and a second L-shaped cut formed in said remaining portion so as to extend from one end of said remaining portion first along the axis of the exhaust tube and then along the periphery of the exhaust tube.

17. The electric vacuum cleaner as claimed in claim 16, wherein the first and second cuts are L-shaped in opposite directions.

18. An electric vacuum cleaner comprising a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling airflow, further comprising:

compressing means for compressing dust collected inside the cyclone dust collector, wherein the compressing means comprises an operation member located outside the cyclone dust collector and capable of being operated manually and a compressing member located inside the cyclone dust collector and interlocked with the operation member.

19. An electric vacuum cleaner comprising a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, further comprising:

compressing means for compressing dust collected inside the cyclone dust collector, and a work chamber that is located above the cyclone dust collector and through which the cyclone dust collector communicates with a downstream side of the dust suction passage, wherein the compressing means comprises a float arranged inside the work chamber and kept pressed downward, a compressing member arranged inside the cyclone dust collector, and a coupling rod that couples the float and the compressing member together.

20. The electric vacuum cleaner as claimed in claim 19, further comprising:

an exhaust tube that is arranged in the work chamber so as to reach into the cyclone dust collector and that has an outlet, fitted with a filter, formed in a peripheral surface thereof inside the cyclone dust collector so as to permit the suction air flow to flow from the cyclone dust collector through the outlet to the work chamber, wherein the coupling rod is fitted into the exhaust tube.

21. The electric vacuum cleaner as claimed in claim 20, further comprising:

cleaning means that is coupled to the float and which cleans the filter relative to movement of the float.

22. An electric vacuum cleaner comprising a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, wherein the cyclone dust collector comprises:

an exhaust tube having an outlet, fitted with a filter, formed in a peripheral surface thereof so as to permit the suction air flow to flow through the outlet to a downstream side of the suction air passage; and cleaning means operatively connected to the vacuum cleaner that cleans the filter by using the force of the suction air flow that flows out of the exhaust tube.

23. An electric vacuum cleaner comprising a nozzle unit having a nozzle, an electric blower for producing a suction air flow, a suction air passage running between the nozzle unit and the electric blower, and a cyclone dust collector arranged in the suction air passage for separating dust from the suction air flow by turning the suction air flow that flows into the cyclone dust collector into a whirling air flow, wherein the cyclone dust collector comprises:

an exhaust tube having an outlet, fitted with a filter, formed in a peripheral surface thereof so as to permit the suction air flow to flow through the outlet to a downstream side of the suction air passage; and cleaning means operatively connected to the vacuum cleaner that cleans the filter by using the force of the suction air flow that is flowing out of the exhaust tube, and a work chamber that is located above the cyclone dust collector, that communicates with the cyclone dust collector through the exhaust tube, and that communicates with the downstream side of the suction air passage.

24. An electric vacuum cleaner comprising:

a nozzle unit having a nozzle, an electric blower for producing a suction air flow, a suction air passage running between the nozzle unit and the electric air blower, and a separator arranged in the suction air passage for separating dust from the suction air flow, further comprising:

a dust collection chamber that communicates with the separator and in which separated dust is collected;

an exhaust tube having an outlet, fitted with a filter, formed in a peripheral surface thereof so as to permit the suction air flow to flow from the separator through the outlet to a downstream side of the suction air passage; and a cleaning member effective to move along the longitudinal axis of the exhaust tube while keeping contact with the filter and thereby cleans the filter.

25. The electric vacuum cleaner as claimed in claim 24, wherein the exhaust tube is substantially cylindrical in shape, and the cleaning member rotates about the longitudinal axis of the exhaust tube.

26. The electric vacuum cleaner as claimed in claim 24, further comprising:

a driving mechanism for moving the cleaning member.

27. The electric vacuum cleaner as claimed in claim 26, wherein the driving mechanism moves the cleaning member at a predetermined time.

28. The electric vacuum cleaner as claimed in claim 26, further comprising:

a motor for supplying the driving mechanism with driving power with which to move the cleaning member.

29. The electric vacuum cleaner as claimed in claim 26, wherein the driving mechanism moves the cleaning member by using as driving power the suction air flow produced by the electric blower.

30. The electric vacuum cleaner as claimed in claim 29, further comprising:

a control mechanism for controlling the suction air flow that the driving mechanism uses as driving power.

31. An electric vacuum cleaner comprising:

a nozzle unit having a nozzle, an electric blower for producing a suction air flow, a suction air passage running between the nozzle unit and the electric blower, and a separator arranged in the suction air passage for separating dust from the suction air flow, further comprising:

a dust collection chamber that communicates with the separator and in which separated dust is collected;

an exhaust tube having an outlet, fitted with a filter, formed in a peripheral surface thereof so as to permit the suction air flow to flow from the separator through the outlet to a downstream side of the suction air passage;

a cleaning member that moves while keeping contact with the filter and thereby cleans the filter, and a loading member for keeping the cleaning member pressed along the axis of the exhaust tube, wherein the dust collection chamber is detachable from the separator, and is attached thereto by moving the cleaning member against a force with which the cleaning member is kept pressed by the loading member.

32. An electric vacuum cleaner comprising:

a nozzle unit having a nozzle, an electric blower for producing a suction air flow, a suction air passage running between the nozzle unit and the electric blower, and a separator arranged in the suction air passage for separating dust from the suction air flow, further comprising:

a dust collection chamber that communicates with the separator and in which separated dust is collected;

an exhaust tube having an outlet, fitted with a filter, formed in a peripheral surface thereof so as to permit the suction air flow to flow from the separator through the outlet to a downstream side of the suction air passage;

a cleaning member that moves while keeping contact with the filter and thereby cleans the filter, and an operation member arranged outside the dust collection chamber effective to be manually operated; and a coupling member for coupling the operation member and the cleaning chamber together.

* * * * *